US012741792B2

(12) United States Patent
Lown

(10) Patent No.: US 12,741,792 B2
(45) Date of Patent: Sep. 22, 2026

(54) DRINKING ASSEMBLY AND RELATED METHODS

(71) Applicant: Takeya USA Corporation, Costa Mesa, CA (US)

(72) Inventor: John M. Lown, Palm Springs, CA (US)

(73) Assignee: Takeya USA Corporation, Costa Mesa, CA (US)

( * ) Notice: Subject to any disclaimer, the term of this patent is extended or adjusted under 35 U.S.C. 154(b) by 0 days.

(21) Appl. No.: 19/224,978

(22) Filed: Jun. 2, 2025

(65) Prior Publication Data

US 2026/0125189 A1 May 7, 2026

Related U.S. Application Data

(60) Provisional application No. 63/716,333, filed on Nov. 5, 2024.

(51) Int. Cl.

| | |
|---|---|
| ***A47G 19/22*** | (2006.01) |
| ***B65D 43/02*** | (2006.01) |
| ***B65D 47/08*** | (2006.01) |

(52) U.S. Cl.

CPC ..... *B65D 47/08* (2013.01); *B65D 43/0212* (2013.01); *B65D 43/0225* (2013.01); *B65D 2543/00046* (2013.01)

(58) Field of Classification Search

CPC ..... B65D 47/08; B65D 43/0212; B65D 43/0225; B65D 2543/00046; B65D 51/242; B65D 47/066; B65D 47/0885; B65D 47/142; B65D 2251/1058; B65D 43/0229; B65D 47/0871; B65D 55/16; B65D 2251/1066; B65D 25/2835; B65D 25/40; A47G 19/2266; A47G 19/2272

(Continued)

(56) References Cited

U.S. PATENT DOCUMENTS 4,756,440 A * 7/1988 Gartner ..... B65D 47/06 220/254.1
4,899,902 A * 2/1990 DeMars ..... B65D 43/0212 220/254.3

(Continued)

FOREIGN PATENT DOCUMENTS

KR 20-0363144 Y1 9/2004

OTHER PUBLICATIONS

Internaional Search Report and Written Opinion on corresponding PCT application No. PCT/US2025/037502 from the International Searching Authority dated Nov. 17, 2025, pp. 1-14.

*Primary Examiner* — King M Chu
(74) *Attorney, Agent, or Firm* — Alumen IP Law PC

(57) ABSTRACT

A drink assembly including a vessel having an open top and a bottom and a lid assembly removably connected to the vessel. The lid assembly includes a lid body and a mouthpiece extending upwardly from the lid body. The mouthpiece includes a mouthpiece body having an upper end that is sized for use without requiring, or with only minimal, puckering of the lips. The upper end includes a first rim portion including simple curvature and a second rim portion opposite the first rim portion and including a contour defined by a compound curve. The mouthpiece further including a through hole extending through the mouthpiece body and fluidly coupled to the vessel.

30 Claims, 52 Drawing Sheets

(58) Field of Classification Search
USPC ..... 220/703, 705, 709; 215/237, 229, 235, 215/387
See application file for complete search history.

(56) References Cited

U.S. PATENT DOCUMENTS

| | | | | |
|---|---|---|---|---|
| 4,961,510 | A * | 10/1990 | Dvoracek | B65D 25/48 220/717 |
| 6,923,337 | B2 * | 8/2005 | Hession | B65D 47/2018 220/717 |
| 8,678,228 | B2 * | 3/2014 | Steininger | A61J 9/085 220/717 |
| 2007/0045316 | A1 | 3/2007 | Arnljots | |
| 2013/0037510 | A1 | 2/2013 | Tamarit Rios | |
| 2015/0201773 | A1 | 7/2015 | Sorensen et al. | |
| 2019/0344934 | A1 | 11/2019 | Faerber et al. | |

* cited by examiner

DRINKING ASSEMBLY AND RELATED METHODS

CROSS-REFERENCED TO RELATED APPLICATION

This is a regular utility of provisional application No. 63/716,333, filed on Nov. 5, 2024, the contents of which are expressly incorporated herein by reference.

FIELD OF ART

The present disclosure is generally related to assemblies for drinking with specific discussions on assemblies having an ergonomic lid and a container vessel and related methods.

BACKGROUND

Drinking containers or drink containers are well known for a variety of situations for hydrating, such as for office use, for hiking, and for playing physical sports. Drinking containers come in a variety of types, typically with a lid and a base or drinking vessel. The lid and the base can typically attach by threads or by snap fitting. The base can be made from plastic or from metal. The base can be a single walled container or a double walled vacuum sealed container for insulation. The lid can have a drink opening to allow fluids inside the base to dispense for drinking. The drinking opening can open and close using a simple threaded cap or with an actuator. The drinking container can further include an internal straw, such as a detachable straw that is compression fit onto a corresponding protrusion on the underside of the lid.

SUMMARY

Broadly speaking, aspects of the invention are directed to a water bottle, which can be called a drink assembly. The drink assembly can have a container vessel or base and a lid assembly. Various components can be incorporated with the lid assembly to provide useful functionalities for the user.

In one embodiment, there is provided a drink assembly including a vessel having an open top and a bottom and a lid assembly removably connected to the vessel. The lid assembly includes a lid body and a mouthpiece extending upwardly from the lid body. The mouthpiece includes a mouthpiece body having an asymmetrical upper end. The upper end includes a rim with a first rim portion and a second rim portion. The first and second rim portions are divided at a tapered end line, which passes through two tapered ends of the mouthpiece. The first rim portion including one angle of curvature, which is understood as a circular curve, a curved line, or a single radius curve, and a second rim portion opposite the first rim portion comprising a compound curve with three or more different radii. The mouthpiece further including a through hole extending throughout the mouthpiece body and fluidly coupled to the vessel. As sometimes used herein, the first rim is understood to mean the first rim portion and the second rim is understood to mean a second rim portion.

In one embodiment, the first rim portion of the upper end of the mouthpiece body comprises a single angle of curvature defining a single convex rim.

In one embodiment, the second rim portion of the upper end of the mouthpiece body comprises a pair of convex portions and a concave portion in between the convex portions defining a nadir between the opposing convex portions.

In one embodiment, the nadir of the second rim portion is configured to accommodate a center tubercle of an upper lip of a user.

In one embodiment, the pair of convex portions of the second rim portion slope upwardly and outwardly from the convex portion and downwardly to respective lateral ends.

In one embodiment, the pair of convex portions of the second rim are configured to respectively accommodate lateral tubercles of an upper lip of a user.

In one embodiment, the first rim of the upper end of the mouthpiece is configured to accommodate and engage with a lower lip of a user.

In one embodiment, the second rim of the upper end of the mouthpiece is configured to accommodate and engage with an upper lip of a user.

In one embodiment, the first and second rim of the upper end of the mouthpiece are configured to allow a user to drink therefrom without puckering their lips.

In one embodiment, the mouthpiece body further comprises opposed lateral ridges each defining a connection point between the first rim and the second rim.

In one embodiment, each lateral ridge is tapered from bottom to top.

In one embodiment, each lateral ridge defines a lateralmost apex.

In one embodiment, the opposed lateral ridges are configured to respectively accommodate opposed oral commissures of a mouth of a user such that the user need not pucker their lips to drink from the mouthpiece.

In one embodiment, the mouthpiece is angled forwardly such that a longitudinal axis of the mouthpiece is angled forwardly relative to a longitudinal axis of the vessel by approximately 15 degrees.

In one embodiment, the drinking assembly further includes a cap pivotally connected to the lip body and configured to pivot in between a closed position in which the cap covers the mouthpiece and an open position in which the cap exposes the mouthpiece.

In one embodiment, the cap comprises a pair of internally disposed structural members configured to flank and abut the mouthpiece in the closed position of the cap.

In one embodiment, the cap comprises an open bottom with a ridge that contacts a top of the lid body in the closed position.

In one embodiment, the cap includes a bottom, a first anchor post and a second anchor post extending downwardly from the bottom, and a seal connected to the bottom. The seal includes a vent protrusion fitted about the first anchor post and configured to seal a vent of the lid body when the cap is in its closed position, and a mouthpiece protrusion fitted about the second anchor post and configured to seal the through hole of the mouthpiece when the cap is in its closed position.

In one embodiment, there is provided a lid assembly configured to be removably connected to a handheld drinking vessel. The lid assembly includes a lid body and a mouthpiece extending upwardly from the lid body. The mouthpiece includes a mouthpiece body having an asymmetrical upper end. The upper end includes a first rim including one angle of curvature and a second rim opposite the first rim and including three differing angles of curvature. The mouthpiece further includes a through hole extending throughout the mouthpiece body.

In one embodiment, there is provided a lid assembly configured to be removably connected to a handheld drinking vessel. The lid assembly includes a lid body including an open bottom configured to connect to the drinking vessel, a top end comprising a first, flat top wall and a second, curved top wall extending above the flat top wall. The curved top wall is configured to accommodate a nose of a user when drinking from the vessel. The lid body further includes a vent extending through the curved top wall and a main opening configured to accommodate liquid therethrough. The lid assembly further includes a mouthpiece extending upwardly from the lid body. The mouthpiece includes a mouthpiece body and a through hole extending throughout the mouthpiece body and fluidly connected to the main opening of the lid body.

BRIEF DESCRIPTION OF THE DRAWINGS

These and other features and advantages of the present devices, systems, and methods will become appreciated as the same becomes better understood with reference to the specification, claims and appended drawings wherein:

FIG. 52B is a schematic cross-sectional view of the lid assembly of FIG. 52B.

DETAILED DESCRIPTION

The detailed description set forth below in connection with the appended drawings is intended as a description of the presently preferred embodiments of drinking assemblies or drinking containers provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like element numbers are intended to indicate like or similar elements or features.

Descriptions of technical features or aspects of an exemplary configuration of the disclosure should typically be considered as available and applicable to other similar features or aspects in another exemplary configuration of the disclosure. Accordingly, technical features described herein according to one exemplary configuration of the disclosure may be applicable to other exemplary configurations of the disclosure, and thus duplicative descriptions may be omitted herein.

Figure 1:
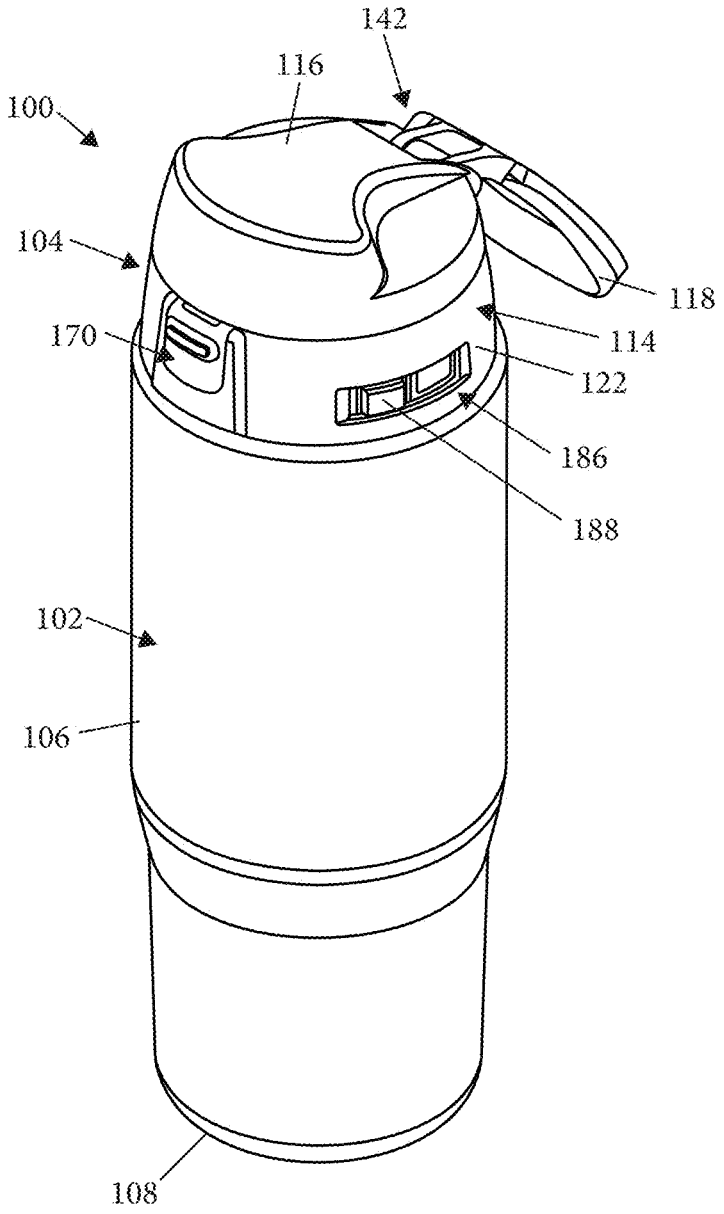
FIG. 1 is a front perspective view of an exemplary embodiment of a drinking assembly in accordance with aspects of the invention, the drinking assembly including a drinking vessel, a lid assembly removably connected to the drinking vessel, and an internally disposed straw.

With reference now to FIGS. 1-24, there is shown an embodiment of a drinking assembly or drinking container 100, in accordance with aspects of the invention. FIG. 1 is a front perspective view of the drinking assembly 100. With specific reference to FIG. 1, the drinking assembly 100 has a drinking vessel or base 102 removably connected to a lid assembly 104. In an example, the drinking assembly 100 can be a tumbler.

The drinking vessel 102 can have a body 106 with a closed bottom 108 (FIG. 3), an open top end 110, and a threaded neck 112 which defines the open top end 110. The body 106 of the drinking vessel 102 can have a single diameter, a tapered diameter, or a multitiered diameter. As shown throughout FIGS. 1-24, the body 106 comprises a two-tiered body with a lower section having a smaller diameter than an upper section (unnumbered), which is configured to fit in a typical cup holder of an automobile. The drinking vessel 102 can be made from a single layer plastic construction, a single layer metal construction, or a double-walled vacuum sealed stainless steel construction. The body 106 of the drinking vessel 102 can embody other shapes and sizes, including traditional sizes such as 18-ounce, 24-ounce, 32 ounce, 40-ounce, and 64-ounce. The exterior of the body 106 of the drinking vessel 102 and the lid assembly 104 can be provided with colors, with a combination of colors, as a single solid color, clear, and/or metallic.

Figure 3:
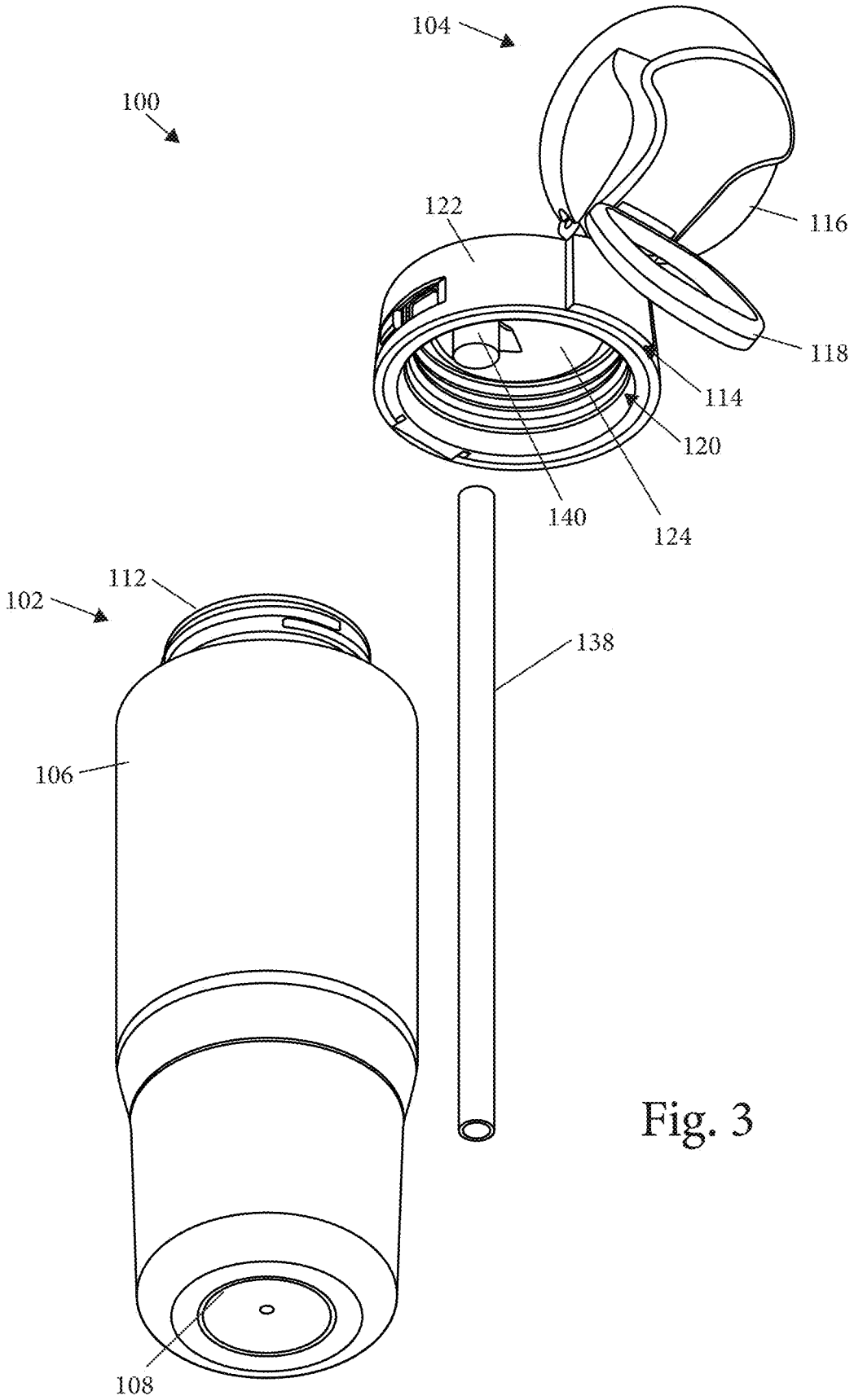
FIG. 3 is an underside perspective and exploded view of the drinking assembly of FIG. 1.

The lid assembly 104 can have a lid body 114, a movable cap or cover 116, and a handle 118 that can be rigidly fixed and stationary or movable relative to the lid body. In some examples, the lid assembly can be practiced without the cap or cover, just the lid body. For example, the lid body with the mouthpiece or nozzle discussed herein can be adapted on a reusable lid for use with a disposable cup or a coffee mug. The lid body 114 includes an open bottom end 120, an annular ring section or sidewall section 122 depending from the upper wall or top wall 126 of the lid body and terminating in the open bottom end 120. The sidewall section 122 of the lid body is also known as a skirt and, in the present embodiment, has internally disposed threads (unnumbered) for threading onto corresponding threads (unnumbered) on the threaded neck 112 of the drinking vessel 102. The lid body 114 has a top wall 126 and an opposite bottom wall 124 (FIG. 3). In some examples, the top wall 126 can have a step defining a raised top wall 128 section. Said differently, the lid body can have a multitiered top wall 126, 128. The lid body 114 further includes a vent 130 with a vent opening 132 (FIG. 9) and a nozzle or spout 134 which defines a mouthpiece 134 with a mouthpiece opening 136, as discussed in more detail below. As clearly shown, the spout or mouthpiece 134 is rigidly fixed to the top wall and is not rotatable relative to the top wall since the spout is unitarily formed with the lid body, which includes the top wall.

In one embodiment, the multitiered top wall 126, 128 can include a first top wall 126 having a flat top wall or plane and a second top wall 128 having an accurate or curved top wall or plane extending above the flat top wall, and having a shoulder or step therebetween. In some examples, the first and the second top wall sections 126, 128 can have a smooth transition therebetween to resemble a single tapered top wall. The curved second top wall 128 defines a raised, beveled, and circular pad or platform 128 that rests atop or is elevated above the first top wall 126. The mouthpiece 134 can be located within the boundary of the second top wall 128 and the first top wall 126 can be provided to mate against the rim of the cap. The second top wall or top wall section 128 performs multiple functions, including accommodating a user's nose because the curved top wall 128 tapers downwardly as it extends away from the mouthpiece 134 to thereby provide space for the user's nose. Additionally, the curved top wall 128 raises the height of the vent 130, and thereby its opening 132 therewith, which allows the vent 130 to be sealed by the cap 116, as discussed in more detail below.

In the embodiment shown, the lid body 114 and the drinking vessel 102 are threadably connected with one another; however, the removable connection between the lid body 114 and the drinking vessel 102 can be variously configured, such as being in a snap fit arrangement. The lid body 114 and the drinking vessel 102 can be structured, such as offset or recessed, to have a smooth or constant exterior at the interface. As shown, the lid body 114 has an outer perimeter that terminates slightly inwardly of the outer perimeter of the top of the drinking vessel 102 (unnumbered). In an alternative embodiment, the lid body 114 can include a skirt that may rest flush against or extend over a portion of the top of the drinking vessel 102.

In another embodiment, the multitiered top wall 126, 128 can include a scented holder, such as a recess or a housing for housing a scent packet for flavoring the liquid within the vessel. In such a configuration, the user may open the sent holder, if equipped with a door or latch, place the scent packet within the holder, and thereafter reclose the scent holder.

Figure 2:
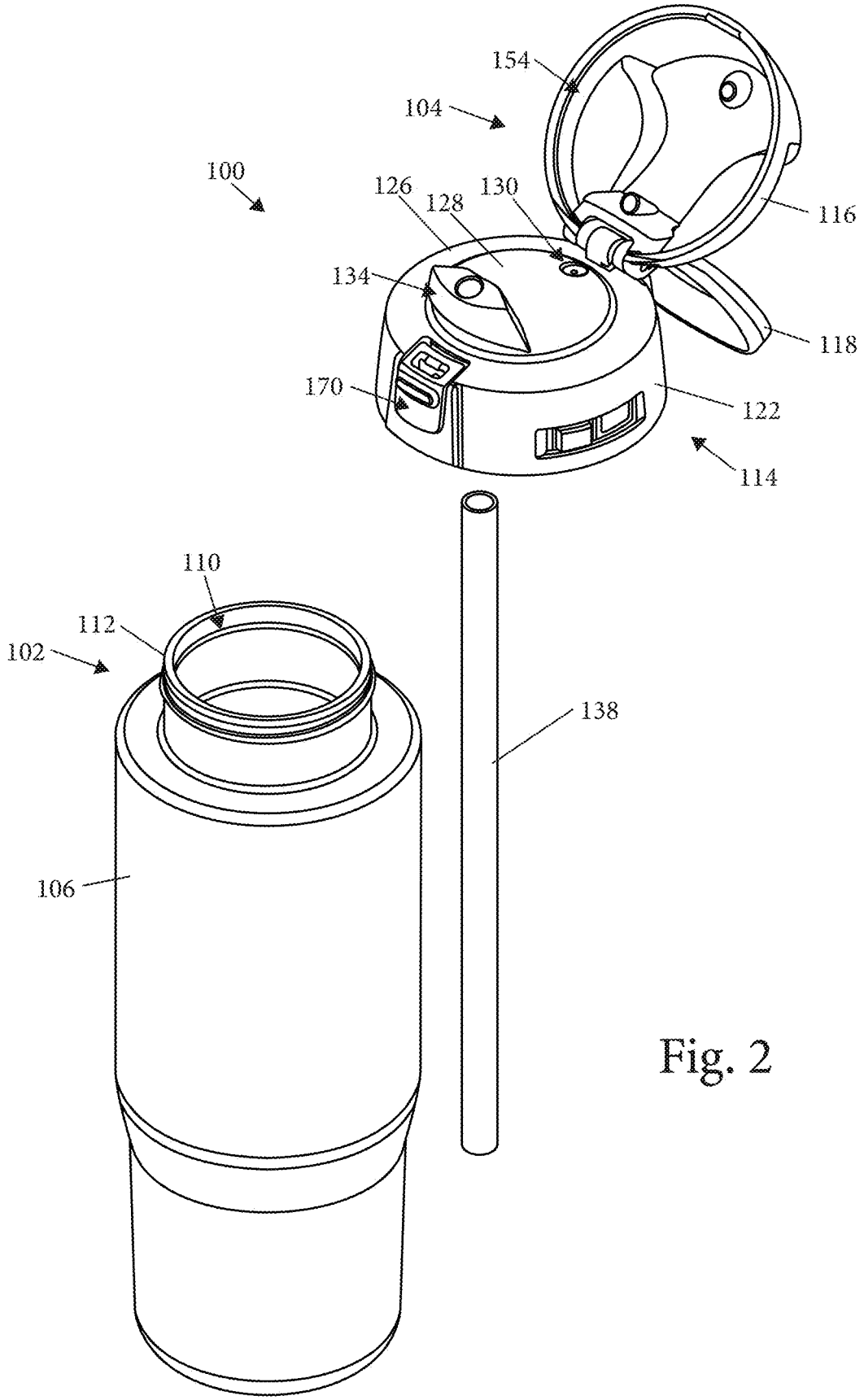
FIG. 2 is an elevated perspective and exploded view of the drinking assembly of FIG. 1.
Figure 4:
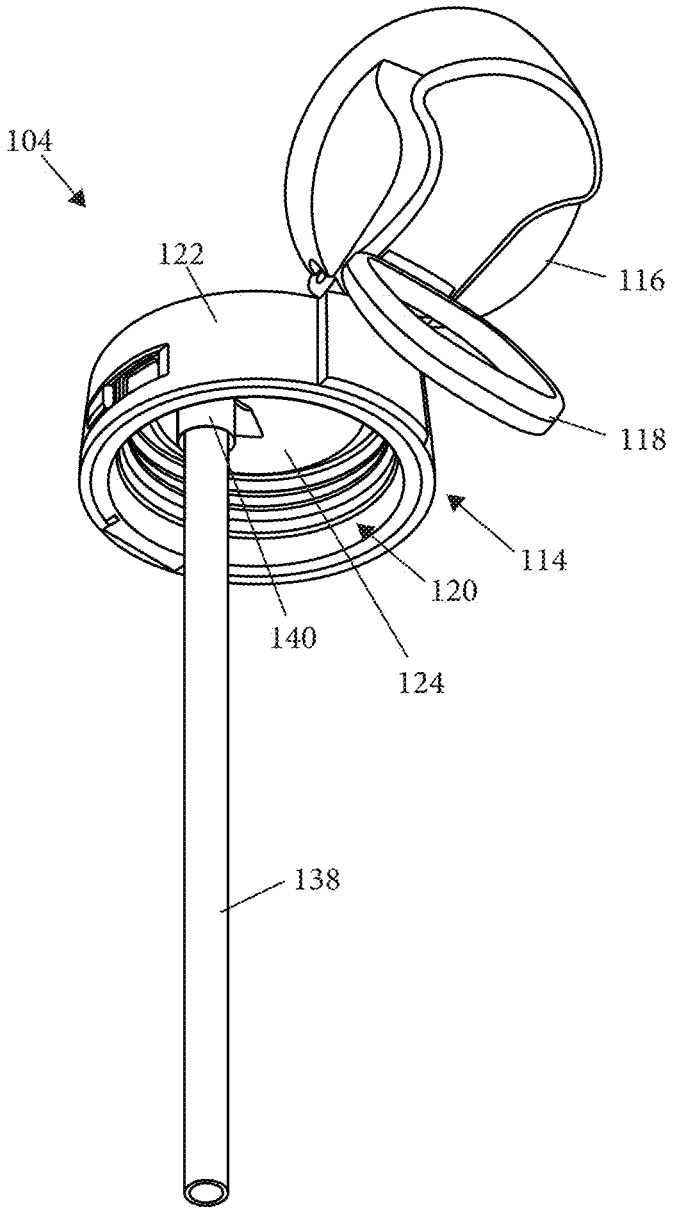
FIG. 4 is an underside perspective view of the lid assembly and the straw connected thereto.

With collective reference to FIGS. 2-4, the drinking assembly 100 can further include a straw 138 removably connected to the lid body 114, in some embodiments. FIGS. 2-3 respectively illustrate a top perspective exploded view (FIG. 2) and a bottom perspective exploded view (FIG. 3) of the drinking assembly 100. As shown in FIG. 4, the straw 138 can be compression fit into a straw receiving receptacle 140 which can be formed integrally within or connected on the bottom wall 124 of the lid body 114. The straw receiving receptacle 140 has an opening or bore (unnumbered) to dually receive the straw 138 therein and fluidly couple the straw 138 to the mouthpiece opening 136. Thus, a flow passage is provided through the top wall to enable fluid communication between the mouthpiece opening 136 and the straw receiving receptacle 140. The straw receiving receptacle 140 is sized and shaped to correspond to the size and shape of the straw 138, and to grip the straw in an interference fit or a tapered fit, similar to luer fittings. The straw 138 can be reusable, can have a lumen, and can have a length that has a first end connected to the straw receiving receptacle 140 and a second end that is located next to the interior enclosed bottom of the drinking vessel 102 (see e.g., FIG. 8), such as within about 1-inch or less from the enclosed bottom, preferably within about 0.25-inches from the enclosed bottom. However, the straw may be connected to the lid body 114 in any desired fashion, including for example being compression fit over a bored stem of the lid body 114 or threadably connected to the lid body 114.

In operation, the user can use the drinking assembly 100 with or without the straw 138. When the straw 138 is coupled to the straw receiving receptacle 140, a user can take a drink from the drink assembly 100 by placing the user's lips around the mouthpiece 134 to form a seal therearound. The user can then draw a vacuum or suck in air to draw up fluid through the straw 138, through the opening 136 of the mouthpiece 134, and into the user's mouth. At the same time fluid is being drawn through the straw 138, air can vent through the vent opening 132 of the vent 130, which is spaced from the mouthpiece 134 and the mouthpiece opening 136 thereof by the curved top wall 128 of the lid body 114. Alternatively, the drink assembly 100 can be used without the straw 138 connected to the straw receiving receptacle 140, such as by chugging.

Figure 5:
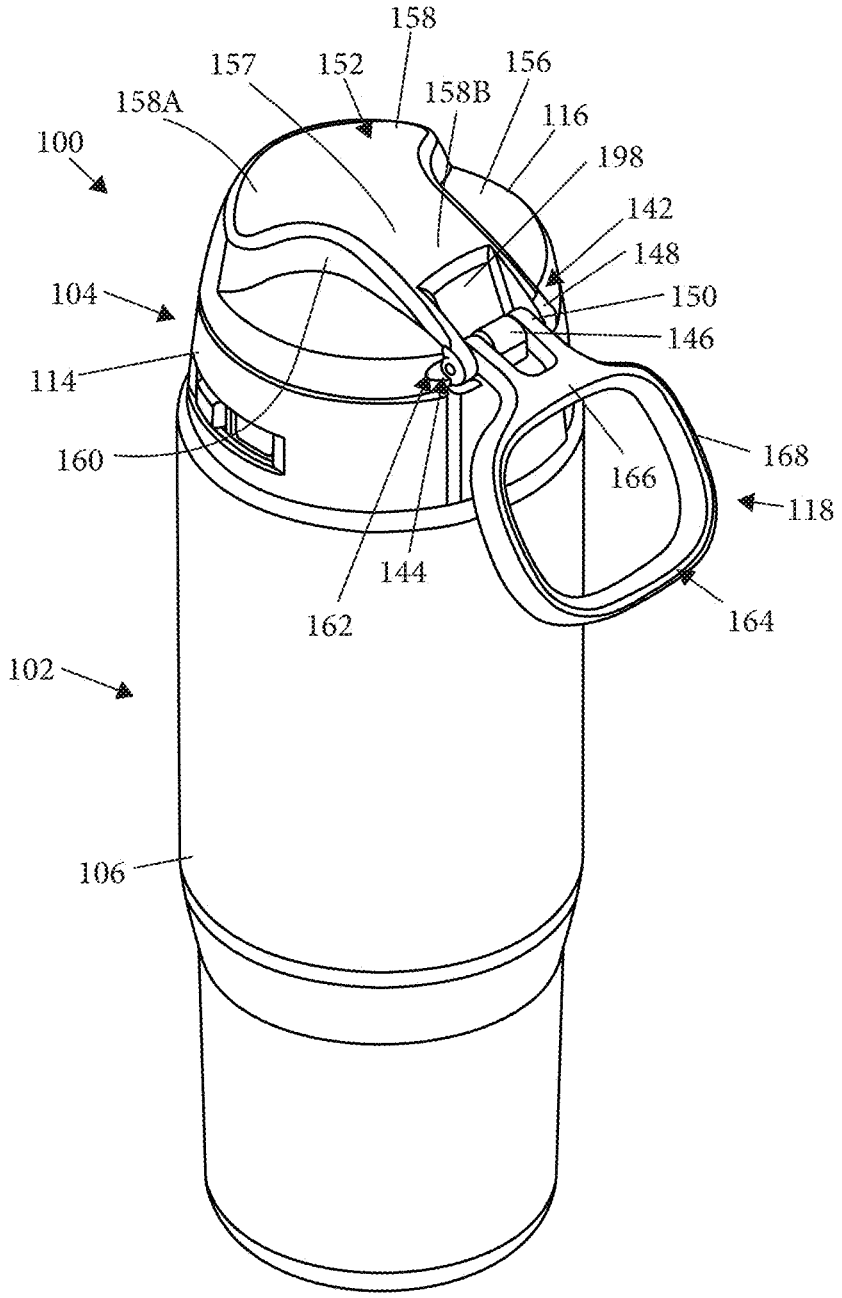
FIG. 5 is a rear perspective view of the drinking assembly of FIG. 1, wherein the handle is pivoted downwardly in a retracted position.
Figure 6:
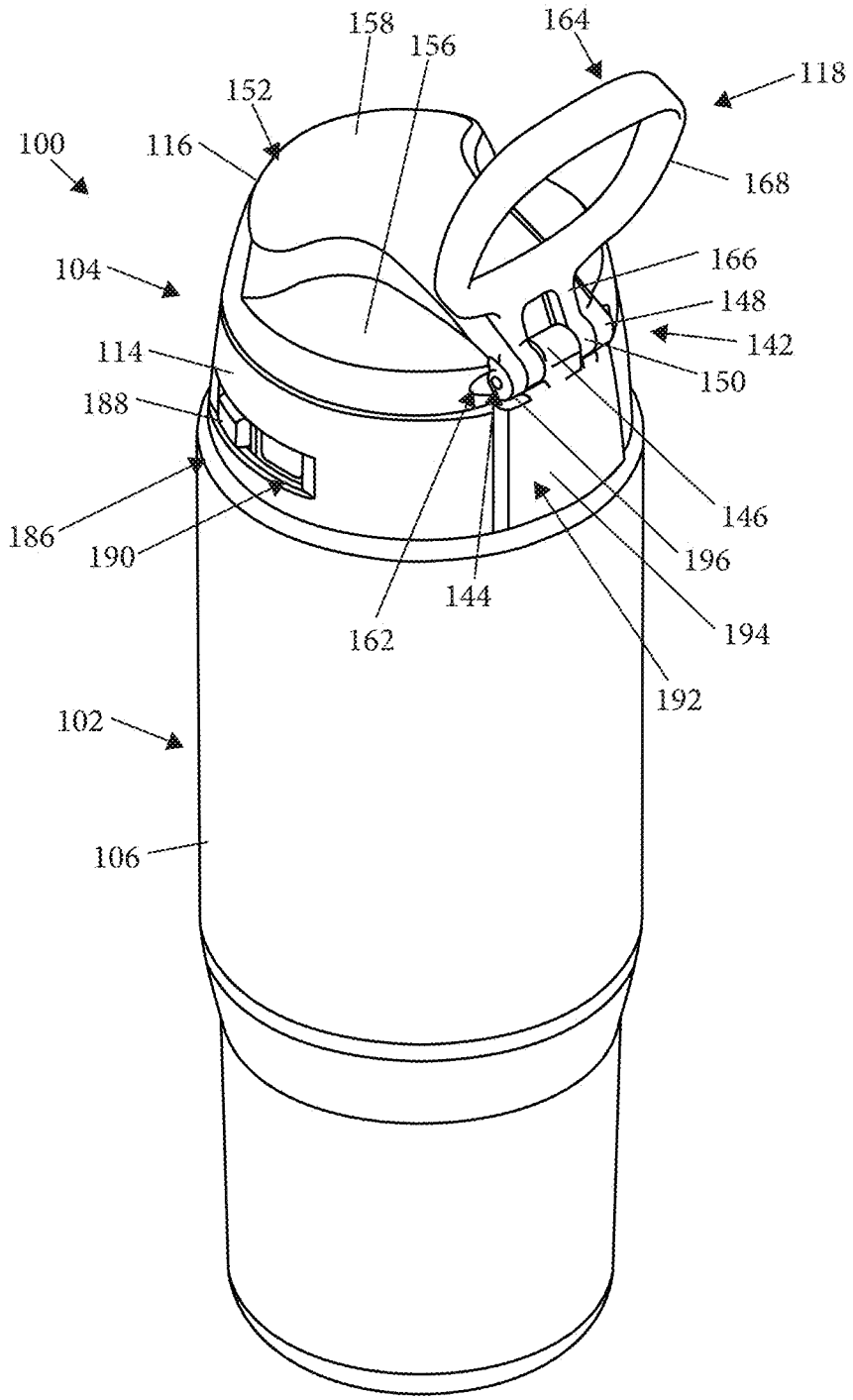
FIG. 6 is another rear perspective view of the drinking assembly of FIG. 1, wherein the handle is pivoted upwardly in an extended position.

Referring to FIGS. 5-6, the cap 116 and the handle 118 can both be pivotally connected to the lid body 114 via a hinge assembly 142. The hinge assembly 142 can include a retaining pin 144 which extends through one or more bored knuckles 146 of the lid body 114, one or more bored knuckles 148 of the cap 116, and one or more bored knuckles 150 of the handle 118. Furthermore, the hinge assembly 142 may include a biasing member to spring bias the cap 116 to open and rotate upwardly when released by depressing the activation button, as further discussed below. In an example, the retaining pin 144 can be a spring biased retaining spring with an internally disposed coil spring.

The cap 116 can rotate up and down via the hinge assembly 142 in between a closed position (FIG. 1) and an open position (FIG. 2) to accordingly cover and expose the mouthpiece 134. In some embodiments, the cap 116 can further seal the lid body 114, as discussed in more detail below. The cap 116 has a cap body 152 with an annular open bottom 154 (FIG. 15), a lower cap region 156, an upper cap region 158, and a transition region therebetween 160. In an example, the lower cap region 156 forms a cover for cooperating with the top wall 126 of the lid body and the upper cap region 158 projects upwardly from the lower cap region to form a taller (or deeper depending on the viewing perspective) cavity for receiving the mouthpiece 134 when the cap 116 is in the closed position. The lower cap region 156 can be sized and shaped to envelope a large area of the lid body 114 while the smaller upper cap region 158 is raised to cover the protruding mouthpiece 134 of the lid body 114. The cap 116 can comprise any desired material, such as plastic. As shown, the upper cap region 158 has a plan view surface profile that resembles a stylized T. The front region 158A has a curved edge that resembles a chord of a circle, or an anvil shape, and the rear region 158B is generally rectangular. The transition between the front and rear regions are rounded, and the upper surface 157 of the upper cap region 158 is slanted from the front region 158A to the rear region 158B.

Referring to FIGS. 5-6, the handle 118 can pivot upwardly and downwardly between fully articulated retracted and extended positions. In the partially retracted position, as shown in FIG. 5, the handle 118 is oriented downwardly and rearwardly and does not extend above the top of the cap 116. In the extended position, as shown in FIG. 6, the handle 118 extends outwardly and upwardly such that the handle 118 extends above the top of the cap 116. The cap 116 and the handle 118 are configured to articulate collectively and/or independently.

In one embodiment, the handle 118 can be recessed or indented into the lid body 114, thereby reducing the overall profile of the drinking assembly 100. As shown in FIG. 5, the cap 116 can include one or more grooves 162 at its backside to receive the knuckle(s) 150 of the handle 118 therein. In this regard, the position of the retaining pin 144 is moved inwardly (closer to a center axis of the drinking vessel 102) such that the retaining pin 144 is positioned within the outer perimeter of the lid body 114.

In one embodiment, the handle 118 can comprise a ring or a ring-like shaped body 164. The handle 118 can include an upper section 166, which defines an upper arm or two or more forks with bored knuckles 150 thereon, and a bent lower section 168 that extends downwardly at an angle from the upper section 166 and which defines the ring body 164. As the handle 118 can have a ring body 164, the handle 118 can thereby have an open configuration to allow fingers or hooks to extend through the opening (unnumbered) and hold onto the handle 118. In an example, the bent lower section 168, which has a generally "U" shape, extends downwardly from the upper section 166 at an angle, preferably 192-270 degrees, and more preferably 200-210 degrees, from a horizontal plane defined by the body of the upper section 166. The upper section 166 extends from a proximal end coupled to the lid body 114, via the hinged connection of the knuckles 150 and the retaining pin 144 of the hinge assembly 142, to its distal end that is conjoined to the proximal end of the lower section 168, which in turn forms the remainder of the ring body 164.

Figure 7:
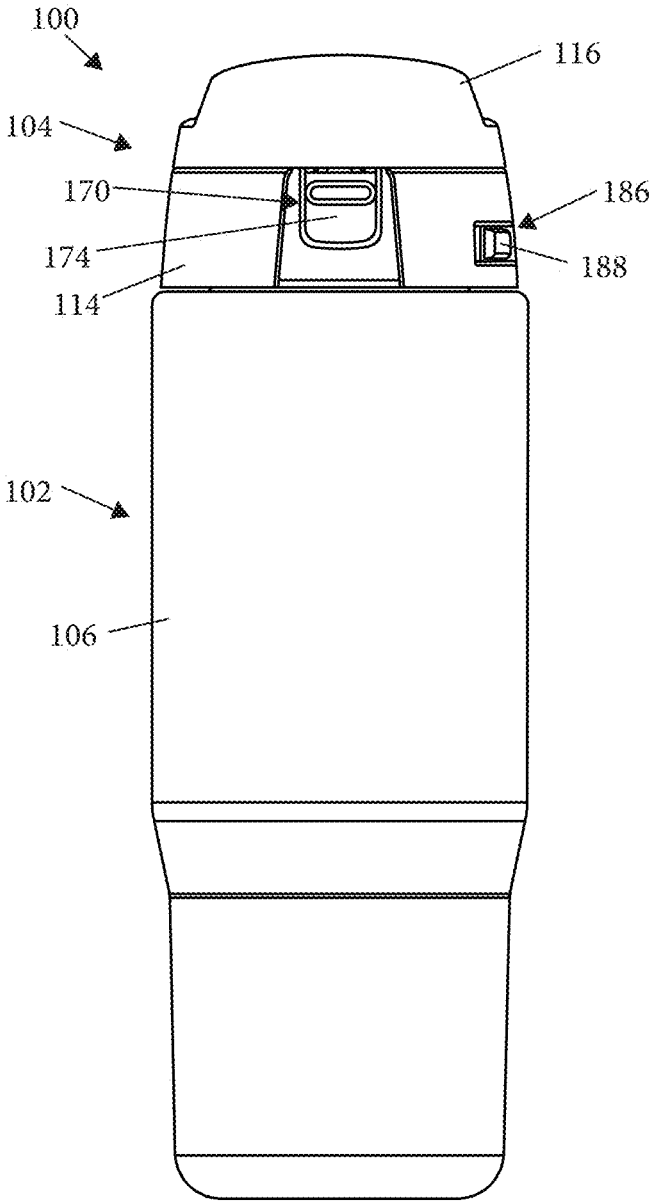
FIG. 7 is a front view of the drinking assembly of FIG. 1.
Figure 8:
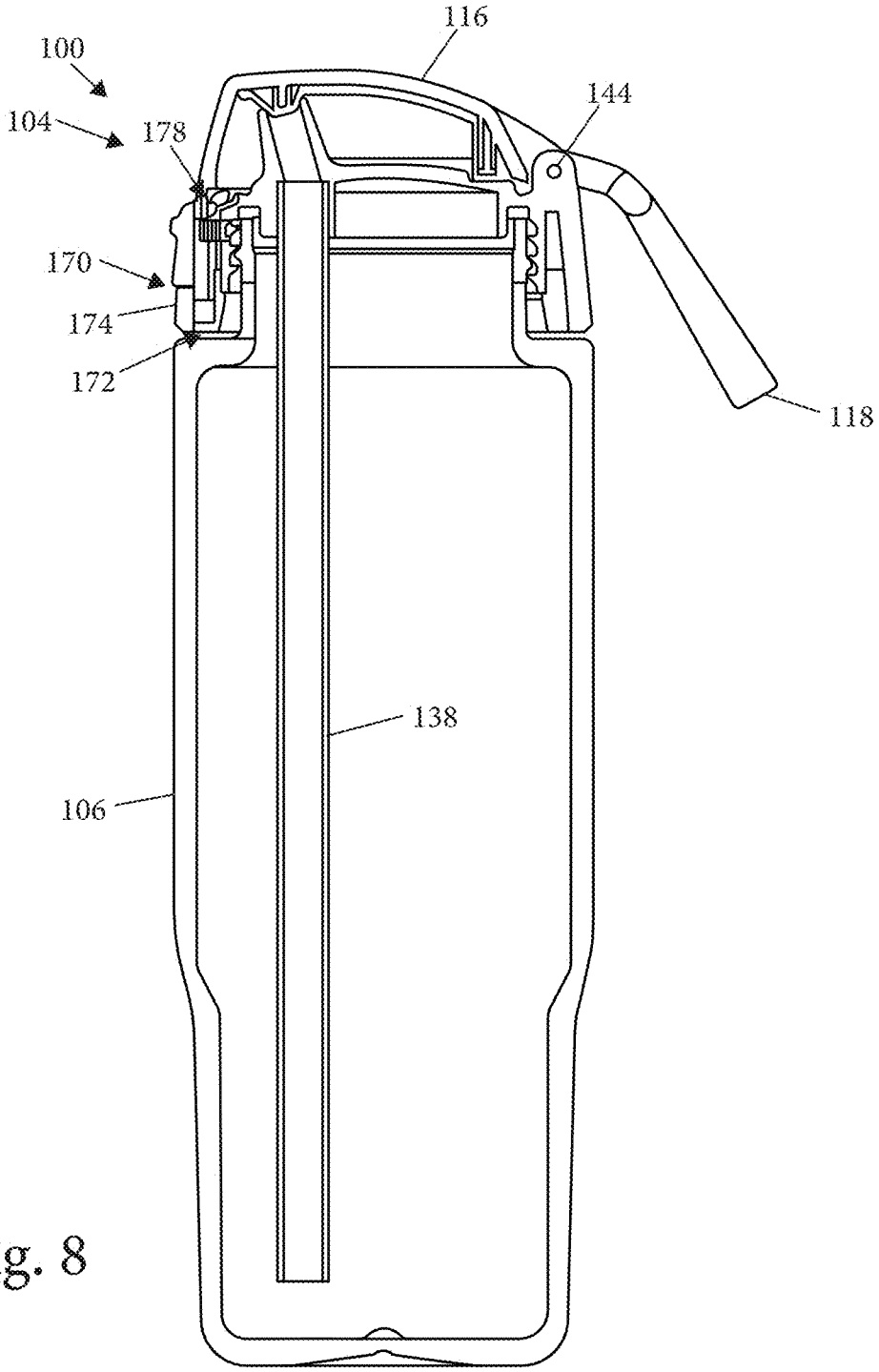
FIG. 8 is a cross-sectional view of the drinking assembly of FIG. 1, taken across line 8-8 of FIG. 7.
Figure 9:
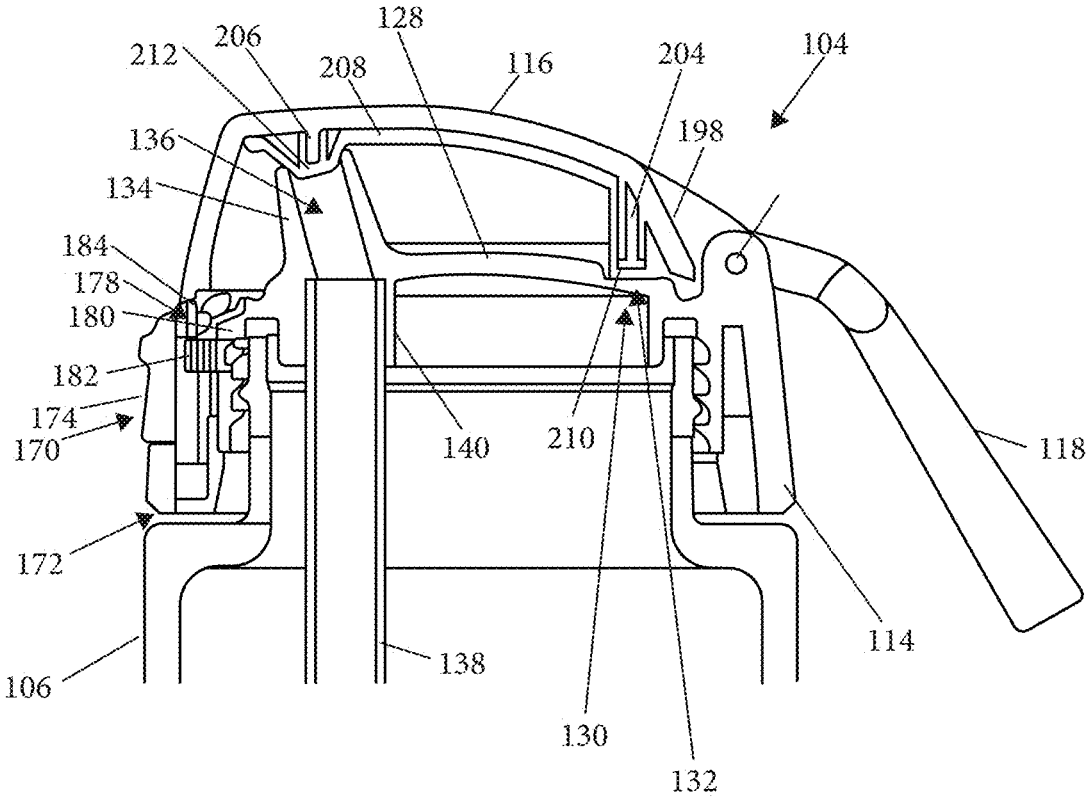
FIG. 9 is a detail view of the cross-section as shown in FIG. 8.

Referring to FIGS. 7-9, a latching assembly for securing the cap to the lid body is provided. The cap can only articulate when the latching assembly is activated to allow articulation of the cap 116. The latching assembly can be activated to enable articulation of the cap via an activator or activation button 170 that is located in an activator opening 172 on the lid body 114, at an end that is generally opposite the handle 118. FIG. 7 illustrates a front elevation view of the drinking assembly 100. FIGS. 8-9 illustrate a cross-sectional view of the drinking assembly 100 and a detail view thereof, respectively.

The activator 170 is configured to move, such as when pressed by a finger or thumb, to release a latch to then release the cap 116, allowing the cap 116 to open to expose the mouthpiece 134. The activator 170 may be slidably connected to the lid body 114 via a tongue and groove connection or the activator 170 may include one or more radially extending tabs that engage with the inside perimeter of the activator opening 172 to hold the activator 170 within the lid body 114. The activator is located on the side of the mouthpiece and the hinge assembly is located on the side of the handle, opposite the handle, so that when the activator is activated, the cap body flips away from the mouthpiece to expose the mouthpiece for sipping, chugging, or drinking. When the cap body is flipped open, the mouthpiece is oriented with the push button and ready for drinking, without having to first adjust the mouthpiece relative to the lid body to orientate the mouthpiece to the lips of the user.

In one embodiment, the activator 170 includes a front wall 174 for receiving a digit of a user, a top wall 176 adjacent to and extending rearwardly of the front wall 174, a recess or hole 178 within the top wall 176 (FIG. 15), a protruding tab 180 (FIG. 9) at the rear of the top wall 176 and extending forwardly into the hole 178, and a biasing member 182, such as a flat spring or a coil spring 182, that forwardly biases the activator 170. The tab 180 selectively locks onto a corresponding locking member 184 of the cap 116, such as a downwardly extending protrusion or tab 184. The locking member 184 of the cap 116 may include a hole (unnumbered), a groove, a recess, and/or a ledge to receive the tab 180 of the activator 170. The spring 182 is located in between the lid body 114 and the backside of the front wall 174. The spring 182 forwardly biases the activator 170 such that the tab 180 automatically abuts and retains the locking member 184 and accordingly the cap 116 therewith. Upon sufficiently depressing the activator 170, the user's digital pressure overcomes the spring force of the spring 182 which depresses the spring 182 and accordingly causes the activator 1170 to move rearwardly such that the locking tab 180 at the top wall 176 of the activator 170 moves rearwardly to disengage from the locking member 184 of the cap 116. Once disengaged, the cap 116 is free to lift upwardly to expose the mouthpiece 134.

In one embodiment, the activation structure further includes a locking mechanism 186 (FIG. 20) for restraining the activator 170 to selectively lock the cap 116 in its closed position and to not allow the activator to open the cap. In an example, the locking mechanism 186 can include a sliding button 188 embedded in a channel 190 on the sidewall of the lid body 114. The sliding button 188 may slide or otherwise articulate forward and backward or side-to-side, upon manipulation by a user's thumb or finger, to lock or unlock, i.e., mechanically interfere with the activator 170.

In one embodiment, the locking mechanism 186 can include a slider with a nob or button integrally formed thereon and which extends at least partially outwardly to provide a leverage point or tab. The slider can be an arcuate strip that fits within and spans a curved internal channel within the lid body 114 which leads to the space (or spring housing) in between the rear of the activator 170 and the opposed wall of the lid body 114. Upon sliding the arcuate strip, the distal end of the arcuate strip (opposite the end with the button thereon) can selectively engage with the backside of the activator 170 and/or the spring 182 to accordingly prevent the activator 170 and/or the spring 182 from moving, thus maintaining the cap 116 in its locked position. In an example, the slider functions as an objection in a locking position when slid behind the rear surface of the activator to prevent inward movement of the activator.

In one embodiment, the locking mechanism 186 can include an internally disposed locking feature (not shown), such as a latch or a mechanical stop, that in turn renders the activator 170 operable or inoperable to accordingly unlock or lock the cap 116. Therein, the locking feature prevents the activator 170, and the spring 182, from being depressed, which in turn prevents the cap 116 from becoming inadvertently unlocked.

In another example, the locking mechanism 186 can include a switch, a hook, a pin, a tongue and groove, or any other desired locking feature. Such locking features may or may not be internally disposed within the lid body 114. The activation structure can further include one or more hooks or latches that project out through the lid body 114 to latch against corresponding latching features on the cap 116, such as corresponding male or female features. In some alternative examples, the activation structure can include links or arms that extend towards the hinge assembly 142 for releasing the male and female latches located near the hinge assembly 142.

Figure 10:
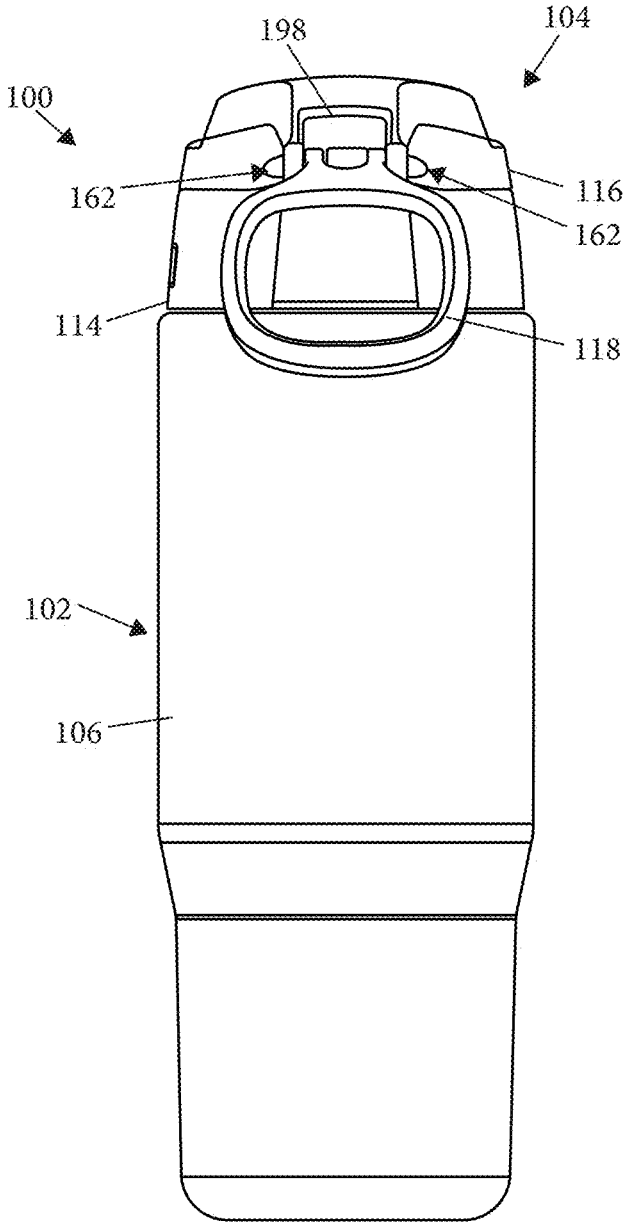
FIG. 10 is a rear view of the drinking assembly of FIG. 1.
Figure 11:
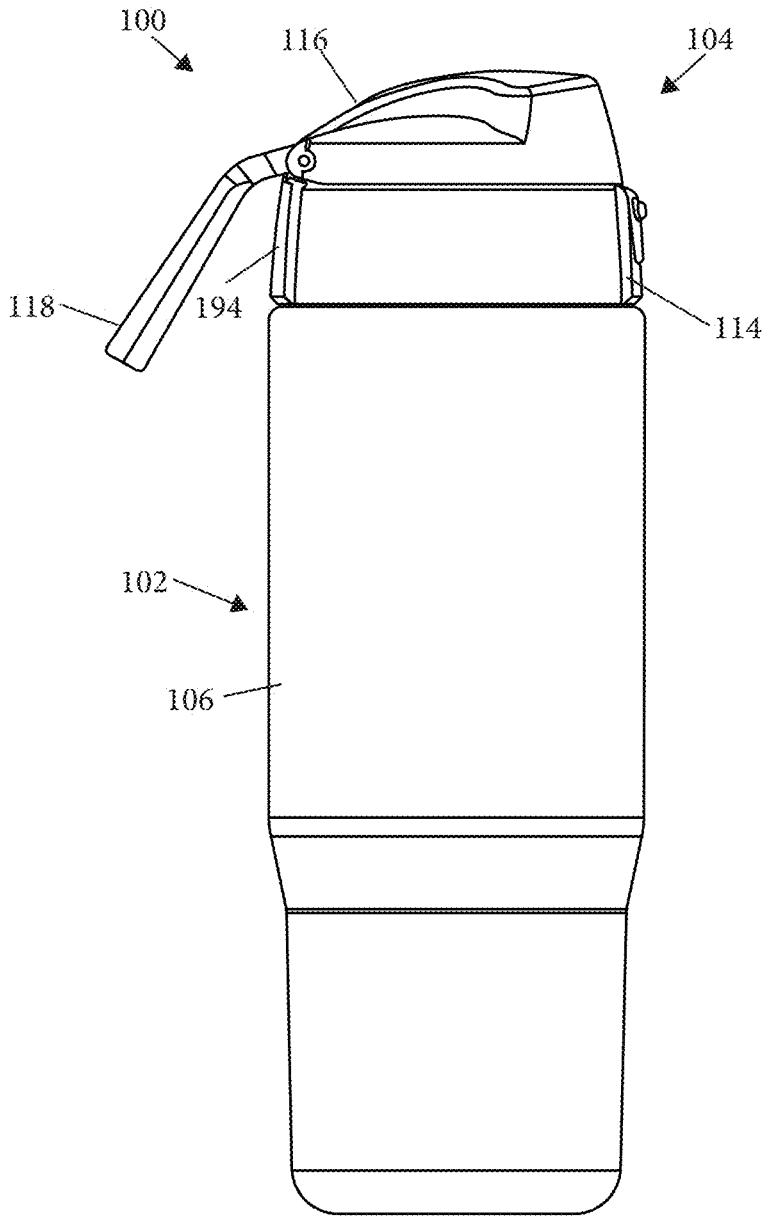
FIG. 11 is a left side view of the drinking assembly of FIG. 1.
Figure 12:
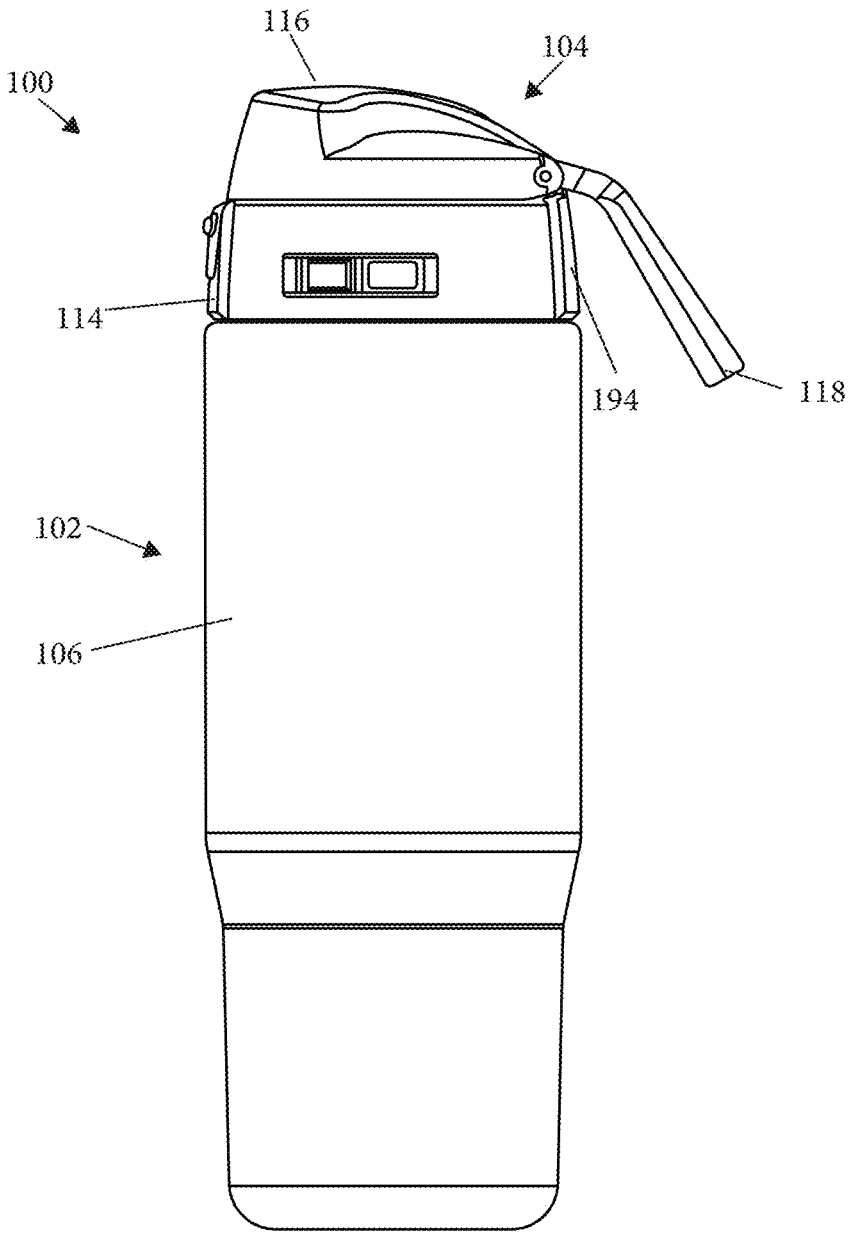
FIG. 12 is a right side view of the drinking assembly of FIG. 1.
Figure 13:
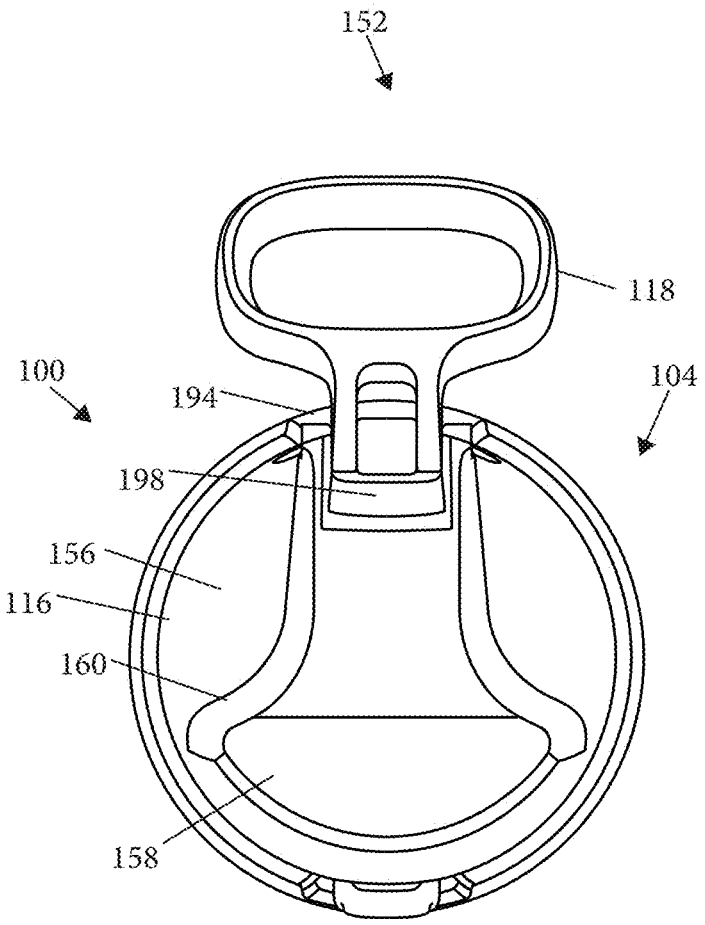
FIG. 13 is a top plan view of the drinking assembly of FIG. 1.
Figure 14:
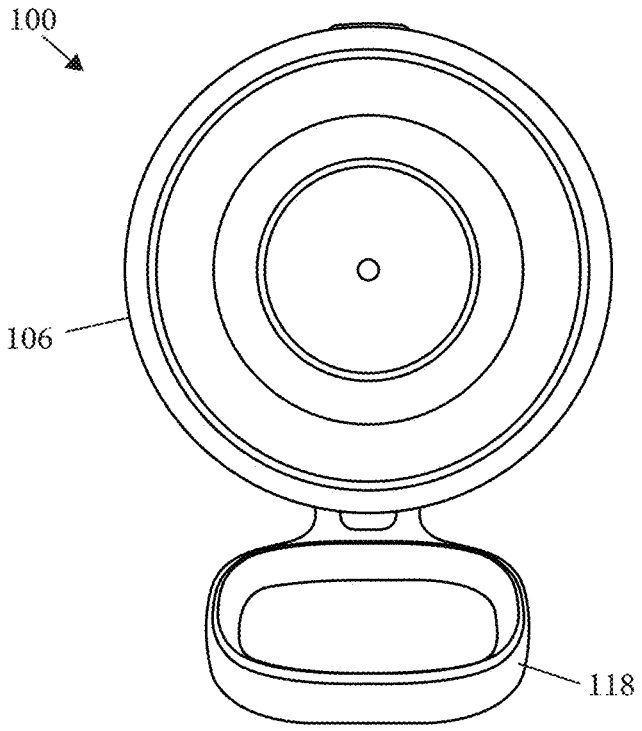
FIG. 14 is a bottom view of the drinking assembly of FIG. 1.
Figure 15:
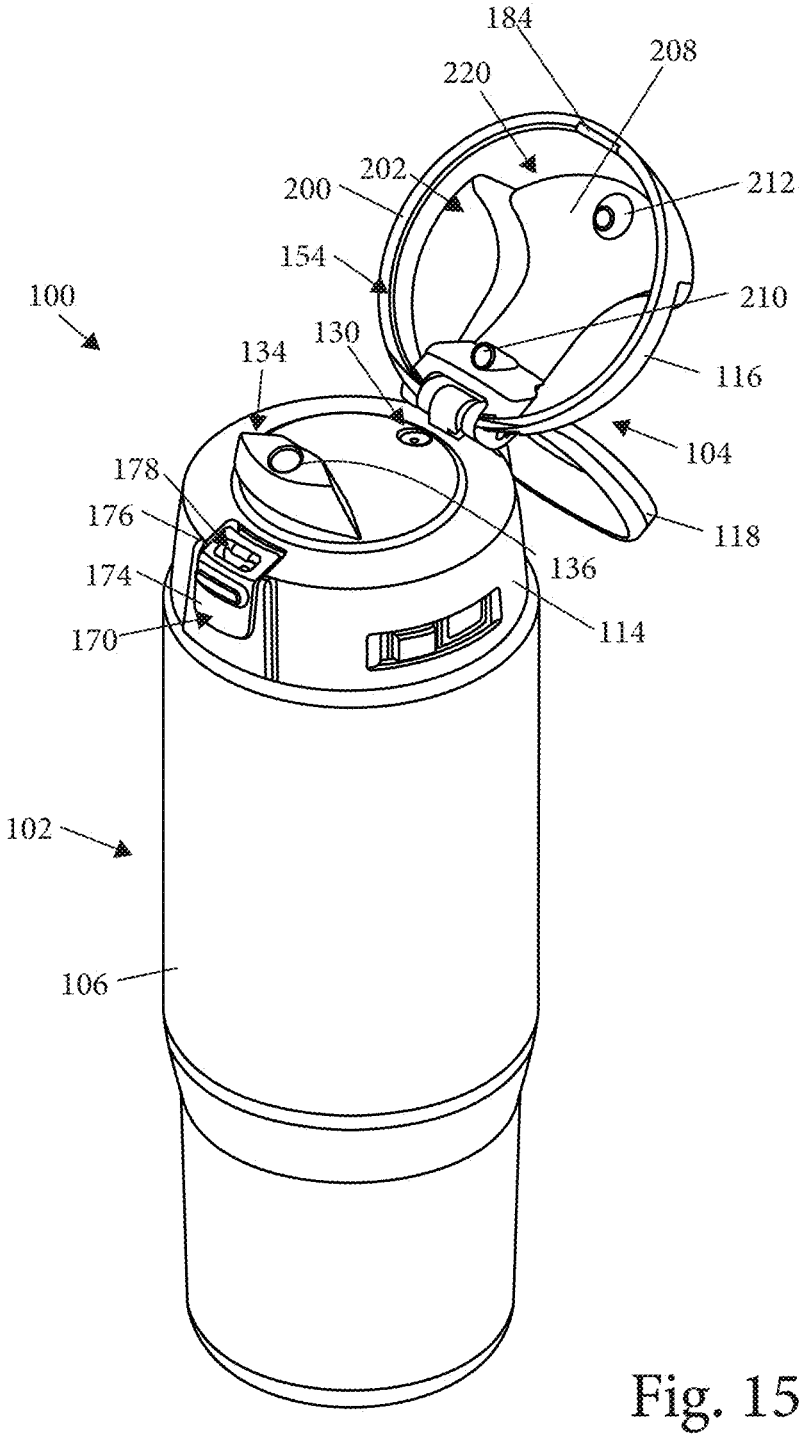
FIG. 15 is a front perspective view of the drinking assembly of FIG. 1, wherein a cap of the lid assembly is in the open position to expose a mouthpiece and drink opening.
Figure 16:
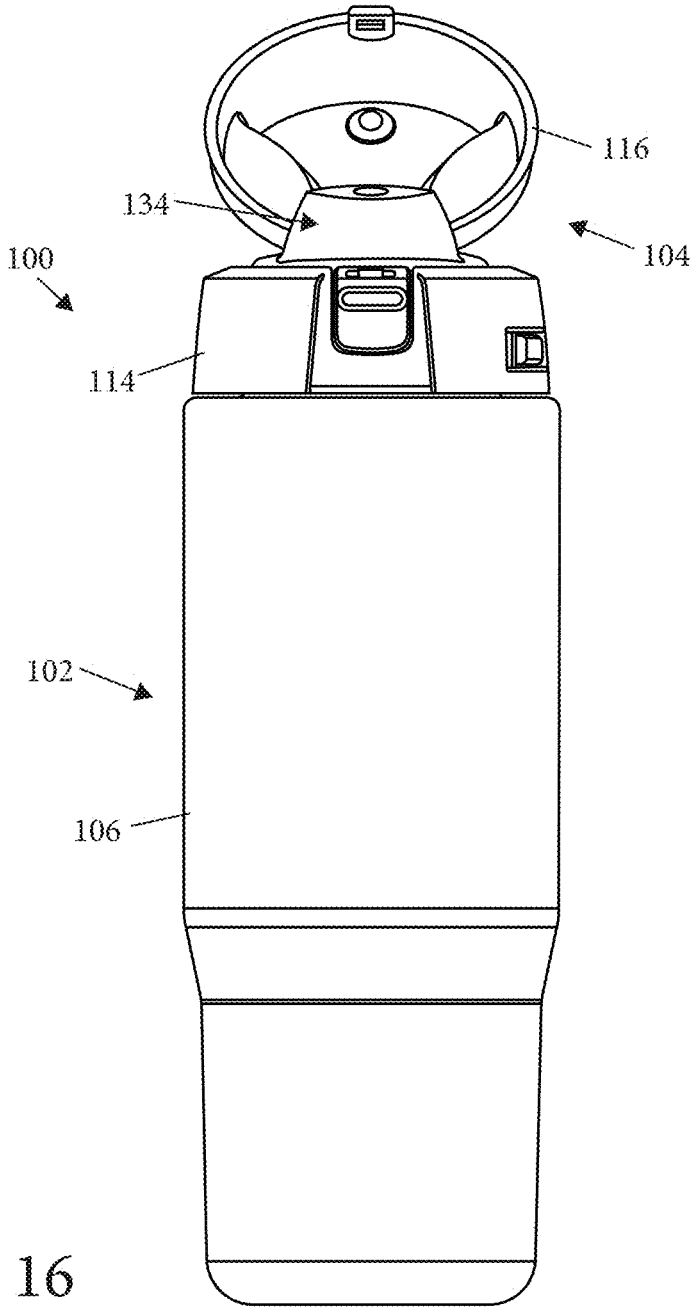
FIG. 16 is a front view of the drinking assembly of FIG. 15.

Referring collectively to FIGS. 10-14, in some embodiments, the lid assembly 104 can further include one or more built-in mechanical, handle stops to limit the range of motion of the handle 118. FIG. 10 illustrates a rear elevation view of the drinking assembly 100. FIGS. 11-12 respectively illustrate left and right side views of the drinking assembly 100. FIGS. 13-14 respectively illustrate top and bottom views of the drinking assembly 100. To set a maximum retracted position of the handle 118, the lid body 114 can include a rear handle stop 192 (FIG. 6) that prevents the handle 118 from fully rotating down. Without the handle stop 192, the handle 118 would otherwise contact the drinking vessel 102. The handle stop 192 can include a rear protrusion 194 that defines a handle ledge 196. When the handle 118 is rotated downwardly, the upper section 166 of the handle 118 abuts the handle ledge 196. Thus, the handle stop 192 prevents the handle 118 from rotating further, which thereby creates a finger gap FG, as shown in FIG. 12, to accommodate a user's fingers when gripping the top of the drinking vessel 102. The finger gap FG extends between the outside of the drinking vessel 102 and the underside of the lower section 168 of the handle 118. Hence, even in the fully retracted position of the handle 118, the user can easily grip and drink from the drinking assembly 100 without having their fingers be pinched by the handle 118. In other examples, the handle stop 192 can be omitted and the handle 118 allowed to rotate downwardly until it contacts the lid body.

To set a maximum extended position of the handle 118, the cap 116 can include a handle stop 198 in the form of a handle recess 198 located in between its bored knuckles 148. The handle recess 198 can extend upwardly and inwardly from the lower cap region 156 to the upper cap region 158 and has a stop wall or blocking wall. When the handle 118 is rotated upwardly, the upper section 166 of the handle 118 abuts the stop wall of the handle recess 198 to thereby prevent the handle 118 from rotating further. Advantageously, due to the bent structure of the handle 118 and the corresponding angled wall of the handle recess 198 of the cap 116, the drinking vessel 102 remains substantially vertical when carried by the handle 118.

Referring collectively to FIGS. 15-24, in some embodiments, the lid assembly 104 can incorporate a sealing system for preventing any leakage of the liquid inside the drinking vessel 102 from leaking out through the mouthpiece opening and/or the vent opening. Throughout FIGS. 15-24, the cap 116 is shown in its open position to accordingly expose the mouthpiece 134 and allow the user to drink therefrom. To prevent leakage of the liquid, the cap 116 can include one or more seals and one or more securement points for rigidly securing the cap 116 onto the lid body 114 when not in use to therefore form a liquid seals at the two openings. In one embodiment, the cap 116 can include a first securement point 200, as defined by a perimeter of the skirt defining the open bottom 154, a second securement point 202 in the form of one or more internal structural members, such as ribs or similar reinforcement members, and third securement points 204, 206 in the form of one or more anchor posts or tabs 204, 206 (see FIG. 9) for mounting a lid seal 208, as discussed further below. The anchor posts 204, 206 can extend downwardly from the bottom of the cap 116 and accordingly serve as mounting points for the seal 208 to secure or attach for installation. The cap 116 can further include a rim, a lip, a ridge, and/or a silicone gasket circumferentially disposed about the perimeter 200 of the bottom opening of the cap 116 to press against the top wall 126, to either cushion the cap against the lid body and/or to seal the perimeter of the cap against the lid body.

The seal 208 can be a two-in-one seal structure for sealing the vent opening 132 and the mouthpiece opening 136 on the lid body 114. The seal 208 can comprise a seal plate or pad connected to the bottom of the cap 116. In an example, the seal 208 can further include a vent protrusion 210 and a mouthpiece protrusion 212 for respectively fitting into or pressing against and sealing the vent opening 132 and the mouthpiece opening 136. The vent and mouthpiece protrusions 210, 212 of the seal 208 can be mounted to respective vent and mouthpiece anchor posts 204, 206 of the cap 116. Therein, the vent and mouthpiece protrusions 210, 212 can have bores (unnumbered) therein that receive the correspondingly shaped and sized vent and mouthpiece anchor posts 204, 206 of the cap 116 when the seal 208 is coupled to the bottom of the cap 116. In one embodiment, the seal 208 can be removably attached to the cap 116 to facilitate removal for cleaning the seal 208, the cap 116, and/or the lid body 114. A user can easily remove and reattach the seal 208 by respectively pulling the seal 208 off of the anchor posts 204, 206 and refitting the seal 208 over the anchor posts 204, 206. The seal 208 can comprise any desired material, such as silicon or rubber. The seal 208 can be variously configured to have any desired, shape, size, and width. The seal can also be attached to the cap without any anchor posts, such as by providing spaced apart ribs and wedging side edges of the seal in between the ribs. Optionally, the seal can be attached to the cap by using both anchor posts and ribs.

Figure 20:
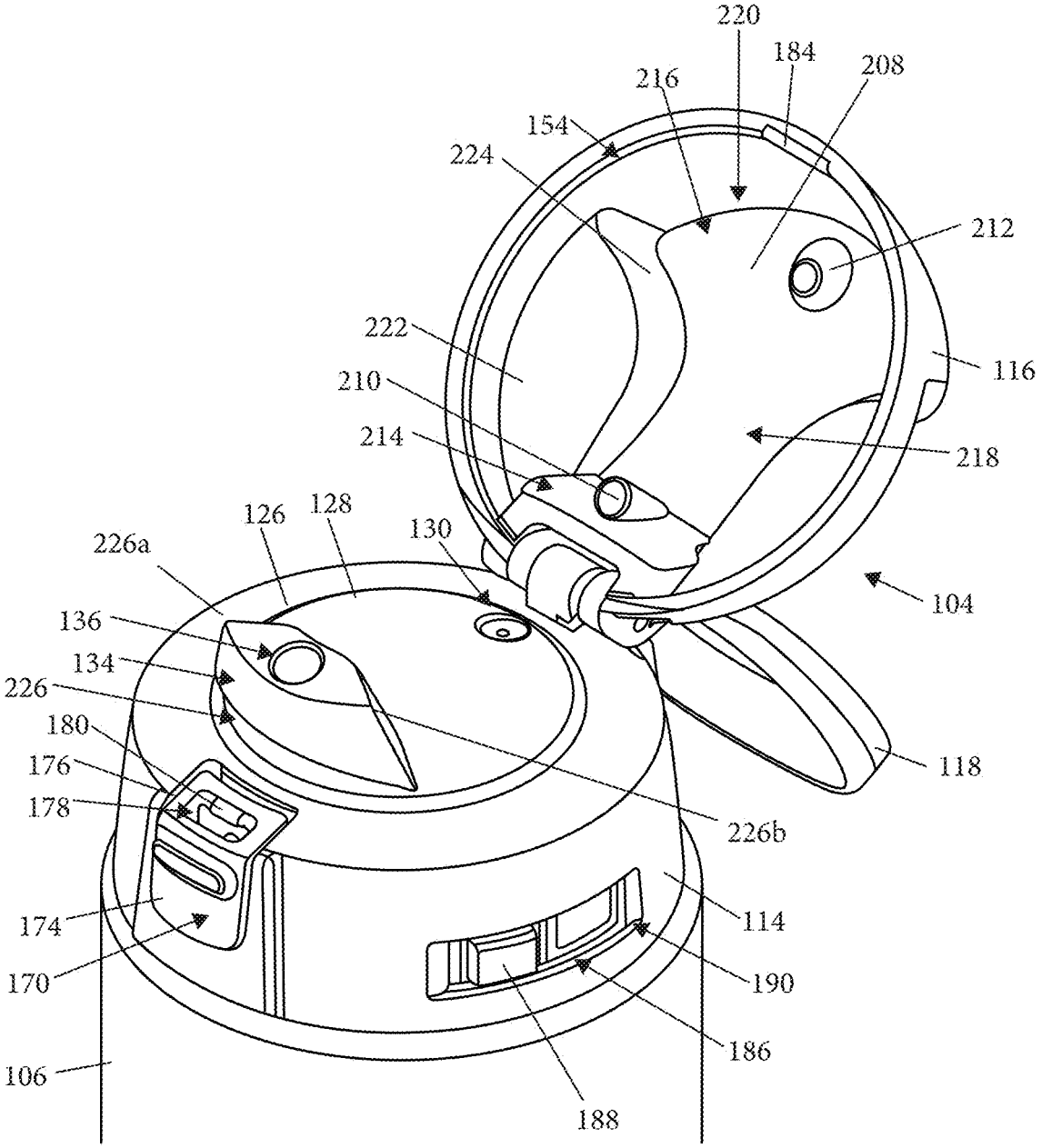
FIG. 20 is a front perspective detail view of the lid assembly of FIG. 15.

In one embodiment, the seal 208 can have a shape and size which corresponds to the interior (or negative) outline of the lower, upper, and transition regions 156, 158, 160 and the handle stop 198 of the cap 116. As shown in FIG. 20, the seal 208 can extend from a first, rectangular and bent end 214, forming an approximate L-shaped cross-section at that end, to a second, anvil-shaped end 216 with a transition middle stem section 218 therebetween. The first rectangular end 214 can include the vent protrusion 210, and the second anvil-shaped end 216 can include the mouthpiece protrusion 212. The vent protrusion 210, as more clearly shown in FIG. 9, can be sized and shaped with a structure that projects outwardly away from the surface of the middle stem section 218 such that in the cap closed position, the end surface of the vent protrusion 210 presses against the vent opening to seal the vent opening. The mouthpiece protrusion 212, as more clearly shown in FIG. 9, can be sized and shaped with a structure that projects outwardly away from the surface of the middle stem section 218 such that in the cap closed position, the end surface of the mouthpiece protrusion 212 presses against the mouthpiece opening to seal the mouthpiece opening.

When the cap 116 is closed, the seal 208 is pressed against the surfaces of the lid body 114 and particularly over the vent opening 132 and the mouthpiece opening 136 to accordingly form a seal therearound via the vent and mouthpiece protrusions 210, 212. The cap 116, when latched to the lid body, constrains the seal in the pressed state against the vent and mouthpiece openings to secure the liquid within the drinking container by preventing any liquid from pouring or spilling out the openings 132, 136 in the lid body 114. Thus, if the drinking assembly 100 should tip or laid on its side, fluids from inside the drinking vessel 102 cannot leak out through the vent opening 132 or the mouthpiece opening 136. As shown in FIG. 20, the anvil shaped end has a surface area that is larger than the surface area at the upper end of the mouthpiece, where the drink or mouthpiece opening 136 is located. Thus, the seal, in an example, covers the entire upper area of the mouthpiece, including the entire circumference of the mouthpiece at the upper end.

In addition to the activator 170 and the locking mechanism 184, the construction of the cap 116 itself may provide additional securement points 200, 202, 204, 206 in order to securely seat the cap 116 onto the lid body 114, which in turn of course augments the ability of the cap 116 to seal the openings 132, 136 in the lid body 114. For instance, the cap 116 provides at least three securement points 200, 202, 204, 206 (FIG. 15) to rigidly stabilize itself from undesirable movement to enable support and reinforcement of the seal 208 to seal against the lid body 114. The at least three securement points are preferably not in a straight line so as to provide lateral stability between the cap and the lid body. In more detail, when the cap 116 is closed, the perimeter 200 of the open bottom 154 of the cap 116, which may also include a ridge or gasket, contacts and/or extends over a corresponding surface of the upper end of the lip body 114, thus serving as a first securement point 200 by preventing the cap 116 from rotating further downward and/or translating side to side. Additionally therewith, the internal structural members 202 within the cap 116 may flank and abut against the mouthpiece 134, thus serving collectively as a second securement point 202 by preventing the cap 116 from translating side to side. Furthermore, since the protrusions 210, 212 of the seal 208 fit within the openings 132, 136, and/or press against surfaces around the vent and mouthpiece openings, the seal 208 itself in conjunction with the rigid structural support provided by the anchor posts 204, 206 of the cap 116 collectively serve as a third securement point 204, 206 by preventing the cap 116 from translating side to side or forward and back. Thereby, the perimeter 200 of the open bottom 154, the internal structural members 202, and the anchor posts 204, 206 along with the protrusions 210, 212 of the seal 208 collectively assist in securing the cap 116 onto the lid body 114, and providing lateral stability, when the cap 116 is in its closed position.

In one embodiment, the internal structural members or second securement point 202 of the cap 116 may define a seal recess 220 therebetween in which the seal 208 is seated. In one embodiment, each structural member 202 of the cap 116 comprises a flat bottom wall 222 (FIG. 20) extending inwardly from the perimeter 200 and an angled vertical wall 224 extending upwardly from the flat bottom wall 222 and terminating at the seal recess 220 of the cap 116. The connection point between the flat and vertical walls 222, 224 can be tapered to form a smooth transition point therebetween. The shape of the structural members can be defined by the shape of the upper cap region 158.

With specific reference to FIGS. 17-23, the mouthpiece 134 of the lid body 114 has a mouthpiece body 226 that is uniquely designed to fit a user's mouth and make the drinking experience easier for the user with less strain and puckering of the lips required to take the drink. The size, angle, and shape of the mouthpiece 134 together allow the user to seal around the entire mouthpiece 134 without puckering their lips excessively or at all. The elongated and uniquely shaped mouthpiece 134 allows a user to use the drinking assembly 100 with or without a straw 138. Furthermore, a seal between the user's mouth and the mouthpiece 134 can be easily and readily created, without requiring the user to tightly gather their lips, such as by puckering up their lips, which would otherwise be required to seal around a common and relatively smaller nozzle, such as a straw or a round mouthpiece. If a straw is used, the straw can be attached to the lid body 114, such as to the straw receiving receptacle 140 of the lid body. The uniquely sized and shaped mouthpiece and its arrangement relative to the lid body allow a user to use the drinkware with minimal efforts and strain to seal around the mouthpiece and draw up fluids.

The profile of the mouthpiece body 226 is selected to generally match the profile of the user's lips when the user merely opens his or her mouth without activating, or without significantly straining, the cheek muscles and/or the lip muscles. In other words, the shape of the mouthpiece body 226 corresponds to an open mouth of a user, without puckering their lips. The mouthpiece 134 includes the ergonomic mouthpiece body 226 and the mouthpiece opening 136 extending through the mouthpiece body 226. The arrangement of the mouthpiece 134 on the lid body 114 allows the user to begin drawing up fluids from inside the drinking vessel or base without having to first align the mouthpiece to the lid body and then the mouthpiece to the shape of the open mouth of the user.

Figure 17:
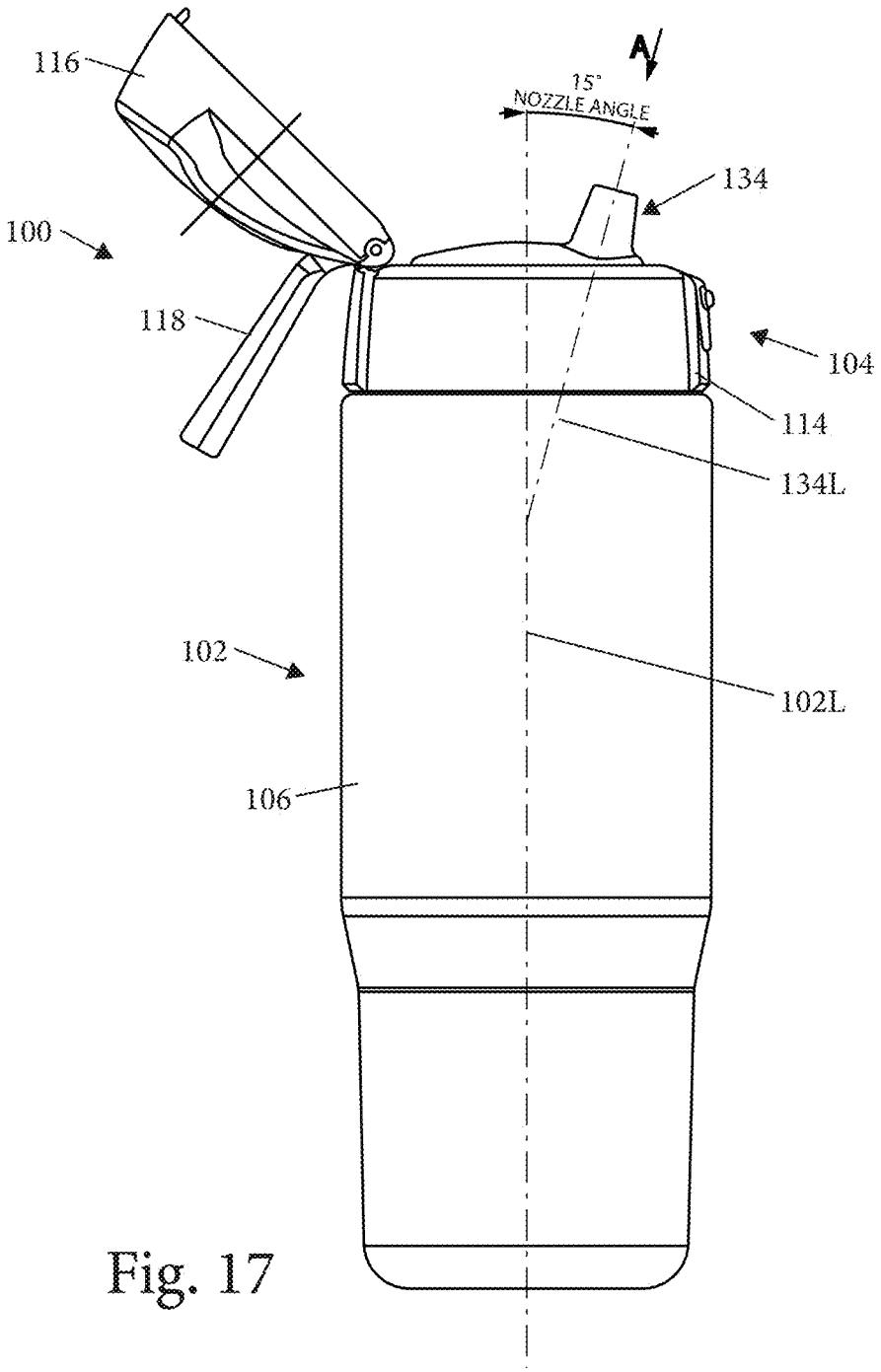
FIG. 17 is a left side view of the drinking assembly of FIG. 15.
Figure 18:
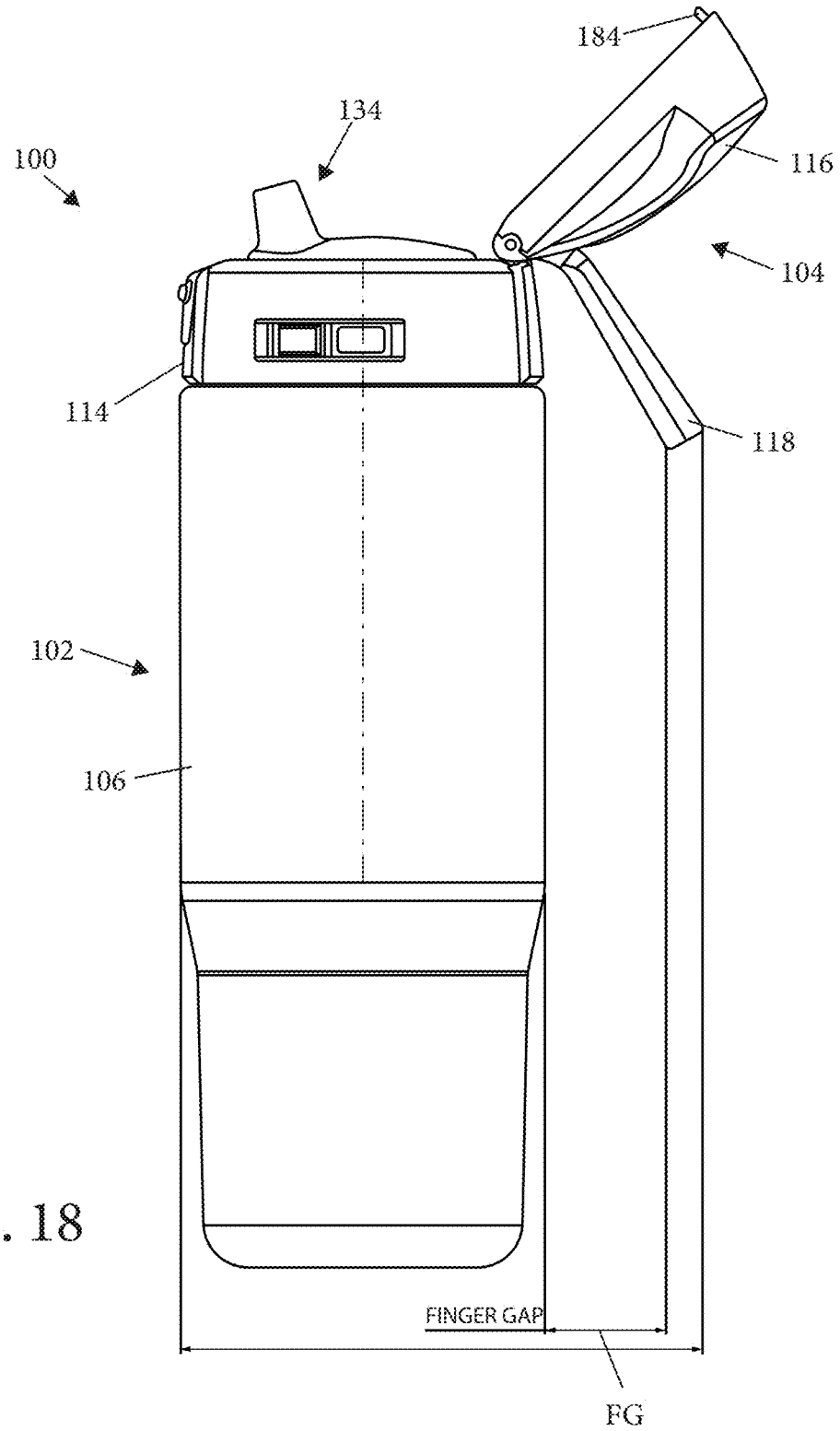
FIG. 18 is a right side view of the drinking assembly of FIG. 15.
Figure 19:
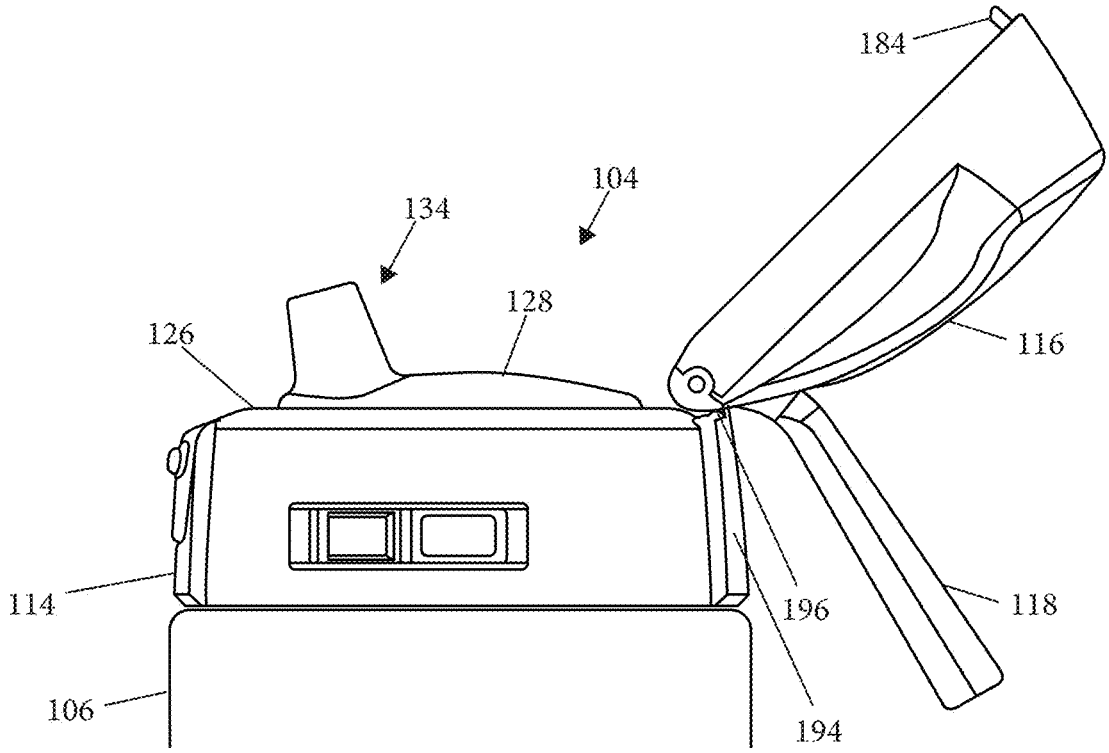
FIG. 19 is an upper right side detail view of the drinking assembly of FIG. 15.

In one embodiment, and referring specifically to FIG. 17, which is a left side view of the drinking assembly 100 with the cap 116 in its open position, the mouthpiece 134 can extend upwardly and forwardly from the top surface of the second top wall 128 of the lid body 114. In an example, a longitudinal axis 134L of the mouthpiece 134 (or the longitudinal axis of the mouthpiece opening 136) can be forwardly angled, forward away from the hinge assembly, relative to a longitudinal axis 102L of the drinking vessel 102 by approximately 15 degrees, plus or minus 10 degrees. In another example, the mouthpiece 134 can extend forwardly at any angle between 5-25 degrees, and preferably 10-20 degrees, from the longitudinal axis 102L of the drinking vessel 102. The angle of the longitudinal axis (unnumbered) of the mouthpiece opening 136 may match the angle of the longitudinal axis 134L of the mouthpiece 134. In some examples, the mouthpiece 134 extends upwardly and perpendicularly from the lid body 114 such that the longitudinal axis of the mouthpiece 134 is parallel to the longitudinal axis of the drinking vessel 102. The angled mouthpiece is preferred as it more readily aligns with the use's open mouth with minimal puckering and alignment required to begin drawing up fluids through the opening of the mouthpiece. In contrast, when the mouthpiece is not attached to the lid body, the mouthpiece has to first be adjusted or aligned relative to an edge or surface for stability, then the cross-sectional shape of the mouthpiece has to be oriented to the open mouth of the user, and then the angle of the mouthpiece has to be oriented to the angle of the user's open mouth or head.

The mouthpiece body 226 may include a tapered base 228 extending upwardly from the second top wall 128 of the lid body 114, a middle section 230, and a rim 232 (FIG. 21), which in the present embodiment can also be the outer perimeter of the mouthpiece at the upper part of the mouthpiece. In one embodiment, the tapered base 228 may reside within the perimeter or boundary of the second top wall 128 of the cap 114, which therein allows the cap 116 to fully surround, cover, and seal the mouthpiece 134 in the cap closed position, as previously discussed. As shown, the tapered base 228 has the same general outer contour as the contour at the rim 232, but is relative larger in size.

Figure 21:
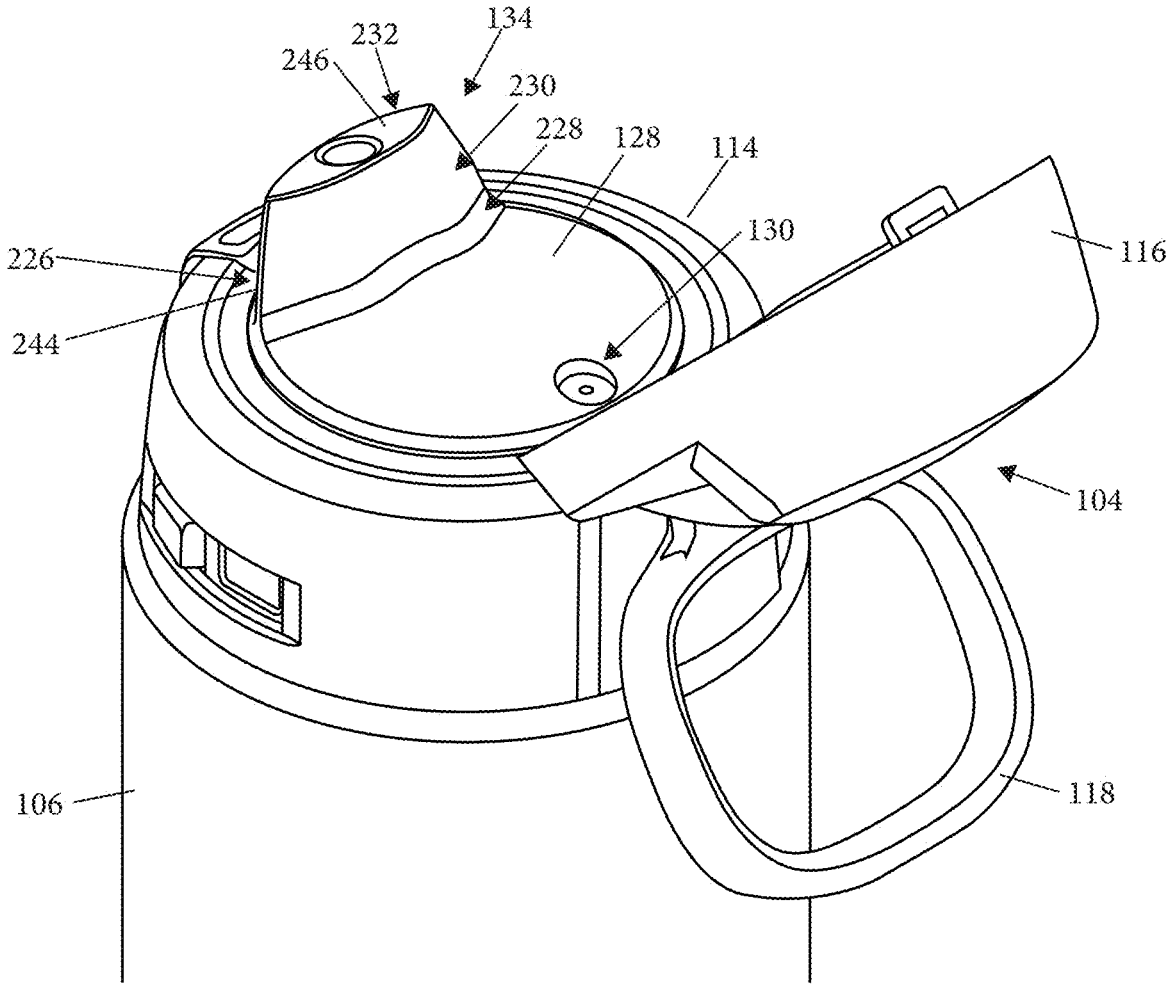
FIG. 21 is a rear perspective detail view of the lid assembly of FIG. 15.
Figure 22:
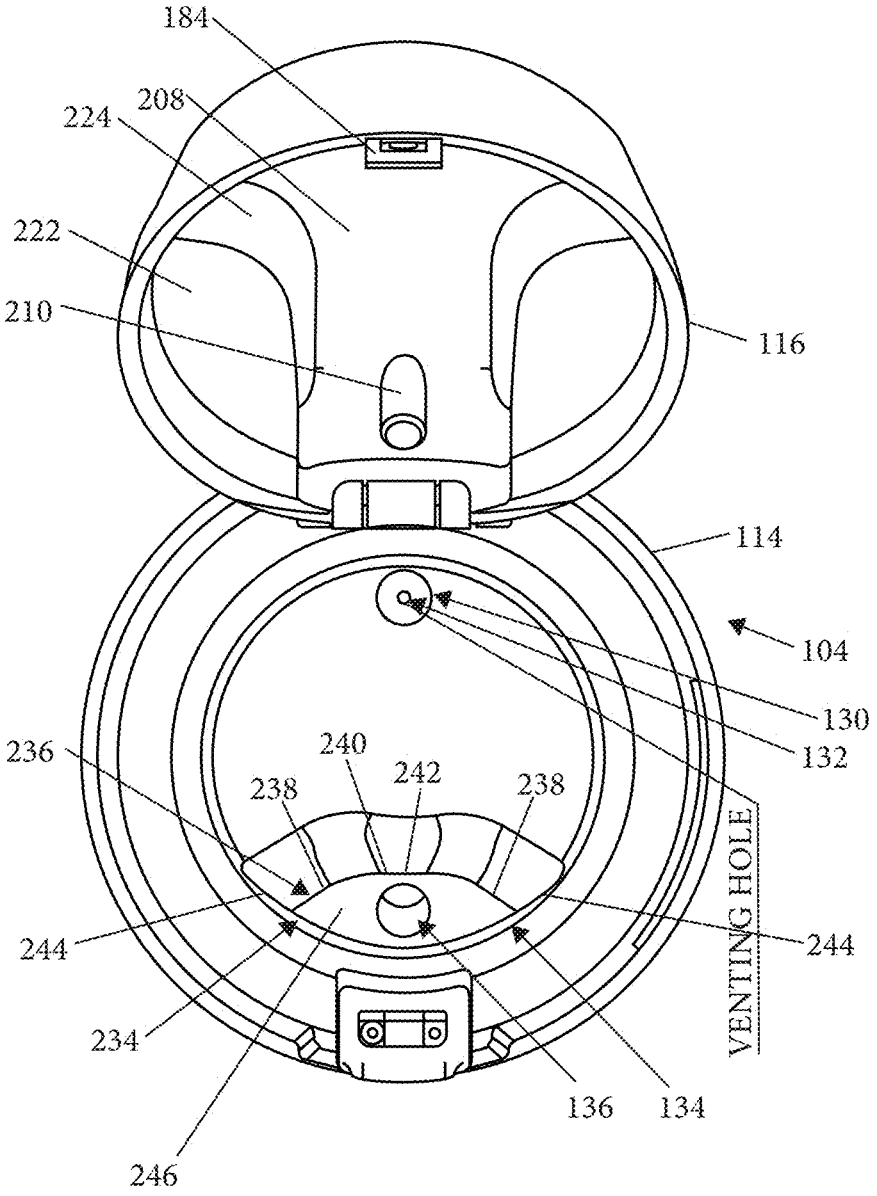
FIG. 22 is a top plan view of the drinking assembly of FIG. 15.
Figure 23:
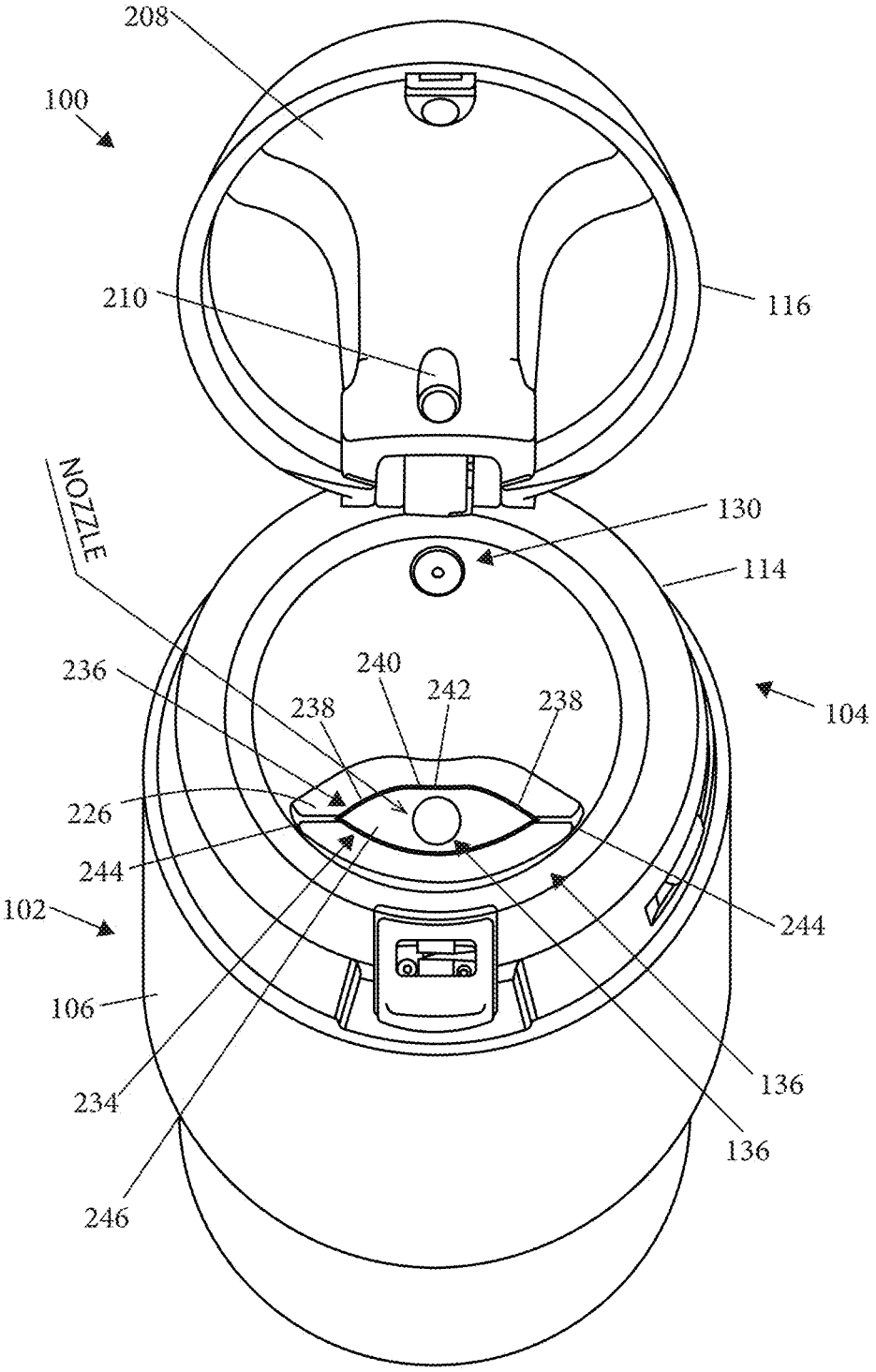
FIG. 23 is a top perspective view of the drinking assembly of FIG. 15, the view being planar to the drink opening of the mouthpiece of the cap of the lid assembly.

Referring specifically to FIG. 23 in combination with FIG. 21, in one embodiment, the mouthpiece body 226 may be forwardly angled, e.g., angled forwardly away from the rear where the cap is hinged to the lid body, tapered inwardly from its base 228 to its top rim 232, and contoured to match the shape of an open mouth of a user. FIG. 23 is a top perspective view that is oriented so that the top surface 246 is generally normal to the longitudinal axis 134L of the mouthpiece 134 (and longitudinal axis of the mouthpiece opening). The mouthpiece body 226, along a cross-section, can define a generally ellipsoidal body 226 with a rim 232 that is asymmetric along a straight line drawn through the two opposed tapered ends 226*a*, 226*b* (FIG. 20), called tapered end line. By incorporating a rim 232 with an asymmetric configuration relative to the tapered end line, the mouthpiece body 226 adapts the geometry of the lip opening with the jaw and the lips open with minimal muscle strains at the lips and the cheeks. In an example, the distance between the two tapered ends 226*a*, 226*b* at the rim is less than the same distance at the base 228 of the mouthpiece. Thus, the width of the mouth piece widens as it extends from the rim to the base. In other examples, the width of the mouthpiece remains the same between the rim and the base.

The rim 232 can have a front side 234, which can be referred to herein as a first rim portion, and a back side 236, which can be referred to herein as a second rim portion. A front side 234 (or bottom side relative to the bottom lip) of the rim 232 of the mouthpiece body 226, nearer the activator 170, may have a simple curvature extending between the two tapered ends 226*a*, 226*b* (FIG. 20) for accommodating the bottom lip of the user. A back side 236 (or top side relative to the top or upper lip) of the rim 232 of the mouthpiece body 226 (nearer to the vent 130) has a compound curve with two or more radii of curvatures for accommodating the upper lip of a user. In other words, the front side 234 of the rim 232 for the lower lip has a convex shape with a single radius of curvature or arc, and the back side 236 of the rim 232 for the upper lip has a compound curve with at least two radii of curvatures or arcs, with three or more being preferred. In some examples, the back side 236 can include one or more flat sections in between curved portions to enhance the contour of the back side to improve fit with the user's upper lip.

In an example, the back side 236 of the rim 232 can include a pair of spaced apart end portions 238 and a central portion 240 in between the end portions 238. In an example, the middle portion 240 is generally flat or planar. In another example, the middle portion 240 is concave to accommodate the tubercle or small rounded portion on the upper lip. In the example with the concave middle portion, the middle portion 240 defines a nadir 242 (FIG. 23), or bottommost point, between the opposing end portions 238. Thereby, the middle portion 240 is configured to accommodate a center tubercle of the upper lip of the user, and the pair of end portions 238, flanking the middle portion 240, are configured to respectively accommodate the lateral tubercles of an upper lip of a user. In an example, from left to right in FIG. 23, the back side 236 of the rim 232 (for accommodating the user's upper lip) includes a lateral start point 226*a* (FIG. 20) defined by an end of a first portion, an upwardly curved portion of the first convex arc which terminates at a first apex (or first highpoint) at the opposite end of the first convex arc, a smooth transition point to the middle concave arc, the nadir 242 defined by the lowest point of the middle portion 240, another smooth transition point to the second convex arc, a second apex defined by the end of the second convex arc, a downwardly sloping portion of the second arc, and a lateral endpoint 226*b* (FIG. 20) defined by the opposite end of the second convex arc. Thus, as described, the contour of the rim on the backside 226 for cooperating with the upper lip has five different distinct lines or distinct line segments that define the compound curve of the backside.

Figure 23A:
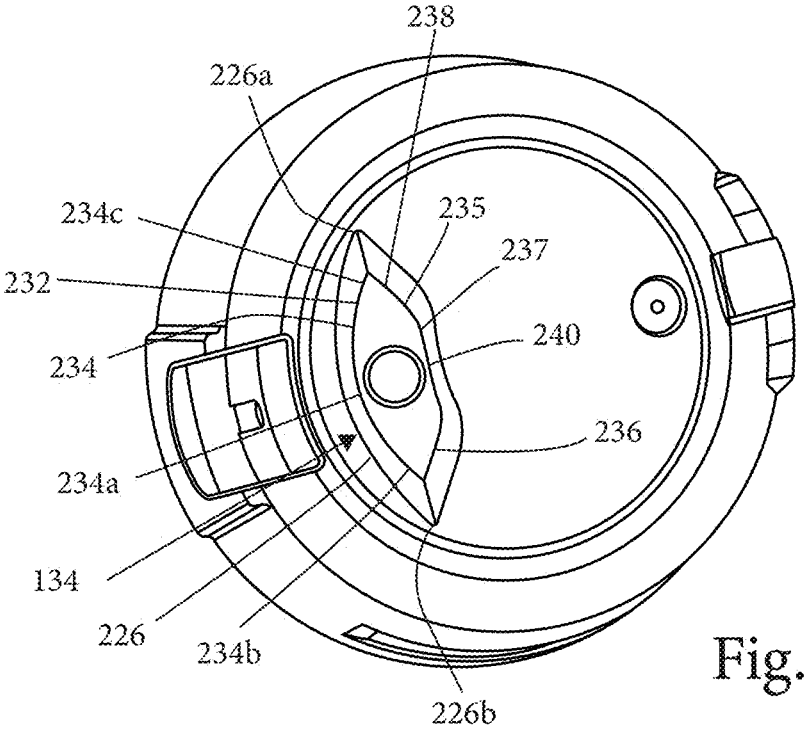
Figure 24:
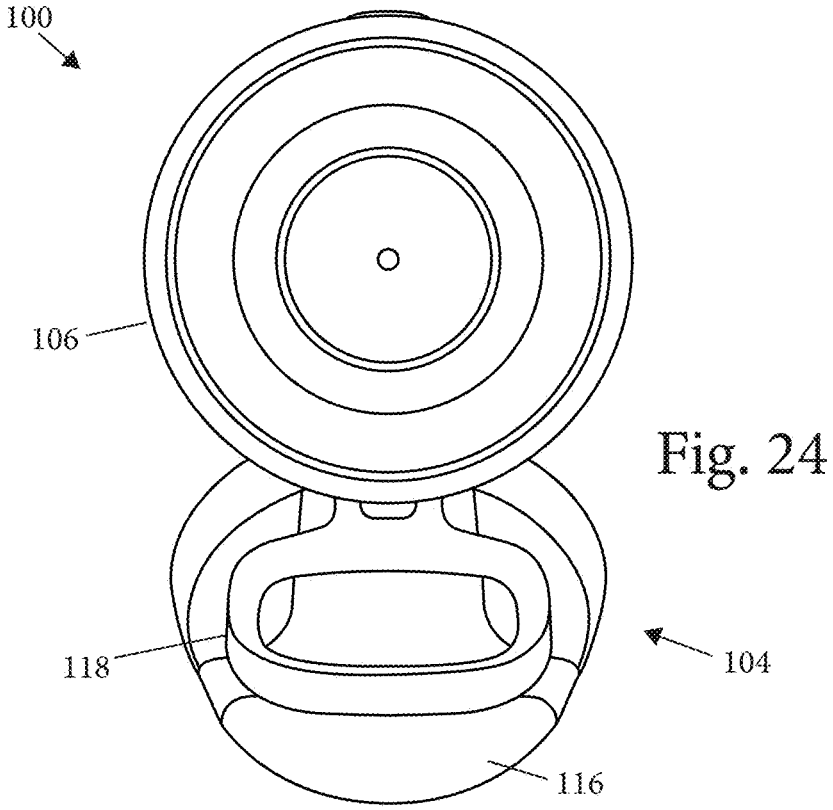
FIG. 24 is a bottom view of the drinking assembly of FIG. 15.
Figure 25:
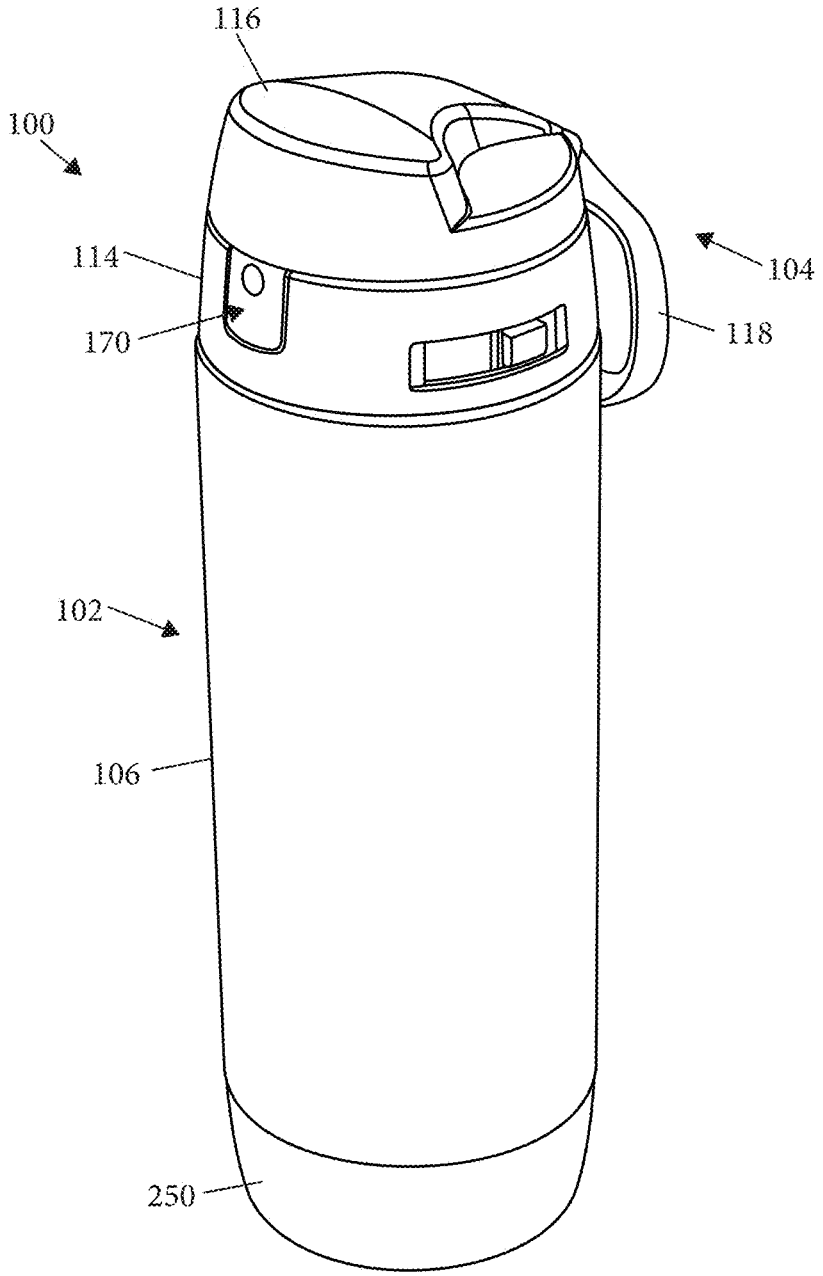
FIG. 25 is a front perspective view of another exemplary embodiment of a drinking assembly in accordance with aspects of the invention.
Figure 26:
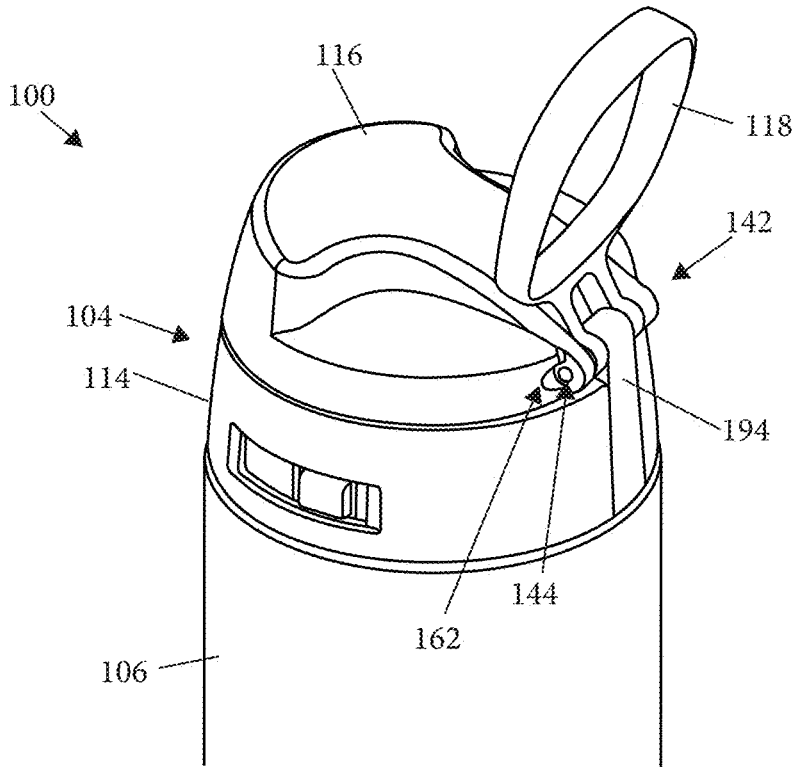
FIG. 26 is a rear perspective view of the lid assembly of the drinking assembly of FIG. 25, wherein the handle is pivoted upwardly in an extended position.

With reference now to FIG. 23A, a mouthpiece 134 in accordance with further aspects of the invention is shown. In the present embodiment, the mouthpiece has a body 226 with a rim 232 having a front side or first rim portion 234 and a backside or second rim portion 236. The first rim portion 234 having a curved contour comprising a radius of curvature for contacting the bottom lip and the second rim portion 236 has a compound curve for contacting the upper lip. In an example, the first rim portion 234 has a single radius of curvature. The radius of curvature of the first rim portion 234 can be about 18 mm to about 30 mm, preferably about 21 mm to about 26 mm, and more preferably about 23 mm to 25 mm, and most preferably around 23.5 mm. In some examples, the first rim portion 234 can have a radius of curvature at the central section 234*a* of the first rim portion, and wherein two end sections 234*b*, 234*c* of the first rim portion 234 can have a different radius of curvature, such as a smaller radius so as to create inclined end sections. For example, the central section 234*a* can have a radius of curvature of 21 mm to 26 mm and the two end sections can have a smaller radius of curvature, such as 17 mm to 20 mm.

In an example, the second rim portion 236 has a compound curve or a complex curve, which is understood to be a combination of more than one radius of curvature. As previously described, and starting from the left side of the second rim portion 236 at the first lateral end 226*a*, the second rim portion can have a lateral end portion 238 that is generally straight and inclined at about 27 degrees to about 37 degrees from a horizontal line with about 31 degrees to 34 degrees being more preferred. The second rim portion 236 then has a convex section defined by a single radius of curvature extending between points 235 and 237. In an example, the radius of curvature between points 235 and 237 is about 8 mm to 12 mm, with about 10 mm being most preferred.

Still following the second rim portion 236 from left to right, the rim then extends to a central portion 240 that is generally concave. In an example, the central portion can be described as a single radius curve with a radius of about 25 mm to about 33 mm, preferably about 27 mm to 31 mm, and most preferably around 29.5 mm. In an alternative example, the concave central portion is truncated at the center section and has a surface that is generally flat. The second rim portion 236 then repeats with similar geometries all the way to the opposite lateral end 226*b*.

The mouthpiece 134 can have an overall width between the two end points 226*a*, 226 *b* at the rim of about 25 mm to about 32 mm in length with about 29 mm being most preferred, and an overall width at the base of the mouthpiece of about 36 mm to about 43 mm in length with about 39.5 mm being most preferred. The height of the mouthpiece from the base to the rim is about 11 mm to about 16 mm in length with about 13.5 mm in length being most preferred. The gap between the two opposing rim portions, at the largest point, is about 11 mm to about 16 mm in length, with about 13.5 mm being most preferred.

The disclosed ranges are believed to provide a mouthpiece that is optimal for use by a user to simply open up his or her jaw to use the mouthpiece without having to strain, or with only minimal strain to, his or her lips, such as puckering up to seal around the mouthpiece. This in turn produces an enjoyable experience with a drink assembly having a lid assembly with the disclosed mouthpiece, one that allows the user to enjoy his or her drink with minimal strain to the lips to seal against the mouthpiece.

In some examples, the front side 234 or first rim portion can also have a compound curve but wherein the two or more radii of this compound curve are within 20% of one another so that the compound curve have the appearance of a smooth simple curve to match the contour of the lower or bottom lip.

In one embodiment, the middle or central portion 240 of the second rim portion 236 can have an arc length that is 10-40%, and preferably 15-25%, of the arc length of one of the adjoining convex portions 238. The middle concave portion 240 and the lateral convex portions 238 can be integrally formed with one another and/or tapered so that a smooth transition exists therebetween. In alternative embodiment, the middle concave portion 240 can be a carveout or groove in between the lateral convex portions 238. The disclosed geometries have been found to provide a superior fit with the upper lip without requiring much, if any, muscle strain on the upper lip to form fit around the backside contour of the mouthpiece.

The front and back sides 234, 236 of the asymmetrical rim 232 about the tapered end line join one another at their lateral ends 226*a*, 226*b* to define lateral ridges 244 across the rim. The opposed lateral ridges 244 each define a connection point between the front and back sides 234, 236 of the rim 232. Each lateral ridge 244 defines a lateralmost apex, which is previously called lateral ends 226*a*, 226*b*. The opposed lateral ridges 244 and lateral ends 226*a*, 226*b* are configured to respectively accommodate opposed oral commissures of a mouth of a user (the lateralmost sides of a mouth) such that the user need not pucker their lips to drink from the mouthpiece 134 in accordance with aspects of the present invention. In one embodiment, each lateral ridge 244 is tapered from its bottom to top. In one embodiment, each lateral ridge 244 can be tapered about the entirety of its edge line to form a smooth transition between the front and back sides 234, 236 of the rim 232.

In one embodiment, a top surface 246 of the mouthpiece 134 can be substantially flat. In another embodiment, the top surface 246 of the mouthpiece can have a grading, wherein the top surface 246 is tapered from its outer edges, i.e., the outer part of the rim 232 adjacent the exterior sides of the mouthpiece, towards the mouthpiece opening 136. In such an embodiment, the rim 232 would reside above the mouthpiece opening 136 instead of being flush with the mouthpiece opening 136, akin to a grade of a drain.

In one embodiment, the mouthpiece opening 136 can be a bore with a single diameter, which extends from a topmost end, throughout the body of the mouthpiece, and terminates at a bottommost end adjacent to the top opening (unnumbered) of the straw receiving receptacle 140 of the lid body 114. The top and/or bottom ends or outer perimeters of the mouthpiece opening 136 can be tapered to form a smooth transition point between the top surface 246 of the mouthpiece 134 and/or the top of the straw receiving receptacle 140. With specific reference to FIGS. 9 and 17, the mouthpiece opening 136 can be angled relative to the opening (unnumbered) of the straw receiving receptacle of the lid body 114 (or the opening of the straw) by an angle of approximately 15 degrees, plus or minus 10 degrees. In an alternative embodiment, the mouthpiece opening 136 can be tapered, angled, or comprise multiple sections with differing diameters. By angling the mouthpiece opening 136, the mouthpiece is conveniently orientated for use by the user. By maintaining the straw receiving receptacle generally vertical, and therefore angled relative to the mouthpiece opening, the straw receiving receptacle allows the straw bottom opening to be located adjacent the vessel bottom.

Referring now to FIGS. 25-31, there is shown another embodiment of a drinking assembly 100 which can be substantially similar to the drinking assembly as discussed above, except that the drinking vessel 102 has a uniform diameter, a bottom member, such as a bottom bumper 250, and the lid body 114 has a mouthpiece 134 that is configured for use with minimal puckering required by its user. Additionally, the lid body 114 has a fully articulated handle 118 that may rest against the drinking vessel 102 in its retracted position, due to a relatively narrower rear protrusion 194 on the lid body 114 which does not form a handle ledge. Thereby, unobstructed by a handle stop on the lid body 114, the handle 118 may fully rotate downward and rest against the drinking vessel 102 in its retracted position. The present drinking assembly can optionally incorporate a mouthpiece 134 that is angled as previously discussed or that extends upwardly and perpendicularly from the lid body 114 such that the longitudinal axis of the mouthpiece 134 is parallel to the longitudinal axis of the drinking vessel 102.

Figure 27:
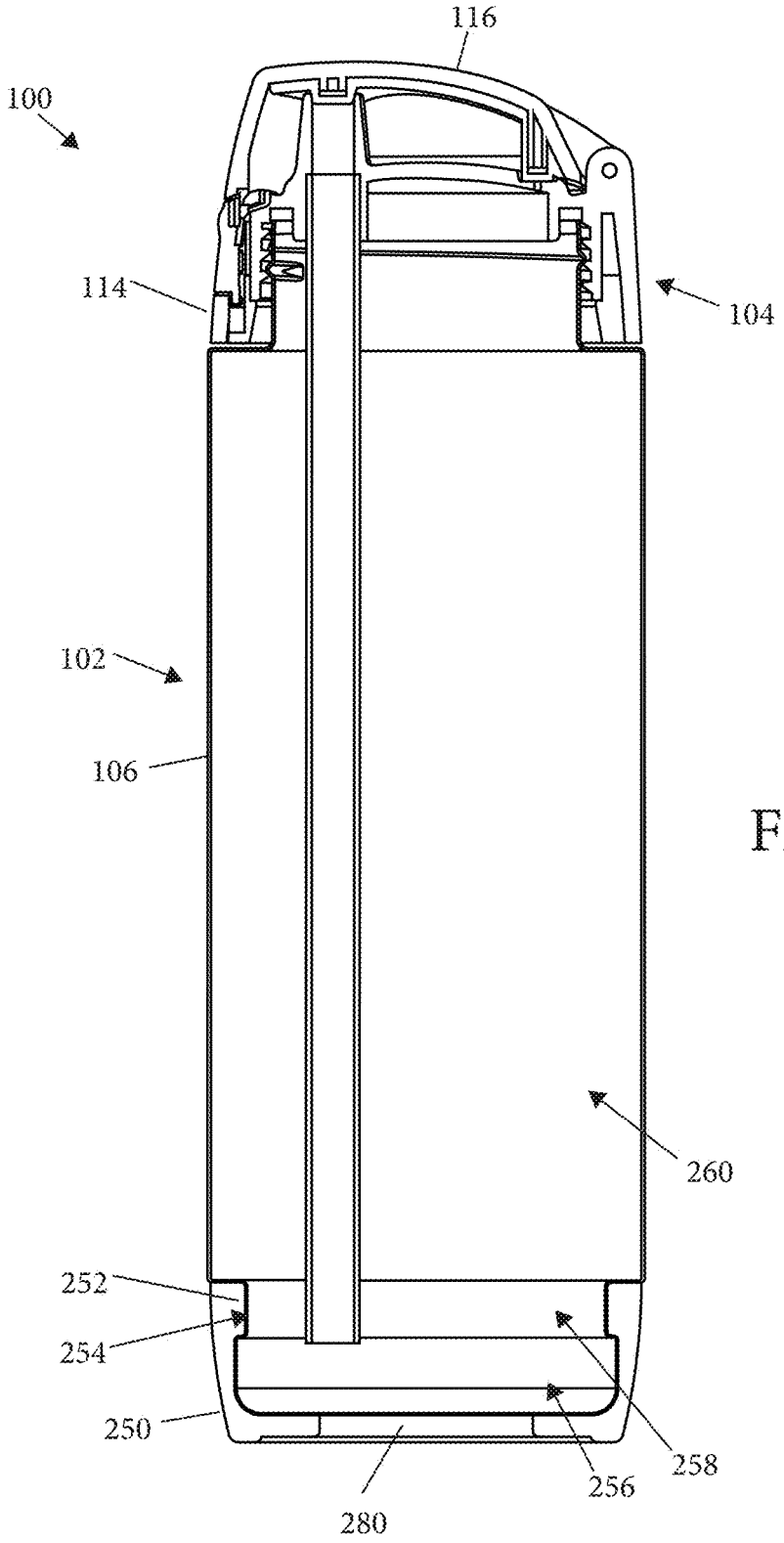
FIG. 27 is a cross-sectional view of the drinking assembly of FIG. 25.

Referring specifically to FIG. 27, the bottom bumper 250 comprises an annular tongue 252 (FIG. 27) that fits within a corresponding annular groove 254 of the drinking vessel 102 next to the bottom 108 of the drinking vessel 102. Therein, in one embodiment, the bottom bumper 250 can be a snap-on component. In some embodiments, the bottom bumper 250 can be removably connected to the drinking vessel 102 such that a user may easily remove and reattach the bottom bumper 250 for ease of cleaning thereof. A bottom opening 280 formed through the bottom wall of the bumper 250 can be provided to allow venting while assembling the bumper onto the drinking vessel.

In one embodiment, the annular groove 254 can comprise an indent which is formed by a multitiered vessel. In such a configuration, the drinking vessel 102 may include a bottom section 256 with a bottom diameter, a groove or ring section 258 with a groove diameter that is less than the bottom diameter, and a main body section 260 with a diameter that is larger than both of the bottom diameter and the groove diameter, respectively. The indentation of the groove 254 is thereby determined in part by the groove diameter of the groove section 258.

Figure 29:
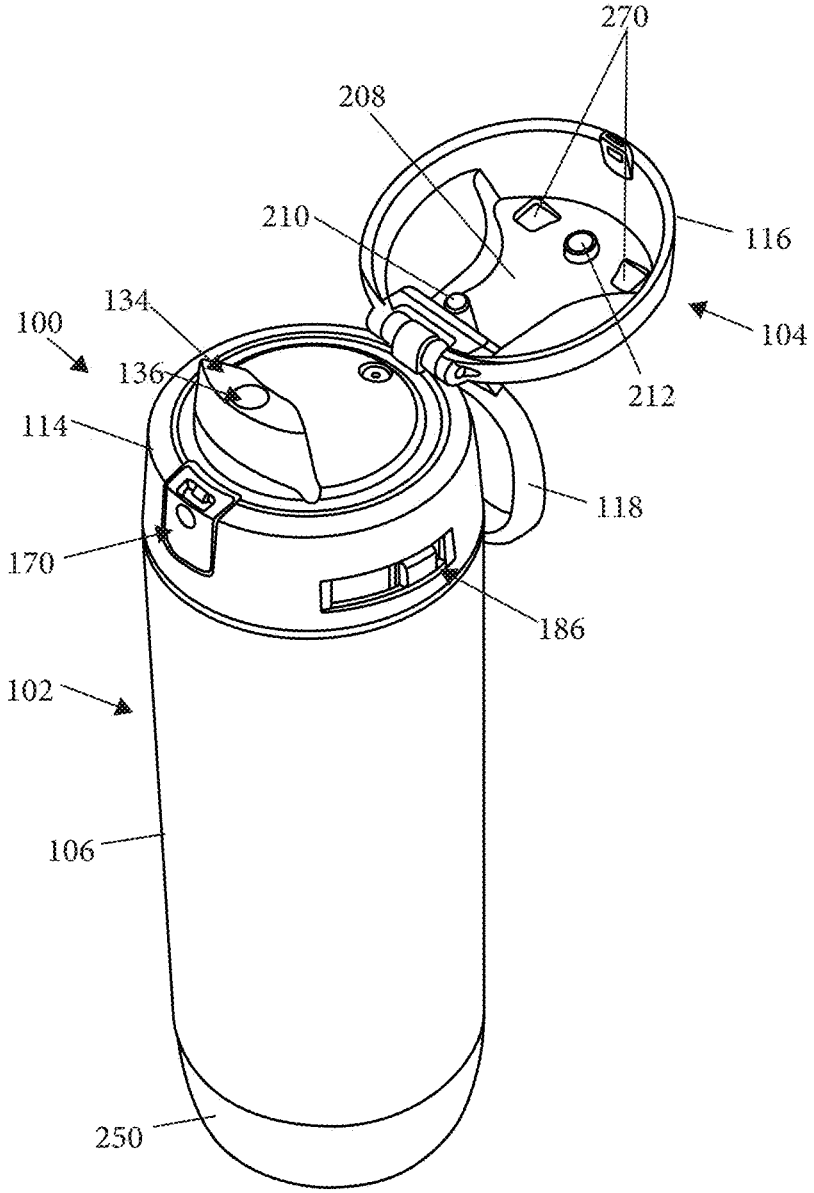
FIG. 29 is a top perspective view of the drinking assembly of FIG. 25, wherein a cap of the lid assembly is in the open position to expose a mouthpiece and drink opening.
Figure 30:
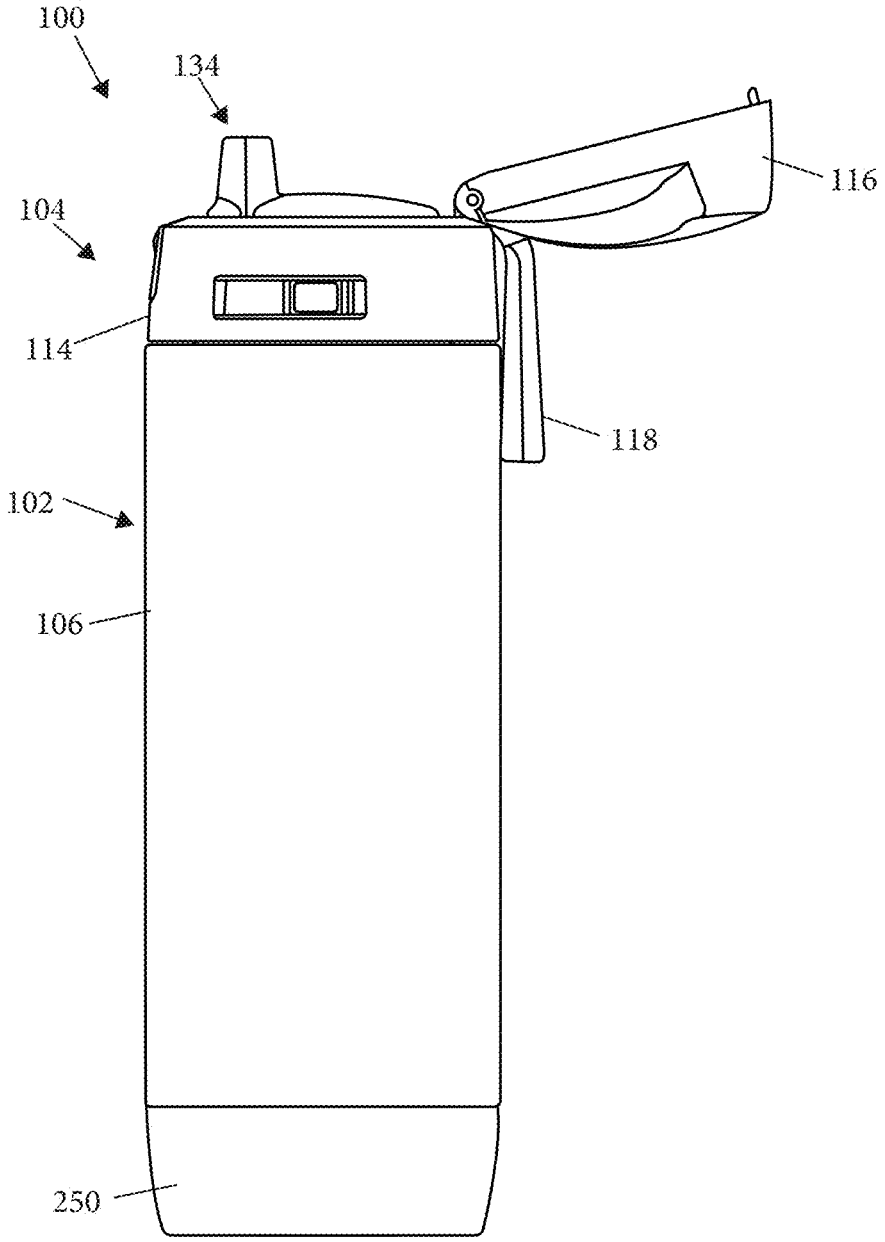
FIG. 30 is a right side view of the drinking assembly of FIG. 29.
Figure 31:
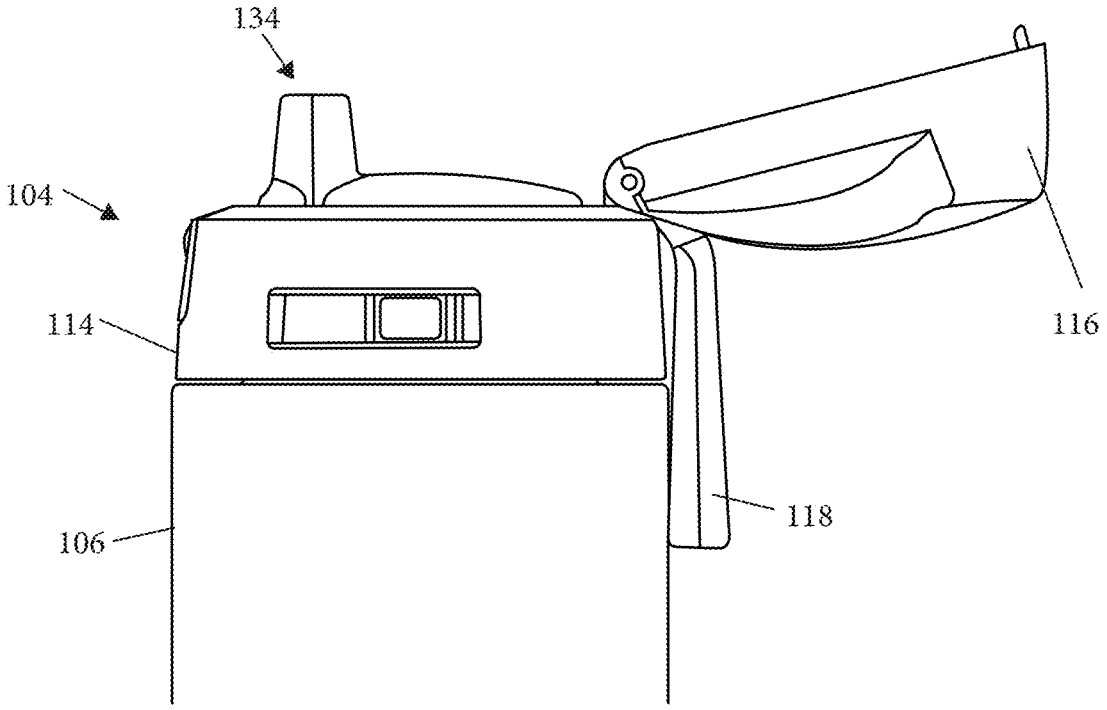
FIG. 31 is an upper right side detail view of the drinking assembly of FIG. 29.
Figure 32:
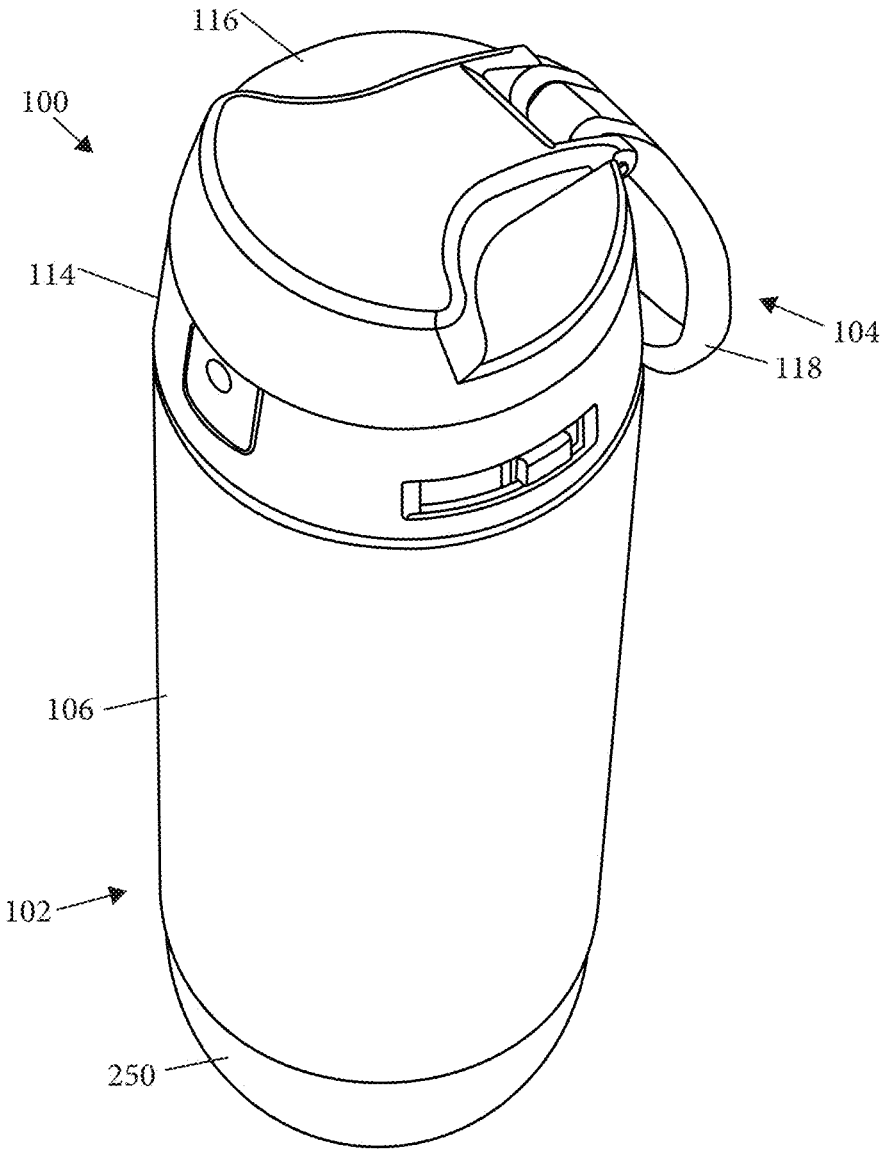
FIG. 32 is a front perspective view of another exemplary embodiment of a drinking assembly in accordance with aspects of the invention.
Figure 33:
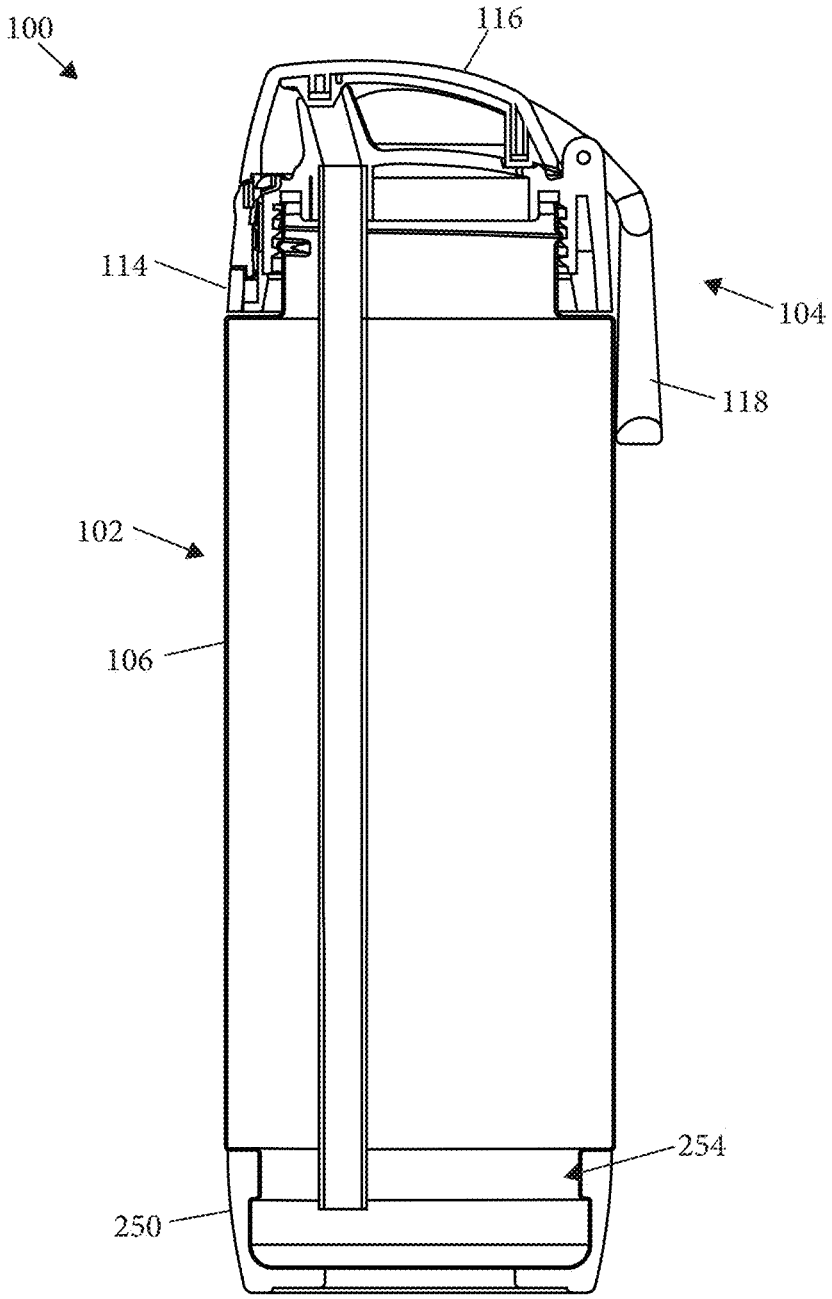
FIG. 33 is a cross-sectional view of the drinking assembly of FIG. 32, taken along line 33-33 in FIG. 32.
Figure 34:
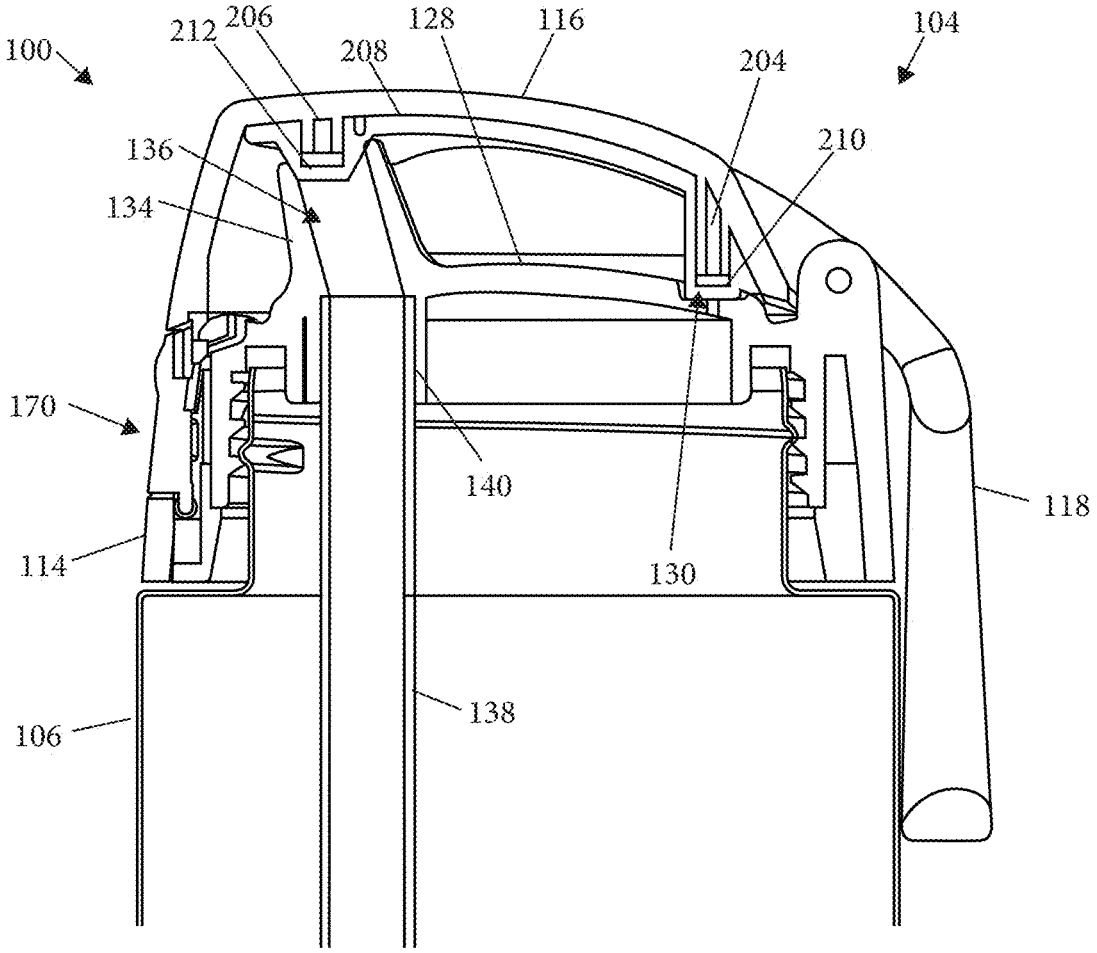
FIG. 34 is a detail view of the cross-section as shown in FIG. 33.
Figure 35:
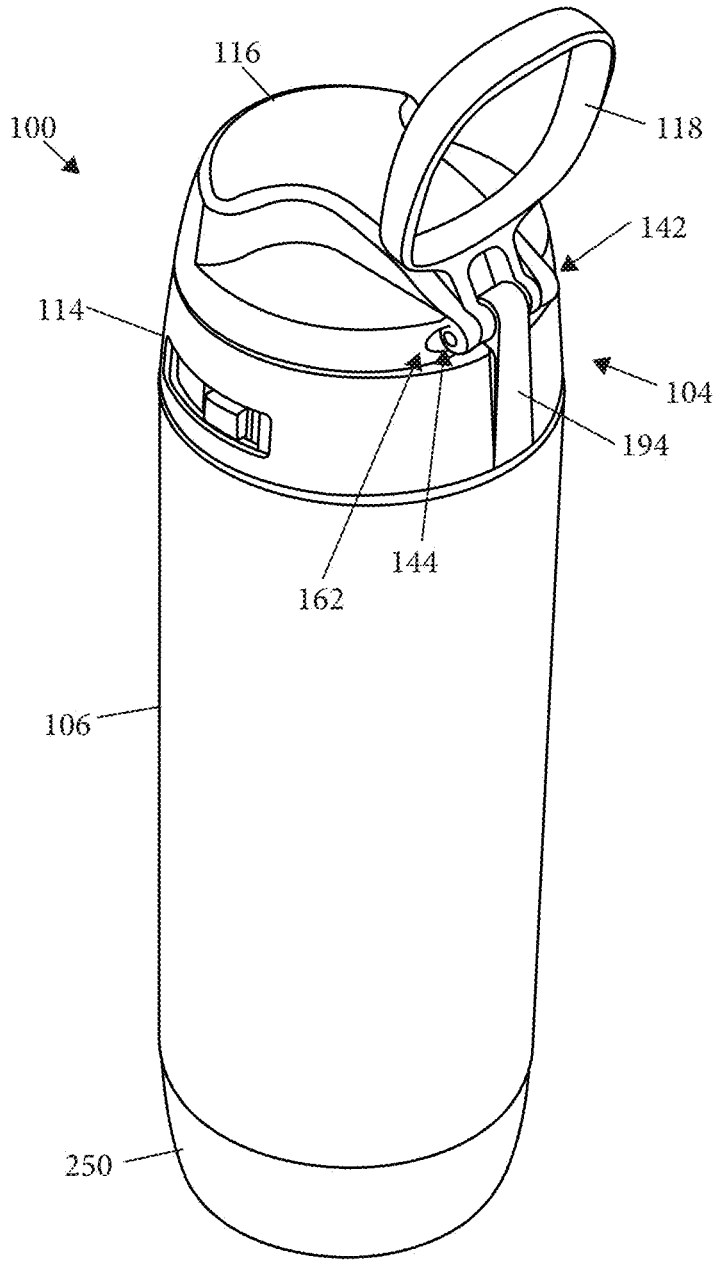
FIG. 35 is a rear perspective view of the drinking assembly of FIG. 32, wherein the handle 118 is pivoted upwardly in an extended position.
Figure 36:
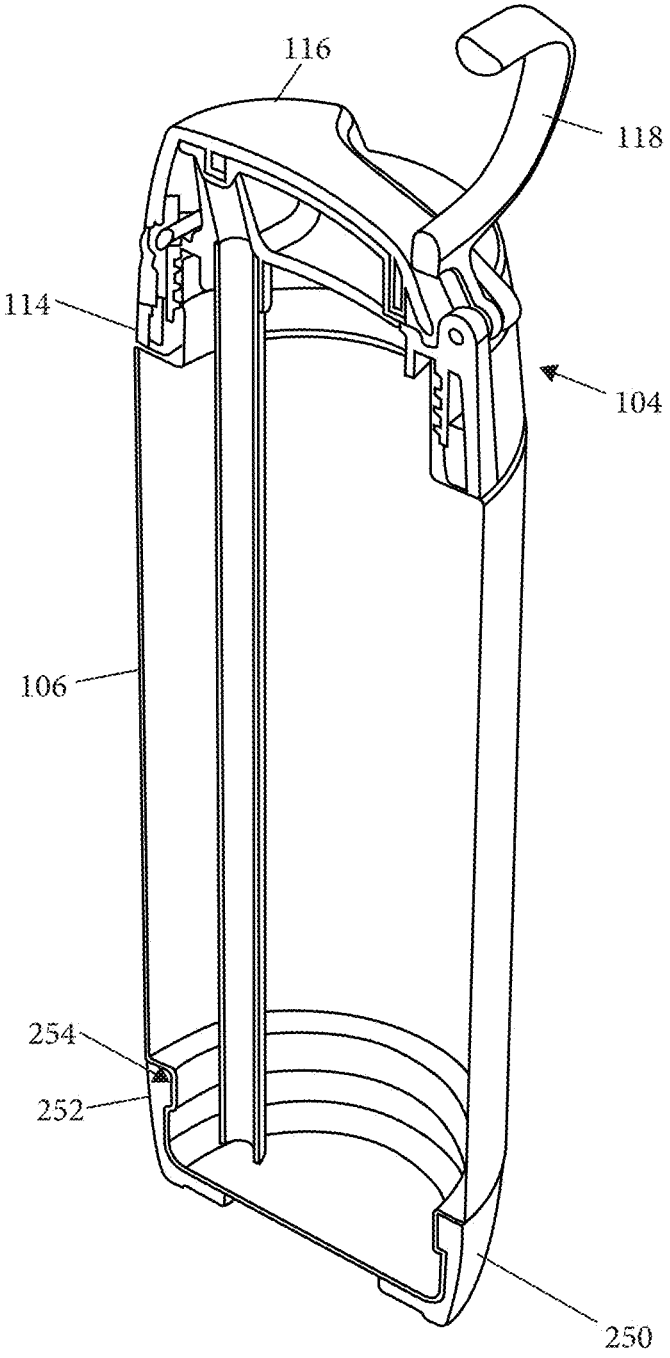
FIG. 36 is a cross-sectional view of the drinking assembly of FIG. 32, taken across line 36-36 in FIG. 35.
Figure 37:
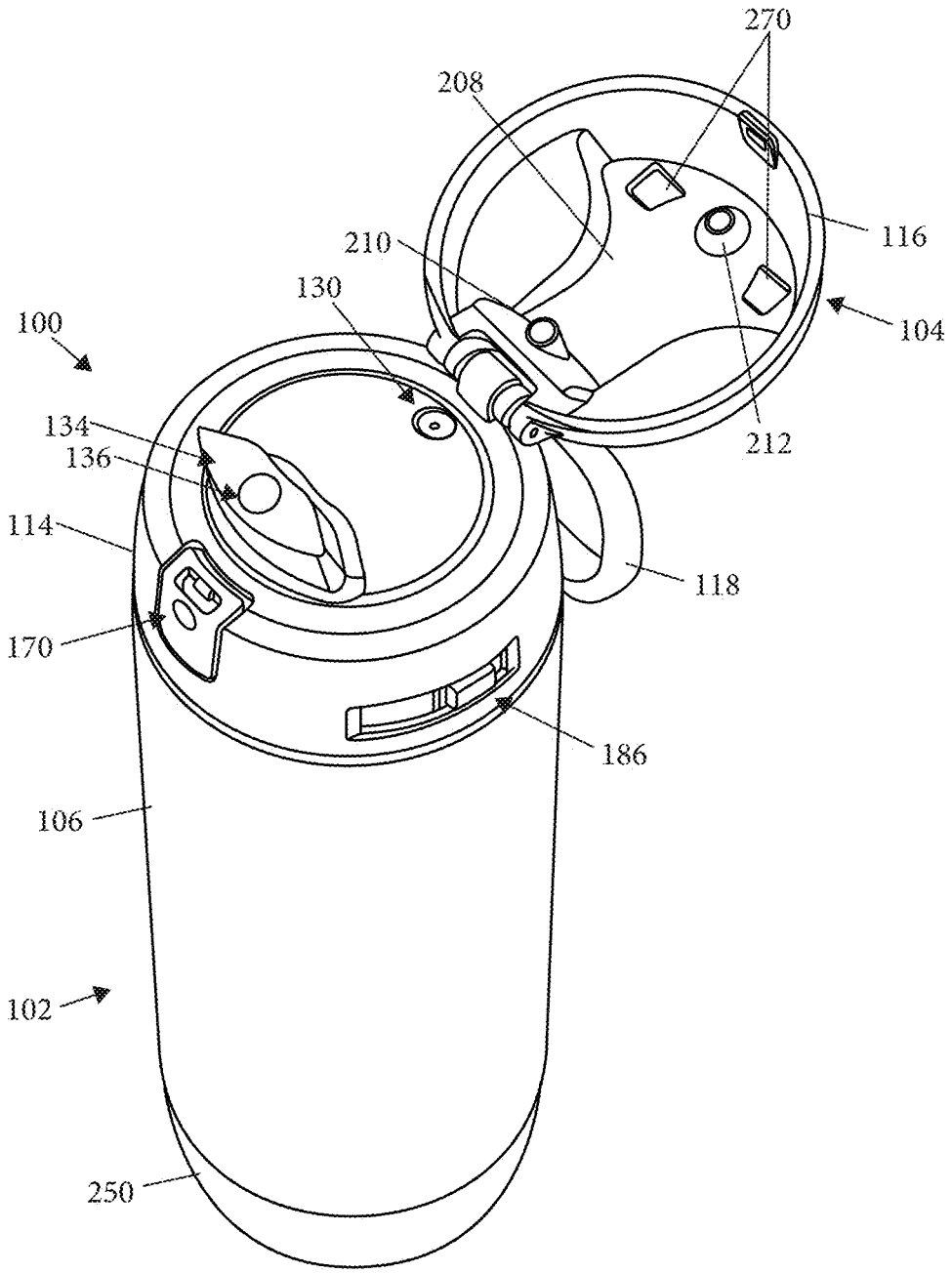
FIG. 37 is a front perspective view of the drinking assembly of FIG. 32, wherein the lid assembly is in an open position to expose a mouthpiece and drink opening.
Figure 38:
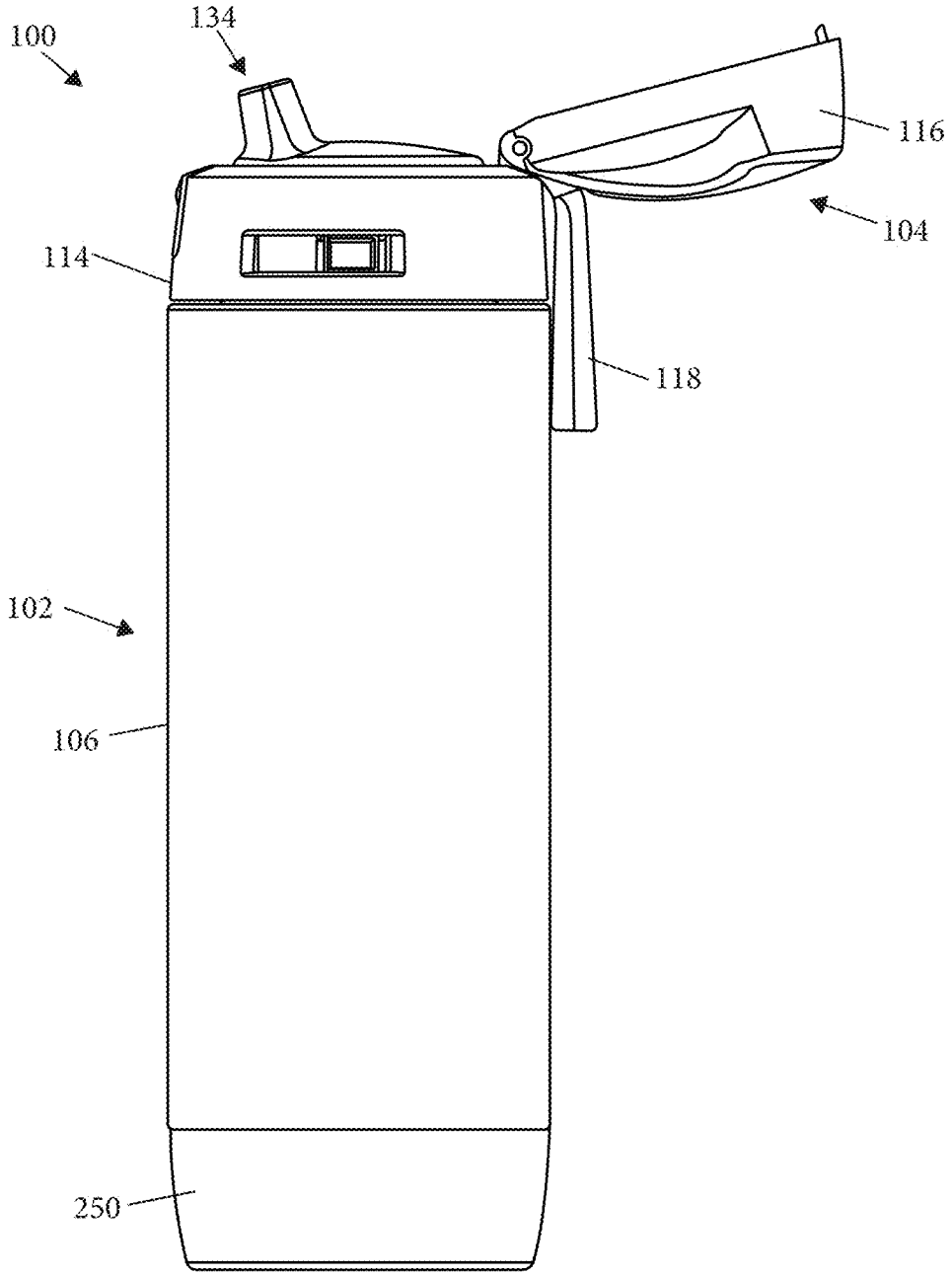
FIG. 38 is a right side view of the drinking assembly of FIG. 37.
Figure 39:
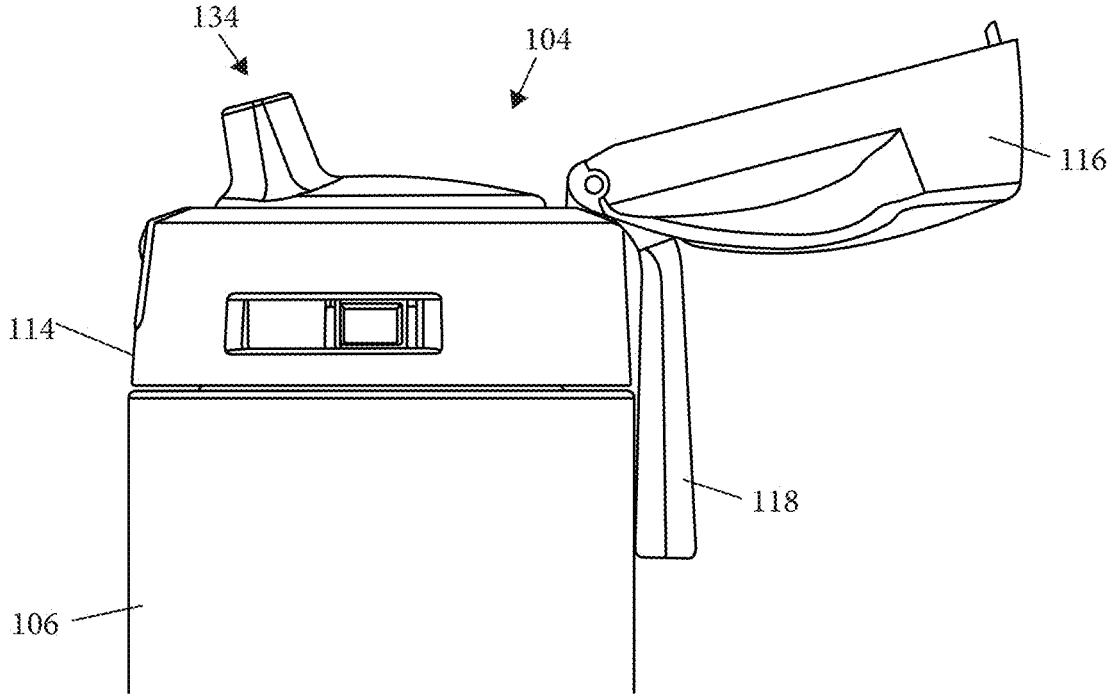
FIG. 39 is an upper right side detail view of the drinking assembly of FIG. 37.
Figure 40:
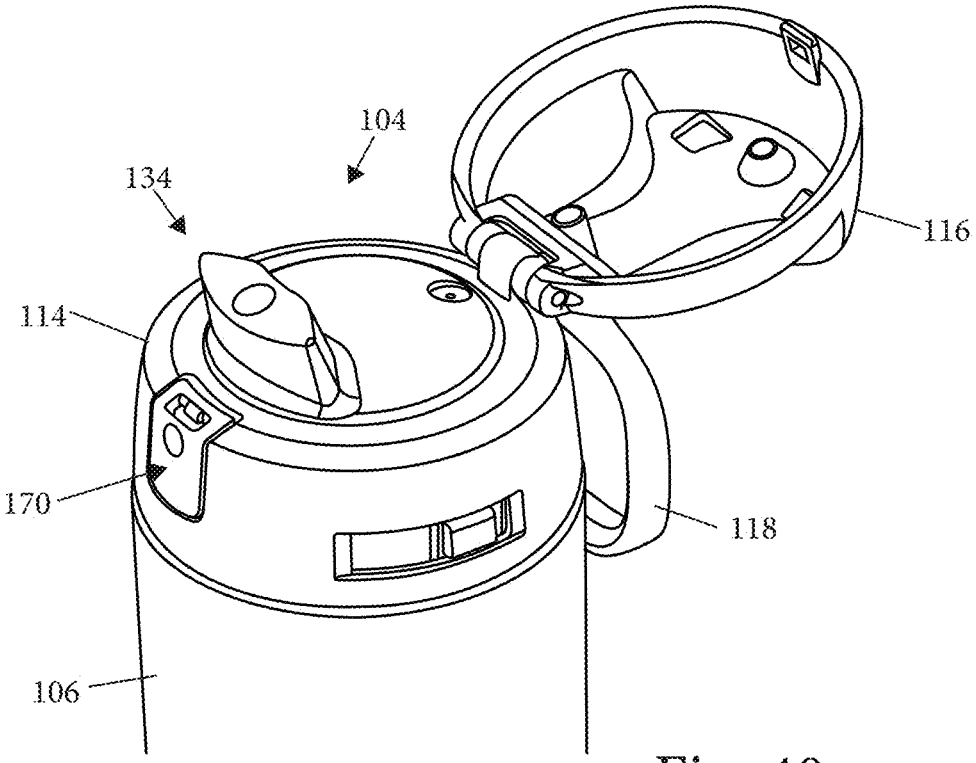
FIG. 40 is a front perspective detail view of the lid assembly of FIG. 37.
Figure 41:
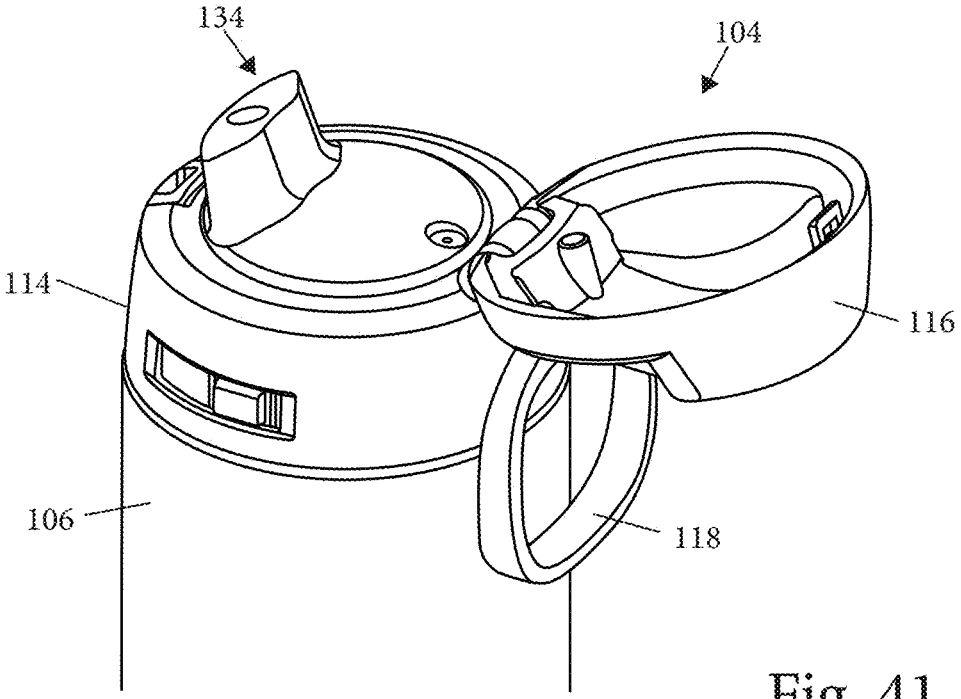
FIG. 41 is a rear perspective detail view of the lid assembly of FIG. 37.

Referring specifically to FIG. 29, the seal 208 of the cap 116 can include lateral mouthpiece recesses 270, which flank the mouthpiece protrusion 212. When the cap 116 is closed, the recesses 270 receive the lateral end portions of the mouthpiece 134. The mouthpiece 134 may have a flat top surface 246 or drain-like grading with a raised rim 232 and recessed mouthpiece opening 136. The mouthpiece recesses 270 in the seal 208 allow the cap 116 to sit lower, which accordingly allows the mouthpiece protrusion 212 to sit further within the mouthpiece opening 136.

Figure 28:
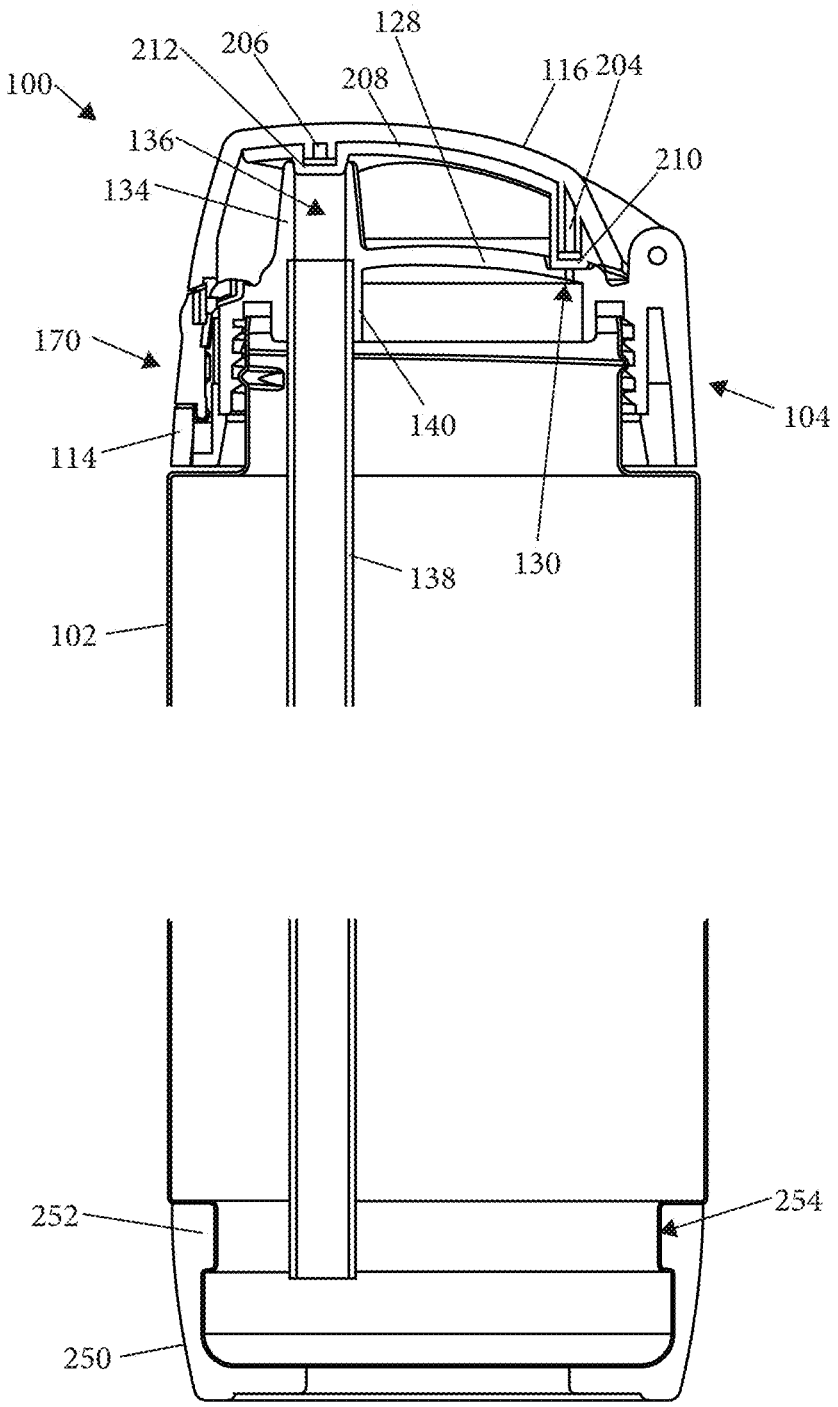
FIG. 28 is a schematic cross-sectional view of the drinking assembly of FIG. 26, wherein the drinking vessel is shown to be sectionalized indicating that the drinking vessel can have any desired length and volume.

As referenced in FIG. 28, illustrating a schematic view of the drinking assembly 100, the drinking vessel 102 can have any desired length. As can be appreciated, the length of the straw 138 can be correspondingly adjusted as desired.

Referring now to FIGS. 32-41, there is shown another embodiment of a drinking assembly 100 which can be substantially similar to the drinking assembly 100 discussed elsewhere herein, such as with reference to the drinking assembly of FIGS. 25-31, except that the mouthpiece is angled forwardly.

Figure 42:
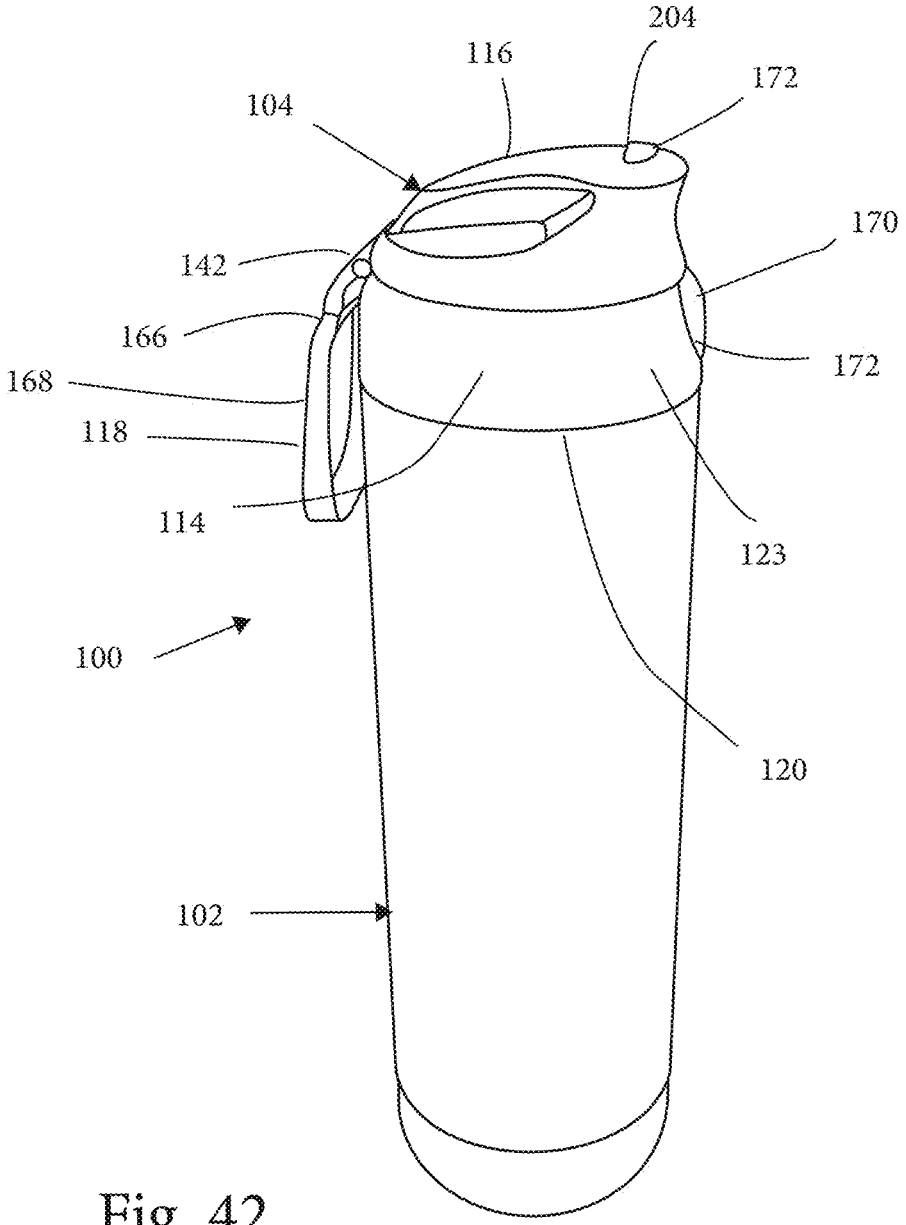
FIG. 42 is a partial side perspective view of a drinking assembly in accordance with aspects of the invention.

With reference now to FIG. 42, an alternative drinking assembly or container 100 provided in accordance with still further aspects of the invention is shown. The drinking assembly 100 has a drinking vessel or base 102 connected to a lid assembly 104, such as by threaded connection, similar to other drinking assemblies discussed elsewhere herein. The body of the drinking vessel 102 can have a tall and slender silhouette as shown but can embody other shapes and sizes, including traditional sizes such as 18-ounce, 24-ounce, 32 ounce, 40-ounce, and 64-ounce vessel sizes. The exterior of the body and lid assembly can be provided with colors, with a combination of colors, as single solid colors, clear and/or metallic finish. A rubber or silicone boot 155, or slip on coaster, can be provided to soften the impact of the vessel as the vessel is placed onto a hard surface, such as countertop. The slip on coaster can have a central opening at the bottom to prevent vapor-lock during assembly of the slip on coaster onto the bottom of the vessel.

The lid assembly 104 can have a lid body 114, a movable cap or cover 116, and a handle 118. In an example, the cap or cover 116 is connected to the lid body 114 via a hinge assembly 142. The lid body 114 can have a lower opening 120 with threads for threaded engagement with the drinking vessel. In an example, the lid body has female threads for receiving external threads on the drinking vessel. The lid body 114 and the drinking vessel can be structured, such sized and shaped, to have a smooth or constant exterior at the interface. As shown, the lid body 114 has a skirt 123 with a sidewall that extends downwardly from an upper surface and wherein the skirt is generally curved or tapered as it extends from the upper region to the lower region, towards the cap 116. In other examples, the skirt 123 can be generally flat or straight between the lower region and upper region.

An activation button or activator 170 is provided on the lid body 114 at an end that is generally opposite the handle 118. The activator 170 is located in an activator opening 172 on the lid body 114. The activator 170 is configured to move, such as when pressed by a finger or thumb, to release a latch between the lid body and the cap to then allow the cap to open to expose a drink opening on the lid body, as further discussed below.

The handle 118 can have a closed loop with an open central configuration to allow one or more fingers or hooks to grab onto the handle. The handle 118 can have an upper handle section 166 having one or more barrels or knuckles 150 (FIG. 43) extending therefrom for aligning with one or more barrels or knuckles formed on the lid body 114 and one or more barrels or knuckles on the cap 116 to then be held by a retaining pin, which together form the hinge assembly 142 in accordance with aspects of the invention. The hinge assembly 142 can further include a spring to spring bias the cap to the open position when the latch is released between the cap and the lid body.

Figure 43:
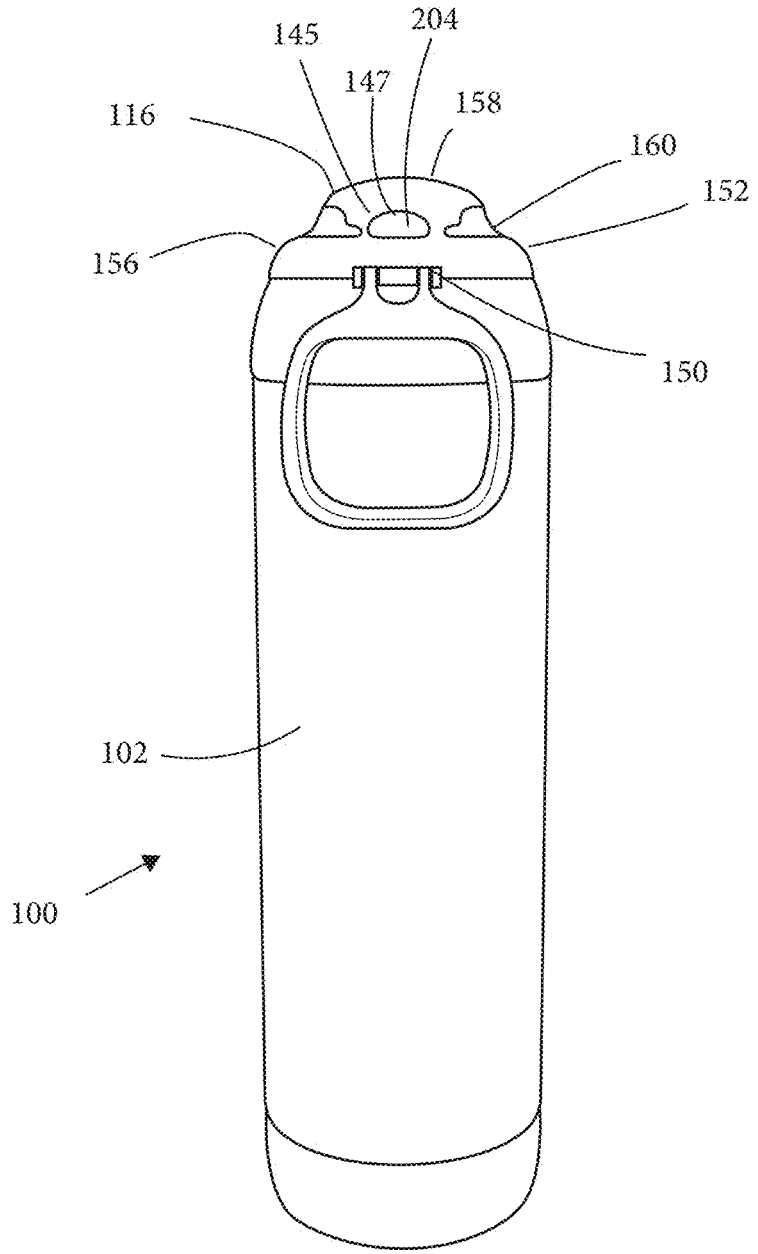
FIG. 43 a rear view of the drinking assembly of FIG. 42.

FIG. 43 is a rear elevation view of the drink assembly of FIG. 42. As shown, the cap 116 has a cap body 152 with a lower cap region 156, an upper cap region 158, and a transition therebetween 160. In an example, the lower cap region 156 is larger, such as wider and/or longer, than the upper cap region 158. The lower cap region 156 can be sized and shaped to envelop a large area of the lid body 114 while the smaller upper cap region 158 is raised to cover the protruding mouthpiece of the lid body, as further discussed below.

A vent anchor post 204 is shown fitted into an opening 145 of the cap 116. In an example, the vent anchor post 204, which can be made from a silicone material or a rubber material, can be co-molded or insert molded with the cap 116, which can be made from a plastic material. Alternatively, the vent anchor post 204 can be separately formed and snap fit into the opening 145. As further discussed below, the vent anchor post 204 extends from a seal pad 211 (FIG. 4) and is part of a vent seal assembly 147 for sealing a vent opening 132 on the lid body. By using a snap fit configuration, the seal assembly 147 can be removed from the cap 116 for cleaning the cap and the vent seal assembly. When the cap 116 is in the closed position, as shown in FIG. 43, the seal pad 211 is pressed against the surface of the lid body 114 and over the vent opening 132 to form a seal around the vent opening. Thus, if the drinking container 100 should tip or laid on its side, fluids from inside the drinking vessel 102 cannot leak out through the vent opening. A similar drinking opening seal assembly can be provided to seal around the drink opening, as further discussed below.

Figure 44:
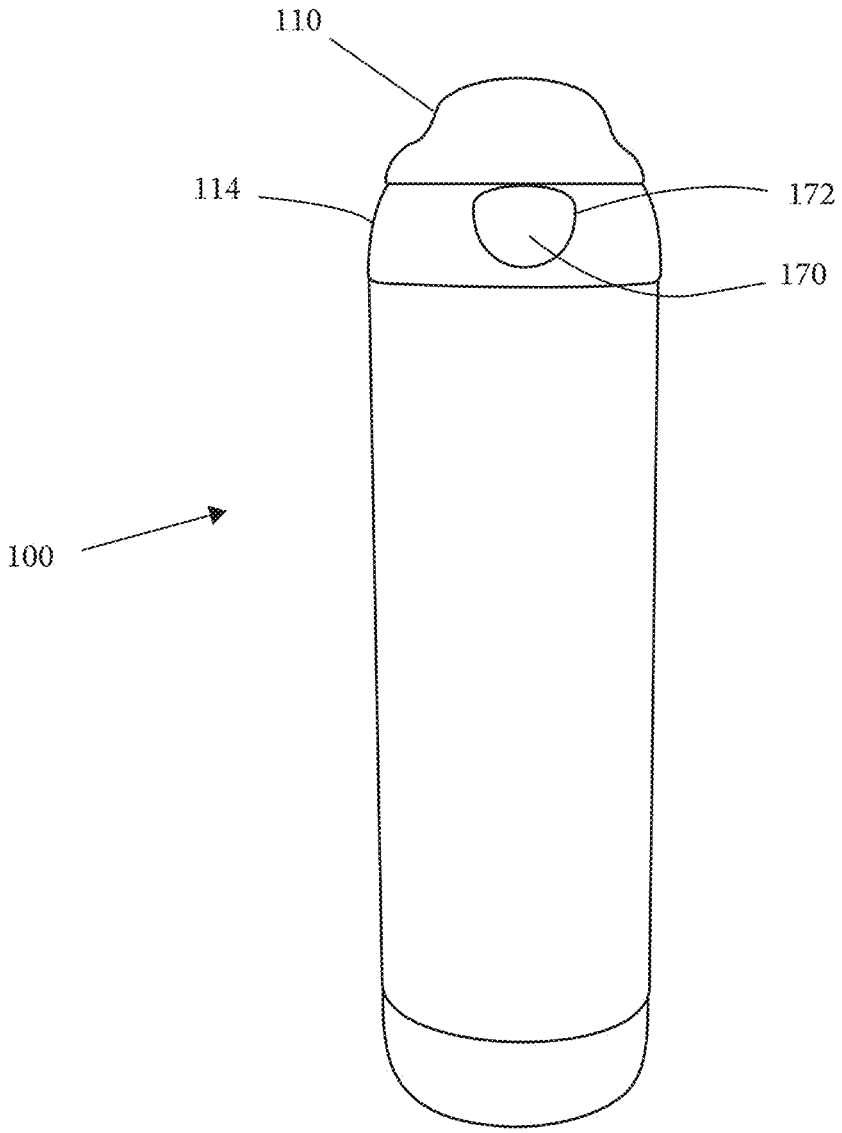
FIG. 44 is a front view of the drinking assembly of FIG. 42.

FIG. 44 is a front elevation view of the drink assembly of FIG. 42, which more clearly shows the activator 170 located inside the opening 172 on the lid body 114. The cap 110 is shown in the closed position, closed over the vent opening and the drink opening.

Figure 45:
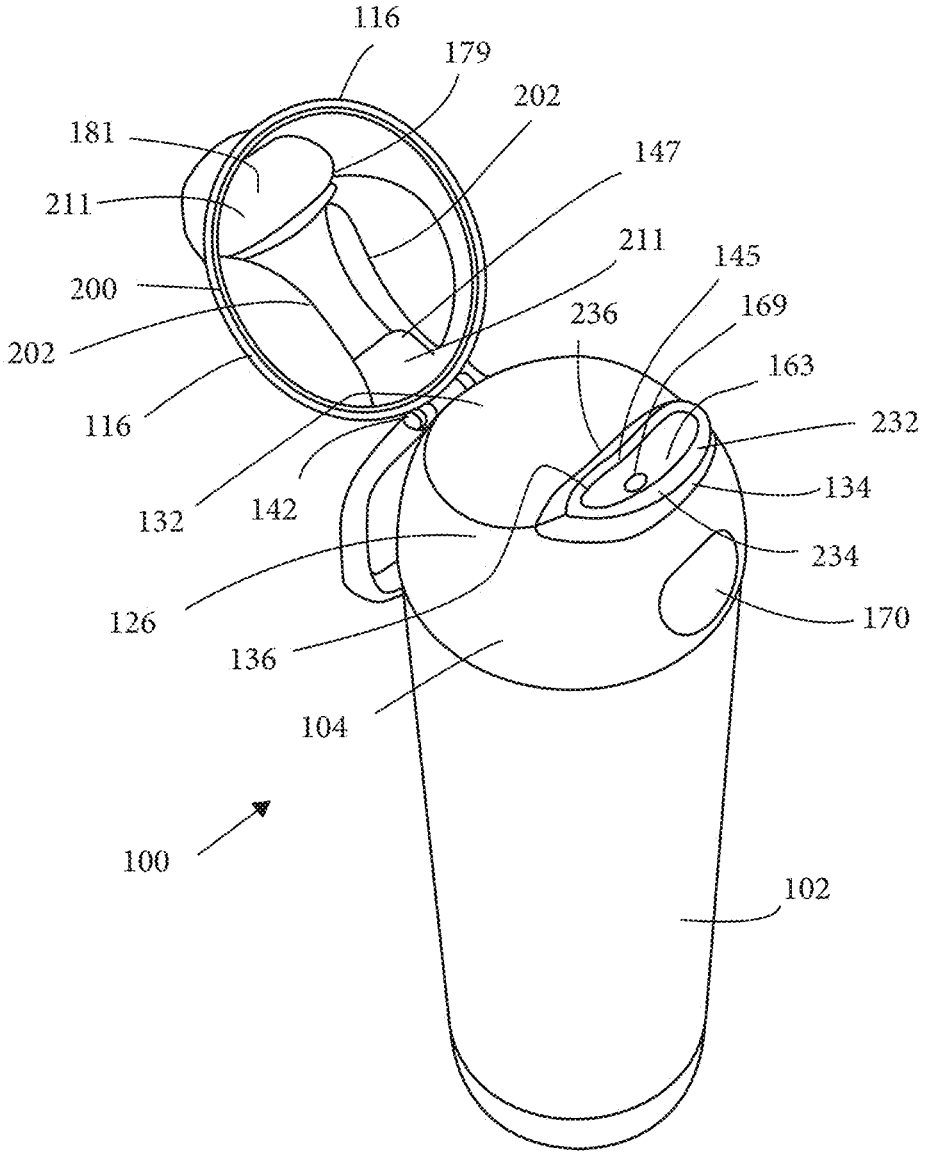
FIG. 45 is a top perspective view of the drinking assembly of FIG. 42 with a cap of the lid assembly in the open position to expose the mouthpiece and drink opening.

With reference now to FIG. 45, a perspective view of the drinking assembly of FIG. 42 is shown with the cap 116 in the open position. In an example, the activator or activation button 170 can be spring biased outwardly away from the lengthwise central axis of the drink container. The spring used to bias the activator 170 can be a leaf spring or a flat spring that is formed with the activation structure comprising the activation button 170. Alternatively, or additionally, a metal helical spring can be used to bias the activation button. The activation structure can further include one or more hooks or latches that project out through the lid body 114 to latch against corresponding latching features on the cap 116, such as corresponding male or female features. In some alternative examples, the activation structure can include links or arms that extend towards the hinge assembly 142 for releasing the male and female latches located near the hinge assembly.

The lid body 114 has a nozzle or spout 134 defining a mouthpiece. The nozzle 134 projects upwardly from the top wall surface of the lid body 114. The nozzle or mouthpiece 134 has a rim 232 defining the drink or spout opening 136, also referred to as a mouthpiece hole, for which a user can place his or her lips around the mouthpiece to take a drink from the container assembly 100, which then pours out of the opening. The rim 232 can have a shape that resembles an elongated oval with two tapered ends, which can be radiused to minimize sharp edges. In the example shown, the two sides of the elongated rim 232, which includes a side 234 of the rim for the bottom lip and a side 236 of the rim for the upper lip, are not identical. In other words, the rim 232 can be asymmetrical about a line drawn through the two tapered ends of the mouthpiece 134. As shown, the side 234 for the bottom lip is curvier than the side 236 of the drink opening for the upper lip. However, the curvier and straighter sides can reverse or the two can have the same line features, which is less preferred.

The drink opening 136 at the rim 232 of the mouthpiece is substantially larger than the vent opening 132 near the hinge assembly 142. In an example, the drink opening 132 size of the mouthpiece 134 is at least 500% larger than the opening size of the vent opening 132. In a particular example, the vent opening is about the size of a 10 to 18 gauge wire while the elongated oval opening has an opening area of about 0.3 in^2 to about 0.8 in^2, and preferably about 0.4 in^2 to 0.6 in^2. However, the relative sizes can be practiced with different ratios with a minimum size difference between the vent opening 132 and the drink opening 136 of the present embodiment, being at least 500%. The size and shape of the mouthpiece 134 are selected to generally match the shape of the user's lips, without requiring the user tightly gather the user's lips, such as puckering up the lips, to seal around the a relatively smaller nozzle, such as a straw.

The silhouette of the mouthpiece 134, such as the outer contour of the mouthpiece, is selected to correspondingly match the opening of the mouth when the mouth opens up to take a drink with minimum tensioning of the lip muscles to form fit around the mouthpiece. For example, the lips would be forced to pucker up, the lower jaw lowers, and the two cheeks changing inwardly, concavity-like, when form fitting around a round mouthpiece. In contrast, when a user places his or her lips around the drink nozzle or mouthpiece in accordance with aspects of the present invention, the lower jaw opens but two cheeks do not deflect inwardly, not cavity-like, to form fit around the oblong shaped outer contour, and the lips are not puckered up. The lip muscles are therefore not exerted and strained as much when using the mouthpiece in accordance with aspects of the present invention compared to a round mouthpiece. Further, when the mouthpiece is asymmetric about a line drawn through the two tapered ends as discussed herein, it is believed that the lip muscles work less to form fit around the exterior of the mouthpiece.

The spout or mouthpiece 134 has an exterior surface and an interior surface. Internally, the interior surface of the spout 134 has a well bottom surface or wall 163 and a well side surface or wall 165. Because the spout has a well bottom surface 163 that occupies the space at the bottom of the spout, the drink opening 136 at the rim of the mouthpiece 134 is larger or bigger than the through opening 169 at the base or bottom surface 163 of the spout 134. As shown, the through opening 169 is formed through the well bottom surface 163 and is in fluid communication with the interior of the lid body 114 and the interior of the drinking vessel 102.

In an example, the through opening 169 is much smaller than the drink opening 136 at the rim 232. In an example, a straw receiving receptacle (not shown) is formed in or on the lid body 114, at a location of the lid wall surface opposite the well bottom surface 163. The straw receiving receptacle is aligned with the through opening 169 at the well bottom surface 163 and is sized and shaped to receive a straw, which can be reusable, can have a lumen, and can have a length that has a first end connected to the straw receiving receptacle at the base and a second end that is located adjacent the interior enclosed bottom of the drinking vessel 102, such as within about 1-inch or less from the enclosed bottom, preferably within about 0.25-inches from the enclosed bottom of the drinking vessel.

When assembled as shown in FIG. 45, and when a straw is coupled to the straw receiving receptacle, a user can take a drink from the drink assembly 100 by placing the user's lips around the mouthpiece 134 to form a seal with the mouthpiece. Preferably, the user forms a seal around the exterior of the mouthpiece and not just with the rim of the mouthpiece. The user can then draw a vacuum or suck in air with his or her mouth to draw up fluid through the straw, through the through opening 169 at the base, and out the drink opening 136 at the rim 232 and into the user's mouth. At the same time fluid is being drawn through the straw, air can vent through the vent opening 132, which is spaced from the mouthpiece 134 and the drink opening 136 by a wall surface on the upper surface of the lid body 114. In alternative examples, the drink assembly can be used without the straw connected to the straw receiving receptable, such as by lifting the drink assembly and chugging it.

The through opening 169 at the bottom of the mouthpiece is preferably round. The through opening can have an opening area of about 0.09 to 0.15 in^2. The elongated oval opening at the rim 232 has an opening area that is about 250% to about 700% larger than the through opening area, with 350% to 600% being more preferred. The relatively larger mouthpiece allows a user to use the drinking container with a straw, but wherein the size of the mouthpiece allows the user to seal around the entire mouthpiece with his or her lips without puckering the lips excessively. In other examples, the contour of the rim 232 of the mouthpiece can be similar to that of FIGS. 23 and 23A, but wherein the mouthpiece has a well rather than an upper surface, like that show in FIG. 45.

In an example, a plurality of ribs or internal structural members 202 are located inwardly of the lid brim or exterior structural member 200, which can also be a skirt depending from the upper wall of the cap 116. The ribs 202 can be provided to increase structural rigidity of the cap 116. In the example shown, ribs are utilized to form a vent seal receptacle 179 and a drink seal receptacle 181, which are spaced from one another. The seal pad 211 of the vent seal assembly 147 is positioned in the vent seal receptacle 179 while the seal anchor 204 (FIG. 43) is located in the opening 172 in the cap 116. Similarly, a relatively larger seal pad 211 of is located in the drink seal receptacle 181 and the seal anchor 204 of the drink seal assembly is located in the second opening 172 of the cap 116. The seal pad 211 of the drink seal assembly is sized and shaped to seal against the rim 232 of the mouthpiece 134 while the seal pad 211 of the vent seal assembly 147 is configured to press against the lid surface to seal off the vent opening 132. The drink seal assembly 181 can be co-molded or inserted molded with the cap or can be separately formed and separately attached to the cap, as previously discussed.

When the cap 116 is closed over the lid body 114 as shown in FIGS. 42-44, the seal pad 211 of the drink seal assembly is pressed against the end surface of the rim 232 to seal the drink opening 136 and prevent spilling contents out through the mouthpiece when the drink container 100 tilts and/or falls to its side. Thus, in the cap closed position of FIGS. 42-44, the separately formed and spaced apart vent seal assembly 147 and drink seal assembly 181 separately seal the vent opening 132 and the drink opening 136, respectively, from spilling.

Figure 47:
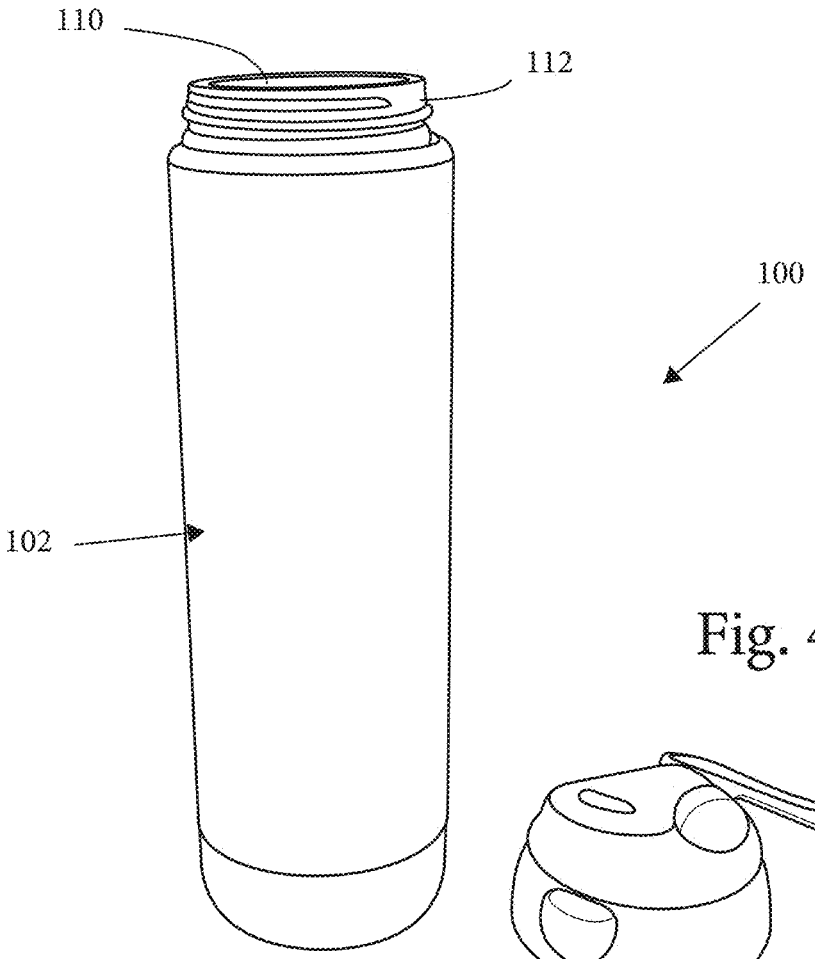
FIG. 47 is a dissembled view of the drinking assembly of FIG. 42, showing the lid assembly.
Figure 46:
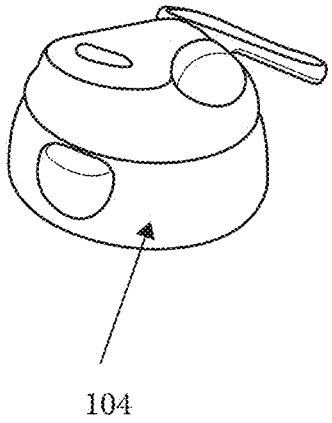
FIG. 46 is a dissembled view of the drinking assembly of FIG. 42, showing the drinking vessel with a threaded open top.

FIG. 47 shows the lid assembly 104 separated from the drinking vessel or base 102. The threaded neck 112 and the vessel opening 110 are shown in the present view. The threaded neck has exterior threads or male threads for projecting into and threadedly engaging the female threads on the lid assembly 104. In some examples, the male and female thread configurations of the drink vessel and lid assembly are reversed.

Figure 48A:
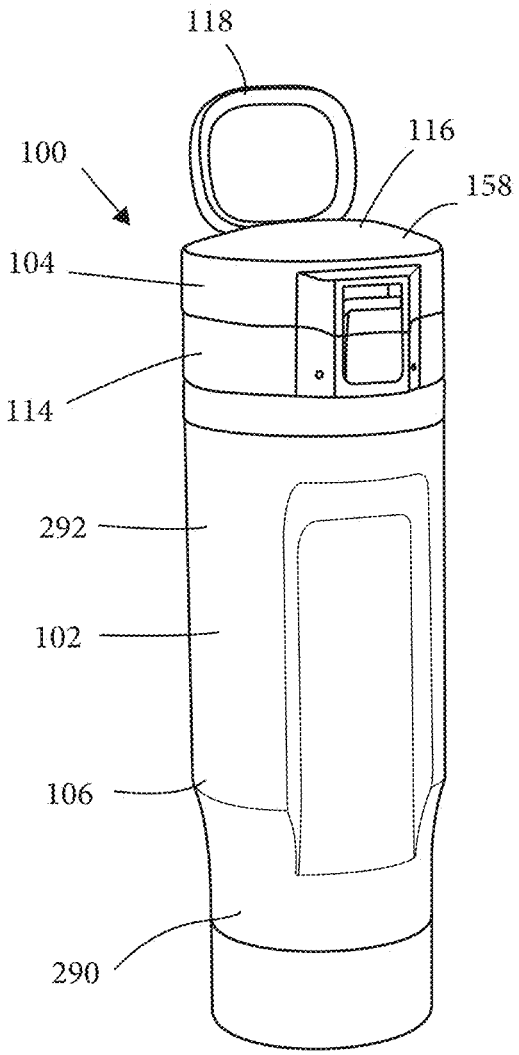
FIGS. 48A and 48B are perspective views of another drinking assembly with a cap in a closed position and in a cap open position, respectively.
Figure 48B:
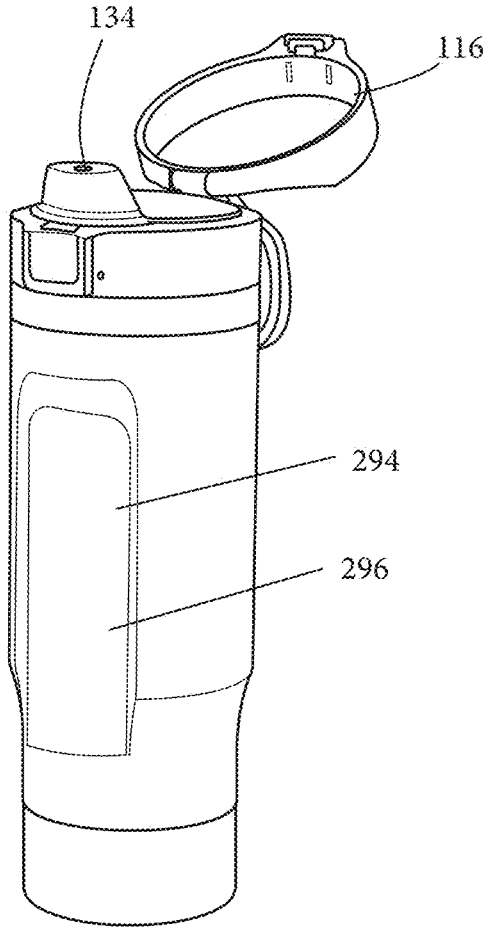

With reference now to FIGS. 48A and 48B, a drink assembly 100 provided in accordance with still further aspects of the invention is shown, in a cover or cap 116 closed configuration and in a cover open configuration, respectively. The present drink assembly 100 shares many common features as other drink assemblies discussed elsewhere herein, including having a lid assembly 104 with a cap 116, a lid body 114, and a handle 118, and a drinking vessel 102. The lid body 114 has a unique mouthpiece or spout 134 similar to previously discussed mouthpieces. In the present embodiment, the vessel 102 has a body 106 with a lower section 290 having a smaller diameter than an upper section 292. The smaller diameter lower section 290 is configured to fit in a typical cup holder.

An indented section 294 is provided with the body 106 for aesthetic, for gripping, and/or for labelling the vessel, such as for placing a product name, a trademark, or a customizable image or text. In an example, the intended section 294 has a surface 296 that is indented from the larger outer surface contour of the upper section 292. In an example, the surface of the indented section 294 is generally flushed with the surface of the lower section 290. The indented section resembles a three-sided rectangular space and the length of the indented section can extend upwardly towards the metal ring area at the opening of the vessel as desired.

The cap or cover 104 shown has a low profile upper cap region 158 that has a generally smooth convex surface without transitions or stepped regions, like that of FIG. 5. The cap 104 can have a seal 208 that is similarly configured for sealing the mouthpiece 134 and the vent opening on the lid body, similar to other described embodiments.

Figures 49A, 49B, 49C:
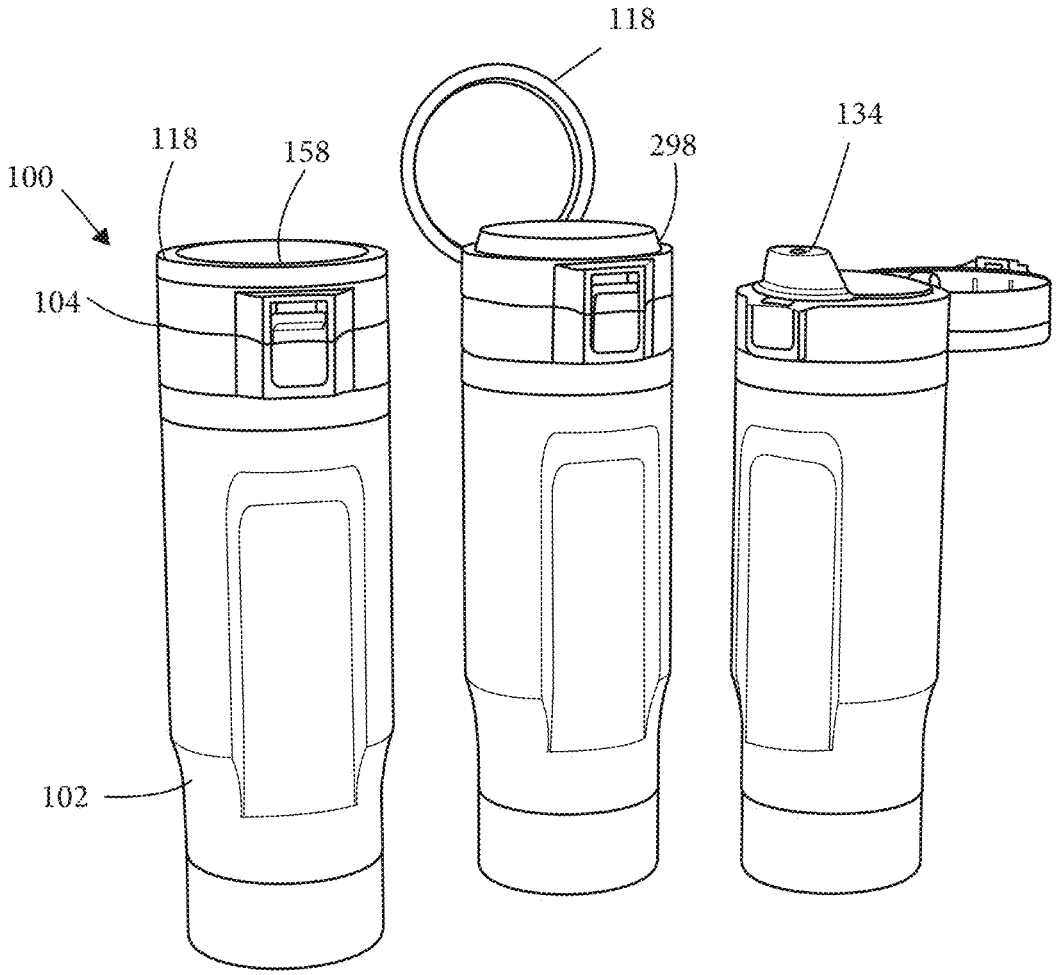
FIGS. 49A, 49B, and 49C are perspective views of another drinking assembly with a cap in a closed position, in a cap closed position with a handle pivoted position, and in a cap open position, respectively.

With reference now to FIGS. 49A, 49B, and 49C, a drink assembly 100 provided in accordance with still further aspects of the invention is shown, in a cover or cap 116 closed configuration, in the same cover closed position but with a handle 118 raised from its stowed position, and in a cover opened configuration to expose the mouthpiece 134, respectively. The mouthpiece 134 has a similar contour and configuration as other mouthpieces discussed elsewhere herein. The cap 116 in the present has a low profile configuration similar to the cap 116 of FIGS. 48A and 48B.

In the present embodiment, a recessed rim section 298 is incorporated with the cap, along the upper outer perimeter of the cap. The recessed rim section 298 is annular or round for accommodating the inside diameter of the handle 118 when the handle is in the stowed position of FIG. 49A. In the stowed position, the upper cap region 158 and the handle should blend in so that the upper surface contour and the handle appear continuous and the sidewall of the cap and the handle appear continuous. However, the handle 118 preferably has a different color or texture than the cap 116 to make it apparent for the user to distinguish between the two, which also inherently serves as instructions that the handle is separable from the cap.

Figure 50A:
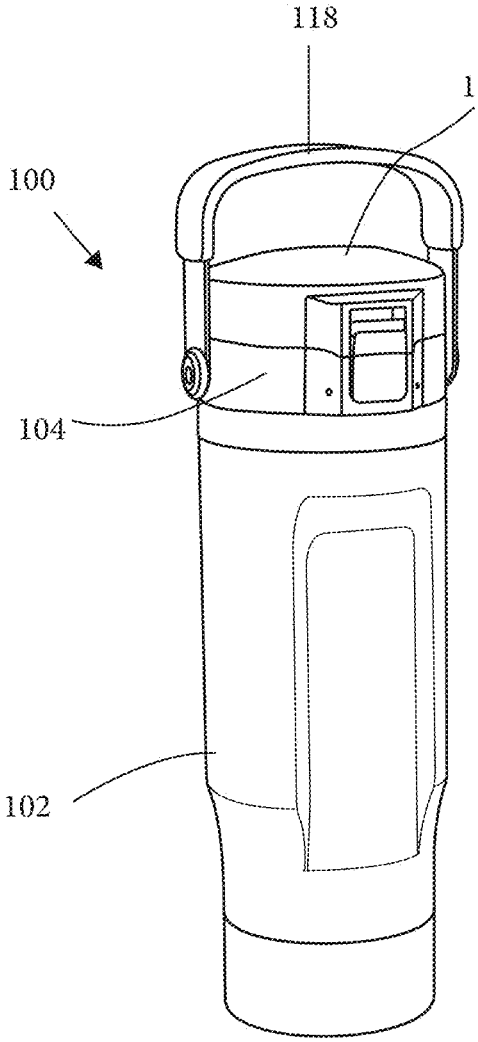
FIGS. 50A and 50B are perspective views of another drinking assembly with a cap in a closed position and in a cap open position, respectively.
Figure 50B:
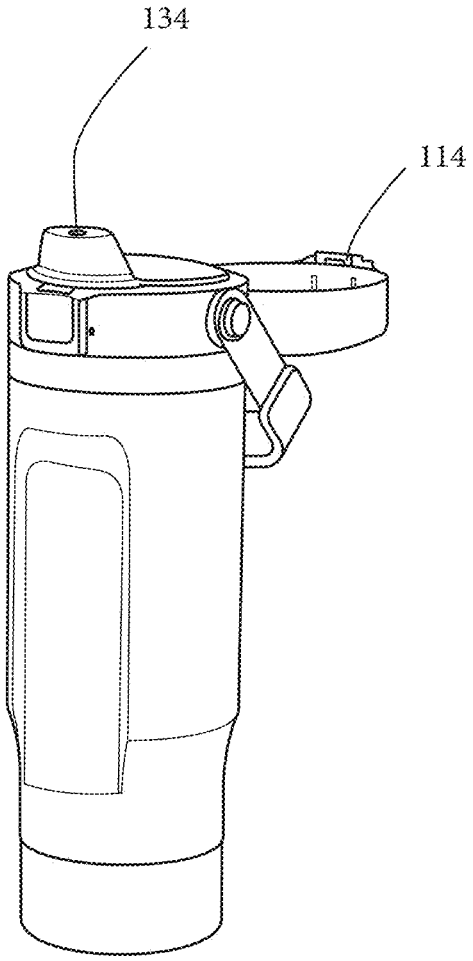

FIGS. 50A and 50B show another drink assembly 100 provided in accordance with still further aspects of the invention in a cover or cap 116 closed configuration and in a cover opened configuration to expose the mouthpiece 134, respectively. The cap 116 in the present embodiment has a low profile configuration similar to the cap 116 of FIGS. 48A and 48B. The mouthpiece 134 has a similar contour and configuration as other mouthpieces discussed elsewhere herein. In the present embodiment, the handle 118 is pivotably mounted to the lid body 114, similar to the other embodiments. However, the handle 118 in the present embodiment is an open or non-continuous design that is generally U-shaped with a three-sided arm. The two parallel arm portions are each pivotably mounted to the lid body 114, such as with a fastener-type pin, and the middle arm portion spans the width of the lid assembly and configured for grabbing or gripping by a user. The two fastener-type pins can have a standard Phillips head or a flat head and be removable or can be provided with an irreversible head to prevent removal of the handle.

In an example, handle 118 is made from a metal material, which can be made from a steel-based material that can be powder coated or painted, or provided as raw or polished steel. The middle handle portion can be co-molded or wrapped with a plastic sleeve or plastic coat. When the lid assembly 104 is removed from the vessel 102, the handle 118 is removed with the lid body 114.

Figure 51A:
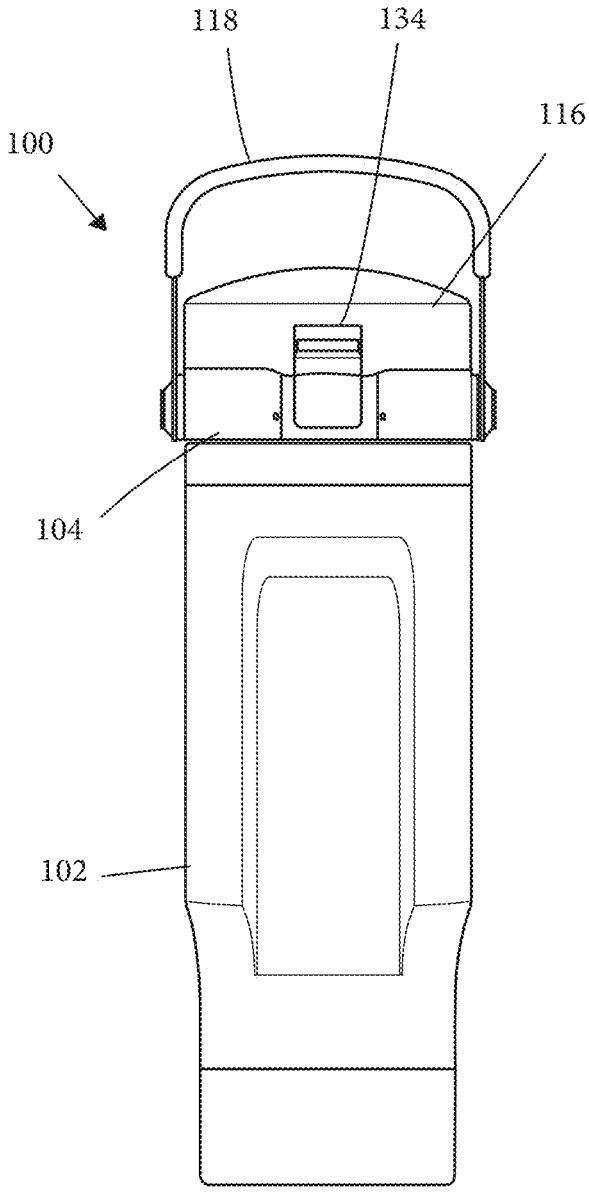
FIGS. 51A and 51B are perspective views of another drinking assembly with a cap in a closed position and in a cap open position, respectively.
Figure 51B:
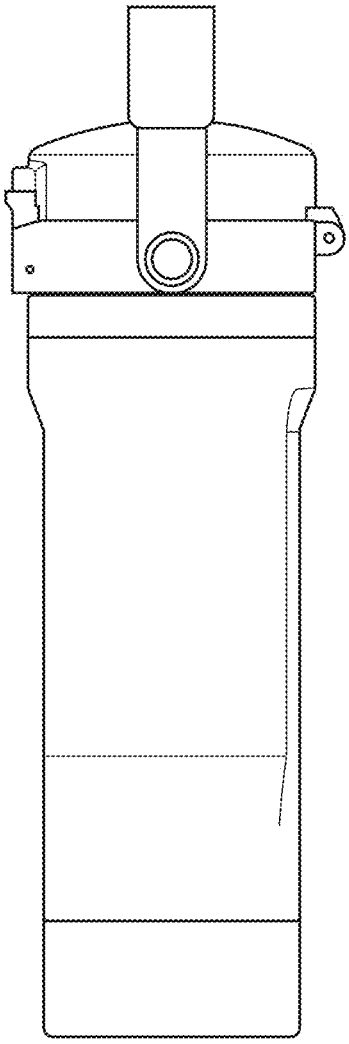

FIGS. 51A and 51B show another drink assembly 100 provided in accordance with still further aspects of the invention in a cover or cap 116 closed configuration and in a cover opened configuration to expose the mouthpiece 134, respectively, similar to the drink assembly of FIGS. 50A and 50B. In the present embodiment, the cap 116 is made from a transparent or a semi-opaque plastic material, such as a clear polycarbonate material. Other caps described herein may be practiced with a similar transparent or semi-opaque material. The clear or semi-opaque material allows the mouthpiece to be viewed even when the cap is in the closed configuration.

Figure 52C:
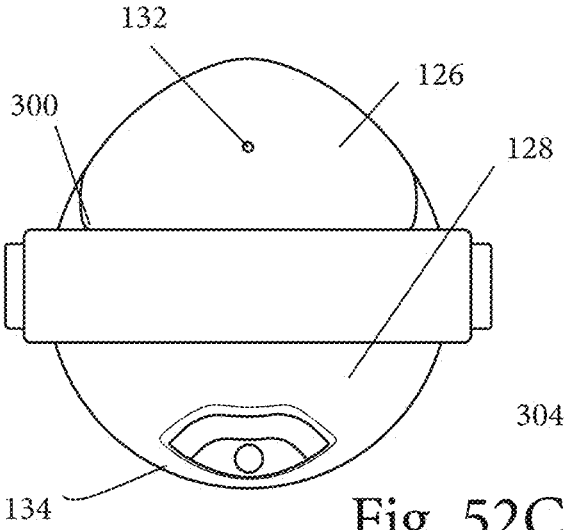
FIG. 52C is a top view of FIG. 52A
Figure 52D:
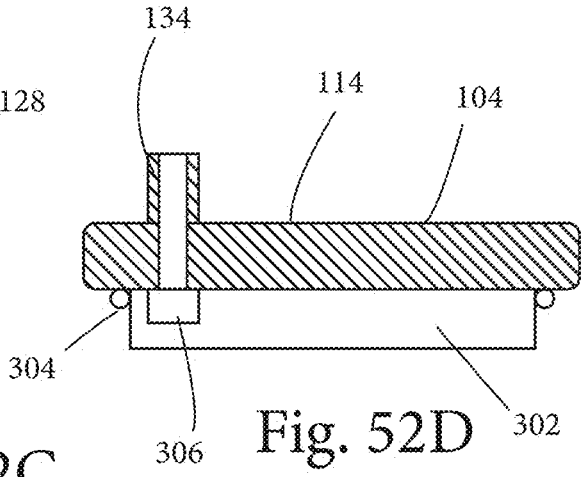
FIGS. 52A and 52B are front and side views of another drinking assembly with a drinking vessel and a lid assembly.
Figure 52A:
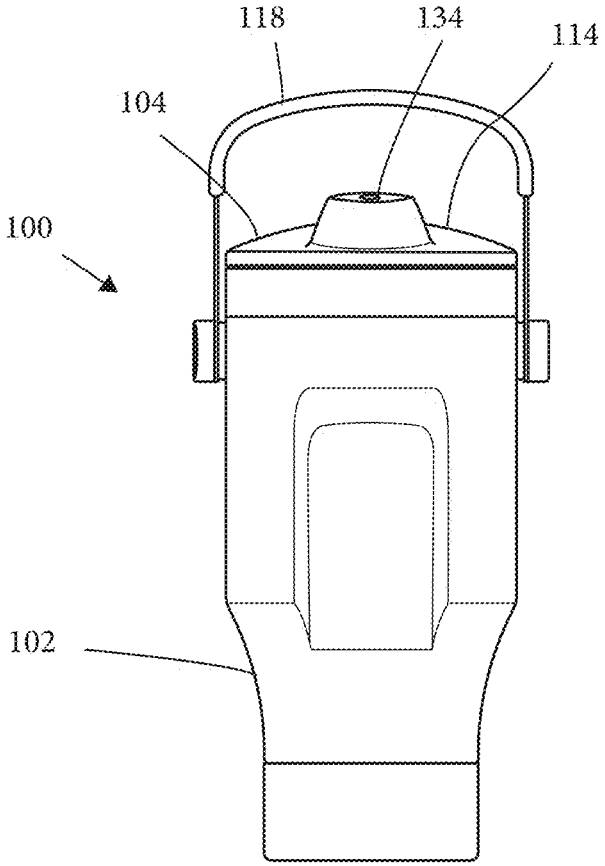
Figure 52B:
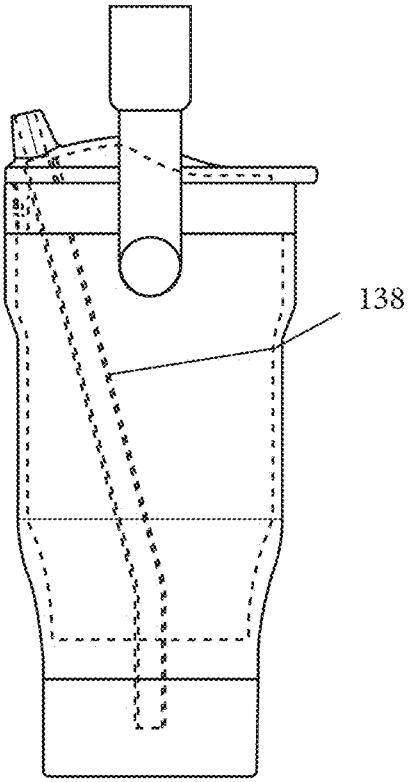

FIGS. 52A and 52B show another drink assembly 100 provided in accordance with still further aspects of the invention, shown along a front view and a side view, respectively. The present drink assembly 100 is a tumbler type drinking assembly comprising a drinking vessel 102 and a lid assembly 104. The lid assembly 104 in the present embodiment has a lid body 114 with a mouthpiece 134, which can be similar to other mouthpieces discussed elsewhere herein. In the present embodiment, a cover or cap is omitted from the lid assembly 104 so that the mouthpiece is always available for use without first opening a cover or cap.

The handle 118 shown is generally U-shaped and is similar to the handle of FIGS. 50A and 50B. In the present embodiment, the handle is pivotably mounted to the vessel and not the lid body. The handle 118 can pivot forward towards the mouthpiece or backward away from the mouthpiece and the middle section can rest against the side of the vessel when fully pivoted.

FIG. 52C is a top view the drink assembly 100 of FIG. 52A, which shows the top of the handle 118 and the top of the lid assembly 104. The lid assembly has an upper region with a multi-tiered top wall comprising a first top wall section 126 and a raised second top wall section 128, which has a curved or arcuate step 300 separating the two upper wall sections of the lid assembly. In an example, the mouthpiece 134 is located at the second top wall section 128 and a vent opening 132 is located at the first top wall section.

FIG. 52D is a schematic cross-sectional side view of the lid assembly 104 of FIG. 52C, taken along a side-center line of the mouthpiece 134. The lid assembly 104 has a lid body 114 with a multi-tiered top wall as previously discussed. A skirt section 302 extends downwardly from the lower surface of the cap body. The skirt section 302 is a ring shaped structure, similar to a ring, that is configured to project into the interior opening of the container vessel 102 in a tight or slight interference fit, which is conventional. A straw receiving receptacle 306 can be provided subjacent the mouthpiece for receiving a straw, as previously discussed. A gasket or O-ring 304 can be provided at the exterior base of the skirt section 302 for sealing against the upper rim of the drinking vessel 102.

With reference again to FIG. 52B, a straw 138 is shown in schematic attached to the straw receiving receptacle 306. As shown, the straw 138 can have a length with a change in axis, or more than one axis. In the present embodiment, the straw has a turn and two axes that are angled to one another. In another example, the straw can be a single axis straw and can be reusable or a disposable type.

Figure 53:
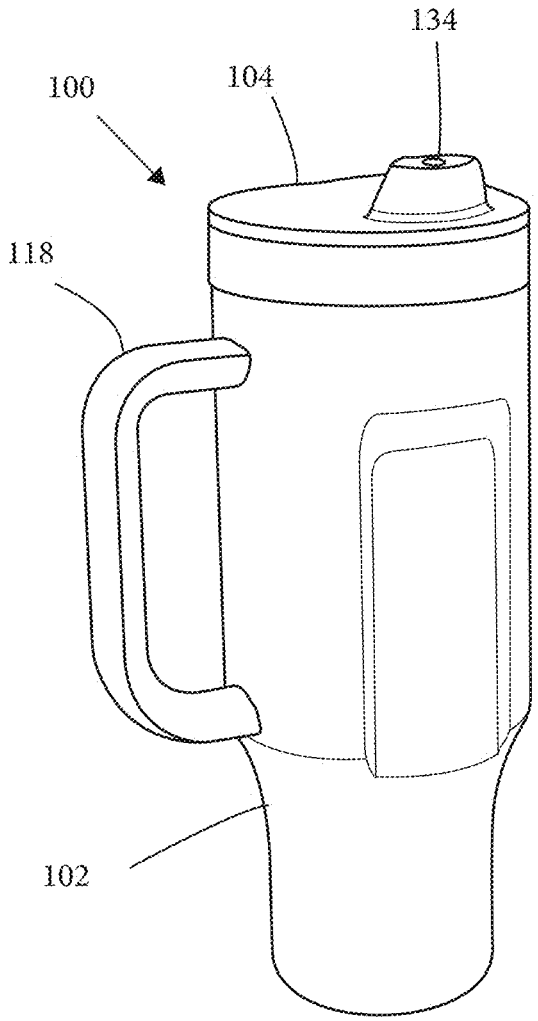
FIG. 53 is a perspective view of another drinking assembly with a drinking vessel and a lid assembly.

FIG. 53 shows another drink assembly 100 provided in accordance with still further aspects of the invention, shown in a front perspective. The drink assembly 100 of FIG. 53 is a tumbler type drinking assembly comprising a drinking vessel 102 and a lid assembly 104, similar to that of FIGS. 52A and 52B. However, the handle 118 in the present embodiment differs from the handle of FIGS. 52A and 52B in that the present handle is similar to a coffee mug type handle, in which the two parallel arm portions are attached to the same side of the vessel, generally aligned along a vertical line.

Figure 54:
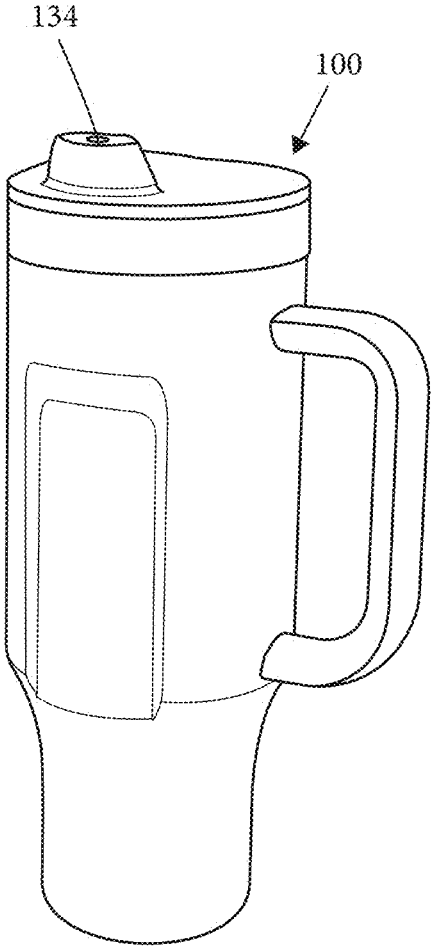
FIG. 54 is a perspective view of another drinking assembly with a drinking vessel and a lid assembly that is similar to FIG. 53, but embodies a different color.

FIG. 54 shows another drink assembly 100 provided in accordance with still further aspects of the invention, shown in a front perspective. The drink assembly 100 of the present embodiment is similar to the drink assembly of FIG. 53, except wherein the color appearance differs. Whereas the drink assembly 100 of FIG. 53 has a dark color, such as black or dark blue color, except for the metal ring at the opening of the vessel, the drink assembly of the present embodiment has a light color, such as an ivory, cream, or white color with a metal ring at the opening of the vessel.

Figure 55A:
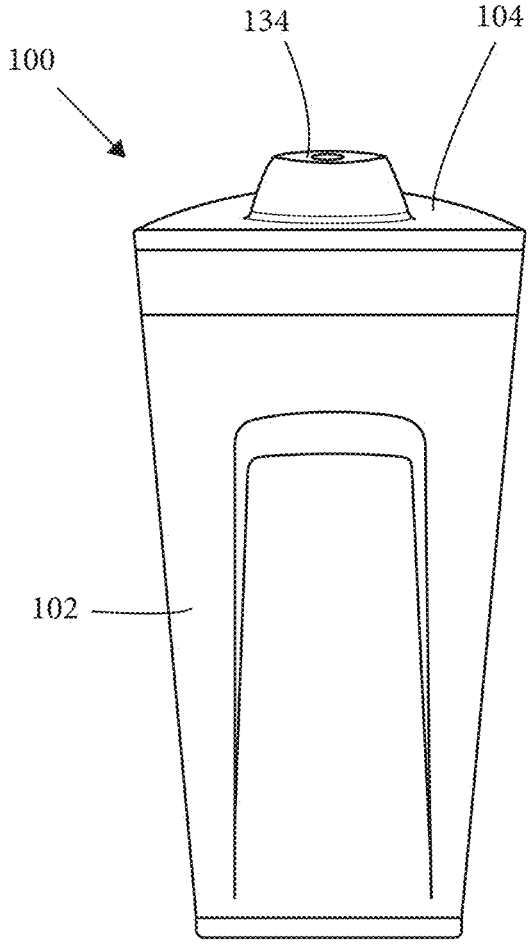
FIGS. 55A and 55B are front and side views of another drinking assembly with a drinking vessel and a lid assembly.
Figure 55B:
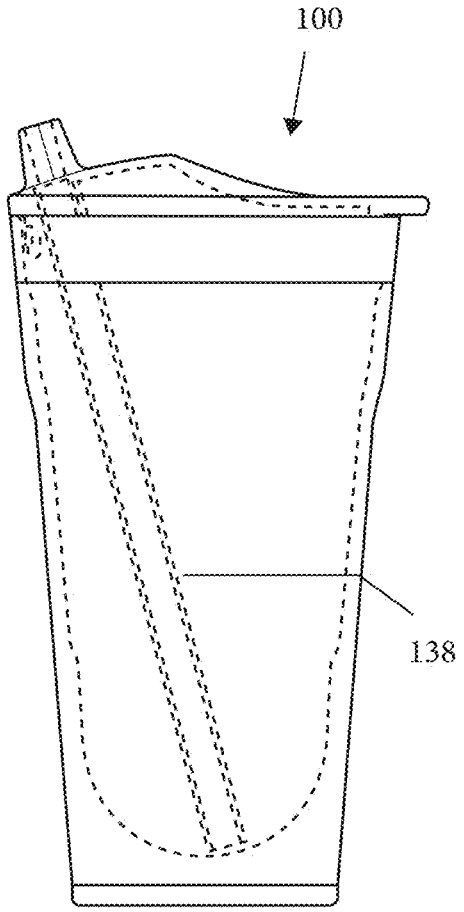

FIGS. 55A and 55B show another drink assembly 100 provided in accordance with still further aspects of the invention, shown along a front view and a side view, respectively. The present drink assembly 100 is a tumbler type drinking assembly comprising a drinking vessel 102 and a lid assembly 104, but without a handle. The lid assembly 104 in the present embodiment has a lid body 114 with a mouthpiece 134, which can be similar to other mouthpieces discussed elsewhere herein, such as being similar to the lid assembly of 52A and 52B. In the present embodiment, the drinking vessel 102 has been modified to having a single taper rather than two distinct diameters like that of FIGS. 52A and 52B.

With reference again to FIG. 55B, a straw 138 is shown in schematic attached to the straw receiving receptacle of the lid assembly. As shown, the straw 138 can have a length with a single axis that can be reusable or a disposable type.

In some examples, a lid assembly with a mouthpiece having the unique contours described herein can be injection molded or plastic molded and used as a 1-time disposable lid, although it can be cleaned and re-used. For example, the lid assembly of FIG. 52C can be made from injection molding or thermoforming. The 1-time use lid, similar to disposable coffee lid, can have the unique mouthpiece in accordance with aspects of the present invention that can be used to sip from, rather than with a straw. The plastic molded lid in accordance with the present embodiment can have a rim that can snap fit around a cup, which can be a disposable paper-based, plastic-based cup, or Styrofoam-based cup. The mouthpiece of the disposable lid can resemble the mouthpiece of FIGS. 22, 23, and 23A, among others, but wherein the body of the mouthpiece has a top wall with a mouthpiece opening, is hollow, and has a mouthpiece outer shell with the same unique asymmetric contour formed by thermoforming. The disposable lid is formed by molding, such as by thermoforming a plastic sheet and then optionally trimmed for fit. The base that is usable with the disposable lid can be a disposable cup or a reusable cup. The skirt on the disposable lid can snap fit to the open top of the base, whether a disposable kind or a reusable kind. The disposable lid can have a lid body with a top wall and a skirt depending from the top wall. The skirt can snap fit with an open top of a base or drinking vessel. The mouthpiece can be located at the top wall. The top wall can be planar, can have curved portions, and/or can have stepped surfaces or shoulders.

Methods of making and of using the drinking assembly and components thereof are within the scope of the present invention.

Although limited embodiments of the drinking assemblies and their components have been specifically described and illustrated herein, many modifications and variations will be apparent to those skilled in the art. Accordingly, it is to be understood that the drink assemblies and their components constructed according to principles of the disclosed device, system, and method may be embodied other than as specifically described herein. The disclosure is also defined in the following claims.

EXAMPLE EMBODIMENTS

The following are numbered example embodiments of the apparatuses, devices, systems, and methods related to a seal system for sealing against a shaft. The below listing of examples or any other examples disclosed herein may be combined in whole or in part.

Elements of the examples disclosed herein are not limiting.

Example 1. A drink assembly comprising a vessel having an open top and a bottom; and a lid assembly removably connected to the vessel, the lid assembly comprising: a lid body; and a mouthpiece extending upwardly from the lid body, the mouthpiece comprising: a mouthpiece body having an asymmetrical upper end, asymmetric about a tapered end line drawn between two opposed tapered ends of the mouthpiece, the upper end comprising: a first rim including one angle of curvature; and a second rim opposite the first rim and including three differing angles of curvature; and a through hole extending throughout the mouthpiece body and fluidly coupled to the vessel.

Example 2. The drink assembly, system, device, apparatus, and method of any of the above Examples alone or in combination, wherein the first rim of the upper end of the mouthpiece body comprises a single angle of curvature defining a single convex rim.

Example 3. The drink assembly, system, device, apparatus, and method of any of the above Examples alone or in combination, wherein the second rim of the upper end of the mouthpiece body comprises a pair of convex portions and a concave portion in between the pair of convex portions defining a nadir between the opposing convex portions.

Example 4. The drink assembly, system, device, apparatus, and method of any of the above Examples alone or in combination, wherein the nadir of the second rim is configured to accommodate a center tubercle of an upper lip of a user.

Example 5. The drink assembly, system, device, apparatus, and method of any of the above Examples alone or in combination, wherein the pair of convex portions of the second rim slope upwardly and outwardly from the convex portion and downwardly to respective lateral ends.

Example 6. The drink assembly, system, device, apparatus, and method of any of the above Examples alone or in combination, wherein the pair of convex portions of the second rim are configured to respectively accommodate lateral tubercles of an upper lip of a user.

Example 7. The drink assembly, system, device, apparatus, and method of any of the above Examples alone or in combination, wherein the first rim of the upper end of the mouthpiece is configured to accommodate and engage with a lower lip of a user.

Example 8. The drink assembly, system, device, apparatus, and method of any of the above Examples alone or in combination, wherein the second rim of the upper end of the mouthpiece is configured to accommodate and engage with an upper lip of a user.

Example 9. The drink assembly, system, device, apparatus, and method of any of the above Examples alone or in combination, wherein the first and second rim of the upper end of the mouthpiece are configured to allow a user to drink therefrom without puckering their lips.

Example 10. The drink assembly, system, device, apparatus, and method of any of the above Examples alone or in combination, wherein the mouthpiece body further comprises opposed lateral ridges each defining a connection point between the first rim and the second rim.

Example 11. The drink assembly, system, device, apparatus, and method of any of the above Examples alone or in combination, wherein each lateral ridge is tapered from bottom to top.

Example 12. The drink assembly, system, device, apparatus, and method of any of the above Examples alone or in combination, wherein each lateral ridge defines a lateralmost apex.

Example 13. The drink assembly, system, device, apparatus, and method of any of the above Examples alone or in combination, wherein the opposed lateral ridges are configured to respectively accommodate opposed oral commissures of a mouth of a user such that the user need not pucker their lips to drink from the mouthpiece.

Example 14. The drink assembly, system, device, apparatus, and method of any of the above Examples alone or in combination, wherein the mouthpiece is angled forwardly such that a longitudinal axis of the mouthpiece is angled forwardly relative to a longitudinal axis of the vessel by approximately 15 degrees.

Example 15. The drink assembly, system, device, apparatus, and method of any of the above Examples alone or in combination, further comprising a cap pivotally connected to the lip body and configured to pivot in between a closed position in which the cap covers the mouthpiece and an open position in which the cap exposes the mouthpiece.

Example 16. The drink assembly, system, device, apparatus, and method of any of the above Examples alone or in combination, wherein the cap comprises a pair of internally disposed structural members configured to flank and abut the mouthpiece in the closed position of the cap.

Example 17. The drink assembly, system, device, apparatus, and method of any of the above Examples alone or in combination, wherein each structural member of the cap comprises a flat bottom wall extending inwardly from a side cap perimeter and an angled vertical wall extending upwardly from the flat bottom wall and terminating at the top of the cap, and wherein the structural members define a seal recess therebetween in which the seal is seated.

Example 18. The drink assembly, system, device, apparatus, and method of any of the above Examples alone or in combination, wherein the cap comprises an open bottom with a ridge that contacts a top of the lid body in the closed position.

Example 19. The drink assembly, system, device, apparatus, and method of any of the above Examples alone or in combination, wherein the cap includes a bottom, a first anchor post and a second anchor post extending downwardly from the bottom, and a seal connected to the bottom. The seal includes a vent protrusion fitted about the first anchor post and configured to seal a vent of the lid body when the cap is in its closed position, and a mouthpiece protrusion fitted about the second anchor post and configured to seal the through hole of the mouthpiece when the cap is in its closed position.

Example 20. The drink assembly, system, device, apparatus, and method of any of the above Examples alone or in combination, wherein the seal is removably connected to the drink assembly.

Example 21. The drink assembly, system, device, apparatus, and method of any of the above Examples alone or in combination, wherein the seal comprises an anvil-shaped end, a middle stem, and a rectangular end opposite the anvil-shaped end.

Example 22. The drink assembly, system, device, apparatus, and method of any of the above Examples alone or in combination, wherein the seal is comprised of silicone.

Example 23. The drink assembly, system, device, apparatus, and method of any of the above Examples alone or in combination, wherein the cap defines at least three securement points to rigidly secure the cap onto the lid body and seal the lid body to prevent leakage.

Example 24. The drink assembly, system, device, apparatus, and method of any of the above Examples alone or in combination, wherein the securement points are respectively defined by the open bottom contacting the top of the lid body, the mouthpiece and vent protrusions of the seal extending into the mouthpiece opening and the vent opening, and the internal structural members abutting the sides of the mouthpiece.

Example 25. The drink assembly, system, device, apparatus, and method of any of the above Examples alone or in combination, wherein the lid body comprises: an open bottom configured to connect to the drinking vessel; a top end comprising a first, flat top wall and a second, curved top wall extending above the flat top wall, the curved top wall configured to accommodate a nose of a user when drinking from the vessel; a vent extending through the curved top wall; and a main opening configured to accommodate liquid therethrough.

Example 26. The drink assembly, system, device, apparatus, and method of any of the above Examples alone or in combination, wherein the lid body further comprises a straw receiving receptacle formed on an interior of the lid body and aligned with the main opening.

Example 27. The drink assembly, system, device, apparatus, and method of any of the above Examples alone or in combination, further comprising a detachable straw attached to the straw receiving receptacle.

Example 28. The drink assembly, system, device, apparatus, and method of any of the above Examples alone or in combination, further comprising a cap pivotally connected to the lid body, the cap Example 29. The drink assembly, system, device, apparatus, and method of any of the above Examples alone or in combination, further comprising an activator button seated within an activator opening of the lid body.

Example 30. The drink assembly, system, device, apparatus, and method of any of the above Examples alone or in combination, wherein the activator button is configured to selectively lock and unlock the cap.

Example 31. The drink assembly, system, device, apparatus, and method of any of the above Examples alone or in combination, wherein the activator button comprises a front wall, a top wall, a recess in the top wall, a protruding tab at the rear of the top wall and extending forwardly into the hole, and a biasing member configured to forwardly bias the activator button such that the protruding tab is mechanically locked against the lid body.

Example 32. The drink assembly, system, device, apparatus, and method of any of the above Examples alone or in combination, wherein the cover comprises a locking member engageable with the protruding tab of the activator button.

Example 33. The drink assembly, system, device, apparatus, and method of any of the above Examples alone or in combination, further comprising a locking mechanism for selectively rendering the activator button inoperable and accordingly locking the cap.

Example 34. The drink assembly, system, device, apparatus, and method of any of the above Examples alone or in combination, wherein the mouthpiece has a longitudinal axis that is perpendicular to the top lid.

Example 35. The drink assembly, system, device, apparatus, and method of any of the above Examples alone or in combination, further comprising a bottom bumper connected to the bottom of the vessel.

Example 36. The drink assembly, system, device, apparatus, and method of any of the above Examples alone or in combination, wherein the bottom bumper comprises an annular tongue that fits within a corresponding annular groove at the bottom of the vessel.

Example 37. The drink assembly, system, device, apparatus, and method of any of the above Examples alone or in combination, wherein the bottom bumper is a snap on component.

Example 38. The drink assembly, system, device, apparatus, and method of any of the above Examples alone or in combination, wherein the lid body further comprises a scented holder or recess for housing a scent packet for scenting the liquid within the vessel.

Example 39. The drink assembly, system, device, apparatus, and method of any of the above Examples alone or in combination, further comprising a handle pivotally connected to the lid body.

Example 40. The drink assembly, system, device, apparatus, and method of any of the above Examples alone or in combination, wherein the handle has a body with an enclosed ring-loop structure.

Example 41. The drink assembly, system, device, apparatus, and method of any of the above Examples alone or in combination, wherein the handle has a body that is non-continuous or not ring shaped.

Example 42. The drink assembly, system, device, apparatus, and method of any of the above Examples alone or in combination, further comprising a hinge assembly which dually and pivotally connects the cap and the handle to the lid body.

Example 43. The drink assembly, system, device, apparatus, and method of any of the above Examples alone or in combination, wherein the lid body comprises one or more handle recesses and the handle is recessed into the lid body, thereby reducing an overall profile of the drinking assembly.

Example 44. The drink assembly, system, device, apparatus, and method of any of the above Examples alone or in combination, wherein the handle is configured to rotate in between an extended position wherein the handle extends above the lid body and a retraced position wherein the handle extends downwardly of the lid body.

Example 45. The drink assembly, system, device, apparatus, and method of any of the above Examples alone or in combination, wherein the lid body comprises a rear protrusion with a handle ledge, and the handle is configured to abut the handle ledge in its retracted position which accordingly forms a finger gap between the vessel and the handle to accommodate fingers of a user when gripping a top of the vessel.

Example 46. The drink assembly, system, device, apparatus, and method of any of the above Examples alone or in combination, wherein the lid body has a narrow rear protrusion which does not form a handle ledge, and thereby the handle rests against the vessel in its retracted position.

Example 47. The drink assembly, system, device, apparatus, and method of any of the above Examples alone or in combination, wherein the handle comprises a bent handle with an upper section and a lower section that extends downwardly at an angle away from the upper section.

Example 48. The drink assembly, system, device, apparatus, and method of any of the above Examples alone or in combination, wherein the cap comprises a handle recess configured to accommodate the upper section of the handle for allowing the handle to pivot independently of and unobstructed by the cap.

Example 49. The drink assembly, system, device, apparatus, and method of any of the above Examples alone or in combination, wherein the vessel is provided with one or more colors.

Example 50. The drink assembly, system, device, apparatus, and method of any of the above Examples alone or in combination, wherein the lid is provided without a cap.

Example 51. The drink assembly, system, device, apparatus, and method of any of the above Examples alone or in combination, wherein the lid is disposable and made by thermoforming a plastic sheet against a mold.

Example 52. The drink assembly, system, device, apparatus, and method of any of the above Examples alone or in combination, wherein the vessel is made from disposable paper or Styrofoam.

Example 53. The drink assembly, system, device, apparatus, and method of any of the above Examples alone or in combination, wherein the vessel is made from disposable plastic.

Example 54. The drink assembly, system, device, apparatus, and method of any of the above Examples alone or in combination, wherein the lid has a multitiered top wall, which includes a first top wall and a second raised top wall having a surface located above a surface of the first top wall, and wherein the mouthpiece extends upwardly from the second raised top wall.

Example 55. The drink assembly, system, device, apparatus, and method of any of the above Examples alone or in combination, further comprising a cap that is closeable over the mouthpiece, and wherein the cap has a lower rim that mates against the first top wall.

Example 56. The drink assembly, system, device, apparatus, and method of any of the above Examples alone or in combination, wherein the lid body has a top wall and a skirt depending from the top wall, and wherein the mouthpiece is unitarily formed with the top wall and is not rotatable relative to the top wall.

Example 57. The drink assembly, system, device, apparatus, and method of any of the above Examples alone or in combination, wherein the lid body is threaded to the vessel or is attached to the vessel by snap fit arrangement.

Example 58. The drink assembly, system, device, apparatus, and method of any of the above Examples alone or in combination, further comprising a straw receiving receptacle unitarily formed with the lid body, the straw receiving receptacle having a bore aligned with a bore of the mouthpiece.

Example 59. The drink assembly, system, device, apparatus, and method of any of the above Examples alone or in combination, further comprising a straw attached to the lid body via a straw receiving receptacle of the lid body.

Example 60. The drink assembly, system, device, apparatus, and method of any of the above Examples alone or in combination, wherein the bore of the straw receiving receptacle has a straw receiving axis, and wherein the straw receiving axis is parallel to a lengthwise axis of the vessel.

Example 61. The drink assembly, system, device, apparatus, and method of any of the above Examples alone or in combination, wherein the mouthpiece has a bore having a mouthpiece bore axis, and wherein the mouthpiece bore axis is angled to the lengthwise axis of the vessel.

Example 62. The drink assembly, system, device, apparatus, and method of any of the above Examples alone or in combination, wherein the cap has a step or transition section to define an upper cap region and a lower cap region, and wherein the lower cap region is sized and shaped to envelope a large area of the lid body while the upper cap region is raised to cover the mouthpiece.

Example 63. The drink assembly, system, device, apparatus, and method of any of the above Examples alone or in combination, wherein the upper cap region resembles a stylized T that comprises an anvil shape section and a generally rectangular section.

Example 64. The drink assembly, system, device, apparatus, and method of any of the above Examples alone or in combination, further comprising a seal attached to an interior of the cap.

Example 65. The drink assembly, system, device, apparatus, and method of any of the above Examples alone or in combination, wherein the cap comprises at least two anchor posts, and wherein the anchor posts project into protrusions of the seal.

Example 66. The drink assembly, system, device, apparatus, and method of any of the above Examples alone or in combination, wherein the seal has a first protrusion that presses against the mouthpiece to seal the mouthpiece in the cap closed position and a second protrusion that presses against the vent opening on the lid body to seal the vent opening in the cap closed position.

Example 67. The drink assembly, system, device, apparatus, and method of any of the above Examples alone or in combination, wherein the first protrusion has a sealing surface with a first area and the second protrusion has a sealing surface with a second seal area and wherein the first seal area is larger than the second seal area.

Example 68. The drink assembly, system, device, apparatus, and method of any of the above Examples alone or in combination, wherein the cap has at least three securement points that contact the lid body, and wherein the at least three securement points are arranged in a non-linear configuration.

Example 69. The drink assembly, system, device, apparatus, and method of any of the above Examples alone or in combination, wherein the cap comprises a spaced apart ribs, and the seal is wedged in between the spaced apart ribs.

Example 70. The drink assembly, system, device, apparatus, and method of any of the above Examples alone or in combination, wherein the asymmetric mouthpiece is sized and shaped to require minimal strain and puckering of a user's lips when drawing up fluid through the mouthpiece.

Example 71. The drink assembly, system, device, apparatus, and method of any of the above Examples alone or in combination, wherein the mouthpiece is usable without first aligning the mouthpiece to the lid body or to the vessel.

Example 72. The drink assembly, system, device, apparatus, and method of any of the above Examples alone or in combination, wherein the mouthpiece extends upwardly and forwardly from a top surface of the second top wall.

Example 73. The drink assembly, system, device, apparatus, and method of any of the above Examples alone or in combination, wherein the longitudinal axis of the mouthpiece is forwardly angled relative to the lengthwise axis of the vessel by about 5-25 degrees.

Example 74. The drink assembly, system, device, apparatus, and method of any of the above Examples alone or in combination, wherein the longitudinal axis of the mouthpiece is forwardly angled relative to the lengthwise axis of the vessel by about 10-20 degrees.

Example 75. The drink assembly, system, device, apparatus, and method of any of the above Examples alone or in combination, wherein the mouthpiece has a tapered base that resides within a perimeter or boundary of the second top wall of the cap such that the cap 116 fully surrounds, and seals the mouthpiece in the cap closed position.

Example 76. The drink assembly, system, device, apparatus, and method of any of the above Examples alone or in combination, wherein the tapered base of the mouthpiece has the same general outer contour as the contour at the rim of the mouthpiece.

Example 77. The drink assembly, system, device, apparatus, and method of any of the above Examples alone or in combination, wherein the rim of the mouthpiece has a first rim section with a simple curvature extending between two tapered ends for accommodating the bottom lip of the user.

Example 78. The drink assembly, system, device, apparatus, and method of any of the above Examples alone or in combination, wherein the rim of the mouthpiece has a second rim section with a compound curve with two or more radii of curvatures for accommodating the upper lip of the user.

Example 79. The drink assembly, system, device, apparatus, and method of any of the above Examples alone or in combination, wherein the second rim section comprises one or more flat sections located in between curved portions.

Example 80. The drink assembly, system, device, apparatus, and method of any of the above Examples alone or in combination, wherein the second rim portion comprises a pair of spaced apart end portions and a central portion in between the end portions, and wherein the central portion is concave.

Example 81. The drink assembly, system, device, apparatus, and method of any of the above Examples alone or in combination, wherein the concave of the central portion comprises a generally flat or planar surface to accommodate a tubercle or small rounded portion on the user's upper lip.

Example 82. The drink assembly, system, device, apparatus, and method of any of the above Examples alone or in combination, wherein the second rim portion comprises a first lateral start point defined by an end of a first portion, an upwardly curved portion of a first convex arc that terminates at a first highpoint, a smooth first transition point to a middle concave arc, a lowest point at a middle of the concave arc, a smooth second transition point, a second highpoint, a downwardly sloping portion of a second convex arc, and a second lateral endpoint.

Example 83. The drink assembly, system, device, apparatus, and method of any of the above Examples alone or in combination, wherein the first rim portion has a radius of curvature about 18 mm to about 30 mm.

Example 84. The drink assembly, system, device, apparatus, and method of any of the above Examples alone or in combination, wherein the radius of curvature of the first rim portion is about 21 mm to about 26 mm.

Example 85. The drink assembly, system, device, apparatus, and method of any of the above Examples alone or in combination, wherein the radius of curvature of the first rim portion is about 23 mm to 25 mm.

Example 86. The drink assembly, system, device, apparatus, and method of any of the above Examples alone or in combination, wherein the concave central portion of the second rim portion has a radius of curvature of about 21 mm to 26 mm.

Example 87. The drink assembly, system, device, apparatus, and method of any of the above Examples alone or in combination, wherein two end sections of the second rim portion each comprises a radius of curvature of about 17 mm to 20 mm.

Example 88. The drink assembly, system, device, apparatus, and method of any of the above Examples alone or in combination, wherein a concave surface at a central portion of the second rim portion is located between a first convex surface and a second convex surface, and wherein each of the first convex surface and the second convex surface has a radius of curvature of about 8 mm to 12 mm.

Example 89. The drink assembly, system, device, apparatus, and method of any of the above Examples alone or in combination, wherein the concave surface of the central portion of the second rim portion has a single radius curve with a radius of about 25 mm to about 33 mm.

Example 90. The drink assembly, system, device, apparatus, and method of any of the above Examples alone or in combination, wherein the concave surface of the central portion of the second rim portion has a single radius curve with a radius of about 27 mm to 31 mm.

Example 91. The drink assembly, system, device, apparatus, and method of any of the above Examples alone or in combination, wherein the concave surface of the central portion of the second rim portion has a single radius curve a generally flat region at a middle portion of the central portion.

Example 92. The drink assembly, system, device, apparatus, and method of any of the above Examples alone or in combination, wherein the mouthpiece has an overall width between two outermost end points of the upper rim of about 25 mm to about 32 mm in length.

Example 93. The drink assembly, system, device, apparatus, and method of any of the above Examples alone or in combination, wherein the overall width at the upper rim is about 29 mm.

Example 94. The drink assembly, system, device, apparatus, and method of any of the above Examples alone or in combination, wherein the mouthpiece has a base, and a width at the base between two outermost end points is about 36 mm to about 43 mm.

Example 95. The drink assembly, system, device, apparatus, and method of any of the above Examples alone or in combination, wherein the mouthpiece has a base, and a width at the base between two outermost end points is about 39.5 mm.

Example 96. The drink assembly, system, device, apparatus, and method of any of the above Examples alone or in combination, wherein the mouthpiece has a height of from the base to the upper rim of about 11 mm to about 16 mm.

Example 97. The drink assembly, system, device, apparatus, and method of any of the above Examples alone or in combination, wherein the mouthpiece has a height of about 13.5 mm.

Example 98. The drink assembly, system, device, apparatus, and method of any of the above Examples alone or in combination, wherein the mouthpiece has a gap between the two opposing rim portions, at outer surfaces of the two opposing rim portions, of about 11 mm to about 16 mm in length at a largest gap.

Example 99. The drink assembly, system, device, apparatus, and method of any of the above Examples alone or in combination, wherein the first rim portion comprises a compound curve of two or more radii that are within 20% of one another.

Example 100. The drink assembly, system, device, apparatus, and method of any of the above Examples alone or in combination, wherein the concave central portion of the second rim portion has an arc length of about 10% to about 40% of an arc length of one of the adjoining portions of the second rim portion.

Example 101. The drink assembly, system, device, apparatus, and method of any of the above Examples alone or in combination, wherein a top surface of the mouthpiece is substantially flat.

Example 102. The drink assembly, system, device, apparatus, and method of any of the above Examples alone or in combination, wherein a top surface of the mouthpiece is tapered from outer edges of an upper rim.

Example 103. The drink assembly, system, device, apparatus, and method of any of the above Examples alone or in combination, wherein the tapered top surface tapers downwardly towards a mouthpiece opening such that the mouthpiece opening is located below the outer edges of the upper rim.

Example 104. The drink assembly, system, device, apparatus, and method of any of the above Examples alone or in combination, wherein the tapered top surface tapers upwardly towards a mouthpiece opening such that the mouthpiece opening is located above the outer edges of the upper rim.

Example 105. The drink assembly, system, device, apparatus, and method of any of the above Examples alone or in combination, wherein the vessel has an upper section with a first diameter that is larger than a lower section with a second diameter.

Example 106. The drink assembly, system, device, apparatus, and method of any of the above Examples alone or in combination, wherein the mouthpiece is hollow and comprises a well with a well bottom surface has a drink opening formed therein.

Example 107. The drink assembly, system, device, apparatus, and method of any of the above Examples alone or in combination, wherein the drink opening in the well is smaller than an opening at an upper rim of the mouthpiece.

Example 108. The drink assembly, system, device, apparatus, and method of any of the above Examples alone or in combination, wherein the vessel has a round outer contour with an indented section that is recessed from the outer contour.

Example 109. The drink assembly, system, device, apparatus, and method of any of the above Examples alone or in combination, wherein the indented section has a surface that is generally flushed with a surface of a lower section of the vessel.

Example 110. The drink assembly, system, device, apparatus, and method of any of the above Examples alone or in combination, wherein the lid has a top wall and a skirt, and wherein the skit is sized and shaped to threadedly engage a container vessel or snap fit to the opening of the container vessel.

Example 111. The drink assembly, system, device, apparatus, and method of any of the above Examples alone or in combination, wherein the lid is a disposable lid, and the mouthpiece of the disposable lid is formed by thermoforming Example 112. The drink assembly, system, device, apparatus, and method of any of the above Examples alone or in combination, wherein the body of the mouthpiece has a top wall with a mouthpiece opening and has a mouthpiece wall thickness that is approximately the same as the wall thickness of the skirt section of the disposable lid.

Example 113. The drink assembly, system, device, apparatus, and method of any of the above Examples alone or in combination, wherein the disposable lid is usable with a base that is disposable or reusable.

Example 114. The drink assembly, system, device, apparatus, and method of any of the above Examples alone or in combination, wherein the skirt on the disposable lid can snap fit to the open top of the base, whether a disposable kind or a reusable kind.

What is claimed is:

1. A drink assembly comprising:

a vessel having an interior, an open top, and a bottom; and a lid assembly removably connected to the vessel, the lid assembly comprising:

a lid body; and a mouthpiece extending upwardly from the lid body, the mouthpiece comprising:

a mouthpiece body having an asymmetric rim defining an outer contour at an upper end and a base at a lower end, the asymmetric rim comprising:

a first rim portion located on a first side of a tapered line passing through two tapered ends of the mouthpiece body and a second rim portion located on a second side of the tapered line;

the first rim portion having a curved contour of a convex rim shape, relative to the tapered line, defined by a radius of curvature; and the second rim portion having a curved contour defined by a compound curve comprising two or more arcs of different radii, wherein said curved contour, relative to the tapered line, comprises a pair of convex portions and a concave portion located between the pair of convex portions;

a through hole extending through the mouthpiece body and in fluid communication with the interior of the vessel;

wherein the pair of convex portions account for a majority of an arc length of the second rim portion between the two tapered ends; and wherein the two tapered ends are each formed as a connection point between the first rim portion and the second rim portion and the two tapered ends define a maximum width of the mouthpiece at the upper end of the mouthpiece.

2. The drink assembly of claim 1, wherein the radius of curvature of the first rim portion of the mouthpiece body is about 18 mm to about 30 mm.

3. The drink assembly of claim 1, wherein the concave central portion of the second rim portion has an arc length of about 10% to about 40% of an arc length of one of the convex portions.

4. The drink assembly of claim 3, wherein the nadir of the second rim portion is configured to accommodate a center tubercle of an upper lip of a user and has a single radius curve of about 25 mm to about 33 mm.

5. The drink assembly of claim 3, wherein the pair of convex portions of the second rim portion slope upwardly, outwardly, and downwardly to respective lateral ends.

6. The drink assembly of claim 1, wherein the base of the mouthpiece comprises a pair of convex portions that accounts for a majority of an arc length of the base below the second rim portion.

7. The drink assembly of claim 1, wherein the concave portion of the second rim portion has a radius of curvature of 21 mm to 26 mm.

8. The drink assembly of claim 1, wherein each tapered end defines a lateralmost apex.

9. The drink assembly of claim 1, wherein the lid body has a forward end and a rear end, and wherein the mouthpiece is angled forwardly such that a longitudinal axis of the mouthpiece is angled forwardly relative to a longitudinal axis of the vessel.

10. The drink assembly of claim 6, further comprising a cap pivotally connected to the lid body and configured to pivot in between a closed position in which the cap covers the mouthpiece and an open position in which the cap exposes the mouthpiece.

11. The drink assembly of claim 10, wherein the cap comprises:

a bottom surface;

a first anchor post and a second anchor post extending downwardly relative to the bottom surface; and a seal connected to the bottom surface and comprising:

a vent protrusion fitted about the first anchor post and configured to seal a vent of the lid body when the cap is in its closed position; and a mouthpiece protrusion fitted about the second anchor post and configured to seal the through hole of the mouthpiece when the cap is in its closed position.

12. The drink assembly of claim 10, further comprising a locking mechanism comprising a sliding button embedded in a channel of the lid body.

13. The drink assembly of claim 10, further comprising a handle pivotably connected to the lid body.

14. The drink assembly of claim 13, wherein the handle is seated in the recessed groove in a stowed position.

15. The drinking assembly of claim 1, further comprising a straw receiving receptacle in fluid communication with the through hole extending through the mouthpiece.

16. The drinking assembly of claim 15, wherein a central axis passing through the straw receiving receptacle is angled to a central axis passing through the mouthpiece.

17. A lid assembly configured to be removably connected to a handheld drinking vessel, the lid assembly comprising:

a lid body; and a mouthpiece extending upwardly from the lid body, the mouthpiece comprising:

a mouthpiece body having an asymmetric rim defining an outer contour at an upper end and a base at a lower end, the asymmetric rim comprising:

a first rim portion located on a first side of a tapered line passing through two tapered ends of the mouthpiece body and a second rim portion located on a second side of the tapered line;

the first rim portion having a curved contour defined by a radius of curvature; and the second rim portion having a curved contour defined by a compound curve comprising three or more arcs of different radii;

a through hole extending through the mouthpiece body and in fluid communication with the interior of the vessel;

wherein, relative to the tapered line, the base of the mouthpiece comprises a pair of convex portions that accounts for a majority of an arc length of the base below the second rim portion; and wherein the two tapered ends are each formed as a connection point between the first rim portion and the second rim portion and the two tapered ends define a maximum width of the mouthpiece at the upper end of the mouthpiece.

18. The lid assembly of claim 17, wherein the lid body is attached to a handheld drinking vessel.

19. The lid assembly of claim 18, wherein the drinking vessel is disposable or is made from a stainless steel material.

20. The lid assembly of claim 17, wherein the lid body is disposable.

21. A lid assembly configured to be removably connected to a handheld drinking vessel, the lid assembly comprising:

a lid body comprising:

an open bottom configured to connect to the drinking vessel;

a top end comprising a top wall; and a main opening configured to accommodate liquid passing therethrough; and a mouthpiece extending upwardly from the top wall of the lid body, the mouthpiece comprising:

a mouthpiece body having an asymmetric rim defining an outer contour at an upper end and a base at a lower end, the asymmetric rim comprising:

a first rim portion located on a first side of a tapered line passing through two tapered ends of the mouthpiece body and a second rim portion located on a second side of the tapered line;

the first rim portion having a curved contour defined by a radius of curvature; and the second rim portion having a curved contour defined by at least one radius of curvature;

a through hole extending through the mouthpiece body and in fluid communication with the main opening;

wherein the base of the mouthpiece comprises, relative to the tapered line, a pair of convex portions with a concave portion located between the pair of convex portions and wherein the pair of convex portions accounts for a majority of an arc length of the base below the second rim portion; and wherein the two tapered ends at the upper end are each formed as a connection point between the first rim portion and the second rim portion and the two tapered ends define a maximum width of the mouthpiece at the upper end of the mouthpiece.

22. The lid assembly of claim 21, wherein the at least one radius of curvature of the second rim portion comprises a curved contour defined by a pair of convex portions and a concave portion located between the pair of convex portions.

23. The lid assembly of claim 22, wherein the concave portion comprises an arc length that is 10% to 40% of an arc length of one of the convex portions.

24. The lid assembly of claim 21, wherein the concave portion is truncated and has a flat central portion.

25. The lid assembly of claim 21, wherein the lid body is disposable.

26. The lid assembly of claim 21, wherein the lid body is attached to a handheld drinking vessel and comprises a vent opening.

27. The lid assembly of claim 26, wherein the handheld drinking vessel is made from a plastic material, a Styrofoam-based material, or paper-based material, or a stainless steel material.

28. The lid assembly of claim 21, further comprising a straw receiving receptacle in fluid communication with the through hole extending through the mouthpiece, and wherein a straw is attached to the straw receiving receptable.

29. The lid assembly of claim 21, wherein a gap between the first rim portion and the second rim portion is about 11 mm to about 16 mm in length.

30. The lid assembly of claim 21, where the second rim has a concave portion located between a pair of convex portions and wherein the concave portion has a single radius of curvature of 21 mm to 26 mm.

* * * * *